US012805644B2

(12) United States Patent
Leng

(10) Patent No.: US 12,805,644 B2
(45) Date of Patent: Nov. 24, 2026

(54) ELASTIC MATTRESS

(71) Applicant: Luhao Leng, Xiamen (CN)

(72) Inventor: Luhao Leng, Xiamen (CN)

( * ) Notice: Subject to any disclaimer, the term of this patent is extended or adjusted under 35 U.S.C. 154(b) by 0 days.

(21) Appl. No.: 18/973,179

(22) Filed: Dec. 9, 2024

(65) Prior Publication Data

US 2025/0194817 A1 Jun. 19, 2025

(30) Foreign Application Priority Data

Dec. 14, 2023 (CN) ..... 202311728367.0

(51) Int. Cl.
*A47C 27/07* (2006.01)
*A47C 27/06* (2006.01)

(52) U.S. Cl.
CPC ..... *A47C 27/07* (2013.01); *A47C 27/064* (2013.01)

(58) Field of Classification Search
CPC ..... A47C 27/07; A47C 27/064; A47C 23/002; A47C 23/005; A47C 23/0438; A47C 23/05; A47C 27/063; A47C 27/065
See application file for complete search history.

(56) References Cited

U.S. PATENT DOCUMENTS 53,579 A * 4/1866 Crandall ..... A47C 23/05 5/264.1
493,427 A * 3/1893 Foster ..... A47C 23/05 5/252
1,111,075 A * 9/1914 Lewis ..... A47C 23/05 5/252
1,678,400 A * 7/1928 Lewis ..... A47C 23/05 5/252
1,718,522 A * 6/1929 Brandreth ..... A47C 23/057 5/264.1

(Continued)

FOREIGN PATENT DOCUMENTS

CN 2694835 Y 4/2005
CN 201691472 U 1/2011

(Continued)

OTHER PUBLICATIONS

International Search Report cited in PCT/CN2024/137274, mailed Feb. 22, 2025, 8 pages.

(Continued)

*Primary Examiner* — Aaron R Eastman
(74) *Attorney, Agent, or Firm* — COOPER LEGAL GROUP LLC

(57) ABSTRACT

An elastic mattress, the elastic mattress includes a spring module and a cushion layer. The pre-compressed springs are inverted tapered springs, the pre-compressed springs form large end surfaces and small end surfaces, upper sections of the pre-compressed springs are disposed with one or more connection structures, adjacent pre-compressed springs are connected by the one or more connection structures or connected by the connection structures and third connecting members, straps with pull buckles are disposed on side edges around the cushion layer and form a detachable connection with one or more connection structures on one or more pre-compressed springs that are disposed on an outer periphery of the spring module or one or more third connecting members configured be connected to the one or more pre-compressed springs.

17 Claims, 68 Drawing Sheets

(56) References Cited

U.S. PATENT DOCUMENTS

| | | | | |
|---|---|---|---|---|
| 2,841,209 | A * | 7/1958 | Wetzler | A47C 23/05 5/310 |
| 2012/0200018 | A1 | 8/2012 | Paz et al. | |
| 2013/0334747 | A1* | 12/2013 | Spinks | A47C 27/064 267/91 |
| 2015/0230621 | A1* | 8/2015 | Spinks | A47C 31/00 5/698 |
| 2023/0200553 | A1* | 6/2023 | Leng | A47C 23/002 5/720 |
| 2024/0349903 | A1* | 10/2024 | Leng | A47C 27/065 |
| 2024/0358164 | A1* | 10/2024 | Leng | A47C 27/063 |
| 2024/0398129 | A1* | 12/2024 | Leng | A47C 27/064 |
| 2025/0176733 | A1* | 6/2025 | Leng | A47C 27/07 |
| 2025/0194810 | A1* | 6/2025 | Leng | A47C 27/063 |
| 2025/0194814 | A1* | 6/2025 | Leng | A47C 27/063 |
| 2025/0194819 | A1* | 6/2025 | Leng | A47C 23/005 |
| 2025/0288122 | A1* | 9/2025 | Leng | A47C 23/005 |
| 2025/0311852 | A1* | 10/2025 | Leng | A47C 17/16 |
| 2025/0311853 | A1* | 10/2025 | Leng | A47C 27/063 |
| 2025/0311861 | A1* | 10/2025 | Leng | A47C 23/002 |
| 2025/0331652 | A1* | 10/2025 | Leng | A47C 27/045 |
| 2025/0344873 | A1* | 11/2025 | Leng | A47C 27/065 |

FOREIGN PATENT DOCUMENTS

| | | | |
|---|---|---|---|
| CN | 204580618 | U | 8/2015 |
| CN | 112674540 | A | 4/2021 |
| CN | 115670171 | A | 2/2023 |
| CN | 115813150 | A | 3/2023 |
| CN | 115998114 | A | 4/2023 |
| CN | 116195850 | A | 6/2023 |
| CN | 116548774 | A | 8/2023 |
| CN | 221489536 | U | 8/2024 |
| CN | 222031953 | U | 11/2024 |

OTHER PUBLICATIONS

Written Opinion cited in PCT/CN2024/137274, mailed Feb. 22, 2025, 13 pages.

EP Search Report cited in EP24220291.9, mailed Aug. 18, 2025, 5 pages.

Office Action cited in EP24220291.9, mailed Aug. 29, 2025, 5 pages.

MX Office Action cited in MX/a/2026/006890, mailed Jul. 24, 2026, 20 pages.

* cited by examiner

ELASTIC MATTRESS

RELATED APPLICATIONS

This application claims priority to Chinese patent application number 202311728367.0, filed on Dec. 14, 2023. Chinese patent application number 202311728367.0 is incorporated herein by reference.

FIELD OF THE DISCLOSURE

The present disclosure relates to the technical field of outdoor camping equipment, and in particular relates to an elastic mattress.

BACKGROUND OF THE DISCLOSURE

As society increasingly progresses and living standards of people increasingly improve, outdoor sports are becoming increasingly popular and have become an important part of daily lives and entertainment of people. When camping outdoors, the inevitable question is: "How to sleep at night?", and how to sleep comfortably outdoors without a household large mattress.

The term "sleeping cushion" is used in camping to refer to an object as a bed mattress. A function of an outdoor sleeping cushion is to provide warmth, comfort, and dehumidification. The comfort is an important factor for having a good night outdoors. No matter how flat the outdoor environment, there will inevitably be uneven surfaces such as pebbles and tree stumps. Sleeping directly on the ground is bound to be uncomfortable. With respect to sleeping comfort options, the most common sleeping cushion is an air mattress that is inflatable to be easy to transport. However, the softness, firmness, and elasticity of the air mattress is still incomparable to that of a household large spring mattress. In addition, the air mattress needs to be inflated, and certain safety risks exist in use due to air leaks.

The reason why large elastic bed mattresses cannot be used outdoors is mainly due to weight and storage size. The weight and the storage size determine whether the mattress is easy to transport, as space in a car trunk is always limited. Most bed mattresses on the current market use springs as a modular structure of the bed mattress, and sizes of the bed mattress are generally designed to fit standard sizes corresponding to the beds, such as 1.5 m×1.9 m or 1.8 m×2.0 m. As the bed mattresses have large sizes and cannot be folded or disassembled so as to be very inconvenient to transport and store, the elastic bed mattresses having the springs as the bed mattress modular structure are particularly difficult to take out for outdoor camping for a person enjoying outdoor activities.

BRIEF SUMMARY OF THE DISCLOSURE

The main technical problem to be solved by the present disclosure is that bed mattresses using springs as bed mattress modules cannot be used for camping. Therefore, the present disclosure provides an elastic mattress that forms an open-type bed mattress, which can be easily disassembled and assembled at any time. The open-type structure also offers a certain degree of breathability and enhances comfort of the bed mattress.

In order to solve the aforementioned technical problems, the present disclosure provides an elastic mattress, the elastic mattress comprises a spring module and a cushion layer laid on an upper layer of the spring module. The spring module is a plurality of pre-compressed springs defining staggered or array arrangements, the plurality of pre-compressed springs are inverted tapered springs, the plurality of pre-compressed springs form large end surfaces and small end surfaces, the small end surfaces are downwardly disposed to form a bottom surface, the large end surfaces are upwardly disposed to form a lying supporting surface, upper sections of the plurality of pre-compressed springs are disposed with one or more connection structures, adjacent pre-compressed springs of the plurality of pre-compressed springs are connected by the one or more connection structures or connected by the one or more connection structures and one or more third connecting members, a plurality of straps with pull buckles are disposed on side edges around the cushion layer, and the plurality of straps with pull buckles form a detachable connection with one or more of the one or more connection structures on one or more of the plurality of pre-compressed springs that are disposed on an outer periphery of the spring module or one or more of the one or more third connecting members configured be connected to the one or more of the plurality of pre-compressed springs.

In a preferred embodiment, the plurality of pre-compressed springs comprise tapered spring sleeves and connecting seats extending from tapered end surfaces of the tapered spring sleeves, the tapered spring sleeves are configured to accommodate the inverted tapered springs thereinto to form pre-compressed forces applied to the inverted tapered springs, and the connecting seats are disposed at any position within upper sections as ⅓ of the tapered spring sleeve and are configured for installing the one or more connection structures.

In a preferred embodiment, the one or more third connecting members are made of elastic materials or flexible materials.

In a preferred embodiment, the spring module comprises one or more spring bases for assembling the plurality of pre-compressed springs, and the spring fixing seats are fixedly connected to the one or more spring bases, or the one or more spring bases are configured to be releasably buckled to the spring fixing seats.

In a preferred embodiment, a plurality of connection structures of the one or more connection structures are disposed on peripheries of the connecting seats, the plurality of connection structures comprise snapping positions and buckling positions, and one of the snapping positions on one of the plurality of pre-compressed springs forms a buckled connection with one of the buckling positions of another one of the plurality of pre-compressed springs.

In a preferred embodiment, the snapping positions are configured to squeeze the buckling positions to contract inward to release the buckled connection when being buckled in the buckling positions.

In a preferred embodiment, the snapping positions are configured such that parts of the snapping positions pass through the buckling positions to enable the parts passing through the buckling positions to rotate to form the buckled connection or released from the buckled connection when being disposed in the buckling positions.

In a preferred embodiment, a plurality of connection structures of the one or more connection structures are disposed on peripheries of the connecting seats, the plurality of connection structures comprise insertion holes and snapping slots in communication with the insertion holes, widths of the snapping slots are smaller than diameters of the insertion holes, the one or more third connecting members comprise one or more rotating parts and one or more protrusions disposed on one or more end surfaces of the one or more rotating parts, the one or more protrusions are matched with the insertion holes, four of the plurality of pre-compressed springs as a group are buckled together through one of the one or more third connecting members, and when the one or more protrusions are disposed in one or more of the insertion holes, the one or more rotating parts rotate to enable the one or more protrusions to be disposed in one or more of the snapping slots to form a buckled connection or disposed in the one or more of the insertion holes to release the buckled connection.

In a preferred embodiment, a plurality of connection structures of the one or more connection structures are disposed on upper ends of peripheries of the connecting seats, the plurality of connection structures are snapping points, a plurality of buckling rings are fixedly connected together to form the one or more third connecting members, each of the plurality of buckling rings of the one or more third connecting members comprises an annular groove and an avoidance opening, the avoidance opening is configured such that a corresponding one of the snapping points is plugged in, and a corresponding one of the snapping points slides in the annular groove to be misaligned with the avoidance opening to enable the corresponding one of the annular groove to be buckled to the snapping points to prevent the corresponding one of the snapping points from being upwardly pulled out.

In a preferred embodiment, the one or more connection structures are disposed at any position within sections of ½ or ⅓ of heights of the plurality of pre-compressed springs adjacent to the large end surfaces, or the one or more connection structures are buckled to the one or more third connecting members.

In a preferred embodiment, the one or more connection structures and the one or more third connecting members are made of elastic materials or flexible materials.

In a preferred embodiment, the elastic mattress further comprises a connecting base disposed on a lower layer of the spring module, one of the connecting base or the small end surfaces of the plurality of pre-compressed springs comprises tapered protrusions, the other one of the connecting base or the small end surfaces of the plurality of pre-compressed springs comprises tapered concave cavities, and the tapered protrusions and the tapered concave cavities are plugged with each other.

In a preferred embodiment, the connecting base is formed by splicing a plurality of second pre-compressed springs housing forward tapered springs on a spring connecting seat, the plurality of second pre-compressed springs housing the forward tapered springs comprise spring fixing seats configured such that the forward tapered springs are pre-compressed, and the spring fixing seats are fixedly connected to the spring connecting seat, or the spring connecting seat is configured to be releasably buckled to the spring fixing seats.

In a preferred embodiment, the connecting base is formed by a plug-in connection of multiple groups of frames in pairs, the frames are configured such that the plug-in connection is configured to be released, the multiple groups of the frames are divided into two groups of the frames having different lengths, the frame comprises at least one grid layer, and the at least one grid layer is configured to be sleeved on at least one of the plurality of pre-compressed springs by individual grids.

In a preferred embodiment, the frames are configured to comprise structures configured to be folded at least once along a length direction of the frames.

In a preferred embodiment, the connecting base is formed by detachably splicing a plurality of bottom plates, the plurality of bottom plates comprise grid structures, individual grids of the grid structures are configured to be sleeved on individual ones of the plurality of pre-compressed springs, the plurality of bottom plates comprise splicing structures, and the plurality of bottom plates are spliced using the splicing structures in pairs or spliced using the splicing structures and the one or more third connecting members.

An elastic mattress, the elastic mattress comprises a spring module and a cushion layer laid on an upper layer of the spring module. The spring module is spliced by a plurality of pre-compressed springs, the spring module is the plurality of pre-compressed springs defining staggered or array arrangements, the plurality of pre-compressed springs are inverted tapered springs, the plurality of pre-compressed springs form large end surfaces and small end surfaces, the small end surfaces are downwardly disposed to form a bottom surface, the large end surfaces are upwardly disposed to form a lying supporting surface, a plurality of snapping slots are disposed on any position within upper sections as ⅓ of the plurality of pre-compressed springs, adjacent pre-compressed springs of the plurality of pre-compressed springs form a buckled connection through one or more third connecting members and the plurality of snapping slots, each of the one or more third connecting members comprises two elastic snapping ends and a connecting part connected to the two elastic snapping ends, the connecting part has an elastic deformation amount configured to enable the two elastic snapping ends to move away from each other, the two elastic snapping ends are configured to squeeze the two elastic snapping ends to contract inward to release the buckled connection when being buckled in the plurality of snapping slots, a plurality of straps with pull buckles are disposed on side edges around the cushion layer, and the plurality of straps with pull buckles form a detachable connection with one or more connection structures on one or more of the plurality of pre-compressed springs that are disposed on an outer periphery of the spring module or the one or more third connecting members configured be connected to the one or more of the plurality of pre-compressed springs.

Compared with the existing techniques, the technical solution has the following advantages.

1. The present disclosure provides the elastic mattress that is easily assembled and has an open type designed for camping scenarios. The elastic mattress can achieve convenient disassembly and assembly, can be stored, and can be transported at any time during use. Additionally, breathability of the elastic mattress can be ensured, enhancing comfort during use.
2. The present disclosure provides the elastic mattress, in which the integrated spring module is converted into a plurality of pre-compressed springs in divided forms by setting the spring module and the plurality of pre-compressed springs in spliced forms. The buckled connection is performed by various buckle structures between the plurality of pre-compressed springs, which can be assembled when needed for use, and an operation is convenient. The bed mattress using springs as bed mattress modules can be used for camping, thereby improving comfort of the bed mattresses for camping.
3. The present disclosure provides the elastic mattress, in which the plurality of pre-compressed springs in inverted tapered forms are used to form the elastic mattress. The large end surfaces of the plurality of pre-compressed springs are used as the lying supporting surface, increasing a stressed area of the lying support surface, thus providing stability to the lying support surface and enhancing stability and comfort of the elastic mattress during use.

4. The present disclosure provides the elastic mattress, in which the one or more connection structures are disposed on the large end surfaces of the plurality of pre-compressed springs in inverted tapered forms, which prevents the plurality of pre-compressed springs with the wide tops and narrow bottoms from swaying unstably when being reversely assembled and being stressed and increases the connection stability between the plurality of pre-compressed springs in pairs.
5. The present disclosure provides the elastic mattress, in which a detachable design is used between the spring module and the soft cushion layer. Compared with the existing sealed and fully-enclosed structure between the soft cushion layer and the spring module, the breathability of the spring module is increased. Additionally, the soft cushion layer can be replaced, which is convenient and efficient to clean and can well meet the customization needs of different individuals.
6. The present disclosure provides the elastic mattress, in which the detachable design is used between the spring module and the soft cushion layer to meet portability for camping use, and the soft cushion layer can be laid as needed. The soft cushion layer is directly laid on the spring module, allowing for convenient disassembly and assembly.

DETAILED DESCRIPTION OF THE EMBODIMENTS

The technical solutions in the embodiments of the present disclosure will be described clearly and completely in combination with the accompanying drawings in the embodiments of the present disclosure. It is obvious that the described embodiments are merely a part of the embodiments of the present disclosure rather than all of the embodiments, and all other embodiments fall within the scope of protection of the present disclosure provided that they are obtained based on the embodiments of the present disclosure by a person of ordinary skill in the art without creative works.

In the description of the present disclosure, it should be noted that terms, such as "upper", "lower", "inner", "outer", "top", and "bottom", indicate orientations or positional relationships based on orientations or positional relationships shown in the accompanying drawings. These terms are merely used to easily describe the present disclosure and simplify the description of the present disclosure, rather than indicating or implying that a referred device or element should have a particular orientation or be constructed and operated with a particular orientation, and therefore should not to be understood as a limitation of the present disclosure. Furthermore, the terms "first" and "second" are merely used for descriptive purposes and should not be understood as indicating or implying relative importance.

In the description of the present disclosure, unless otherwise expressly specified and limited, it is noted that terms, such as "mounted", "provided with", "socketed", "sleeved", and "connected", should develop a broad understanding, for example, "connection" can be a wall-mountable connection, a detachable connection, a one-piece connection, a mechanical connection, an electrical connection, a direct connection, an indirect connection via an intermediate medium, or a communication between inner portions of two elements, and the specific meaning of the terms in the present disclosure can be understood in specific conditions for those of ordinary skill in the art.

Figure 1:
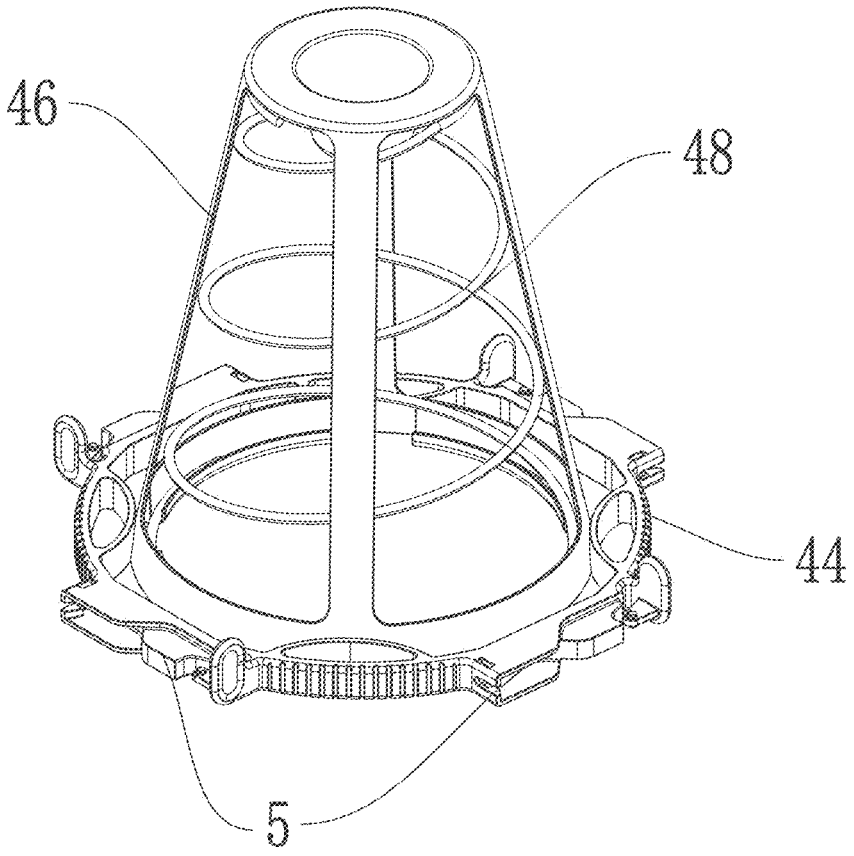
FIG. 1 is a diagrammatic view of a structure of a pre-compressed spring housing an inverted tapered spring in Embodiment 1 in the present disclosure.
Figure 2:
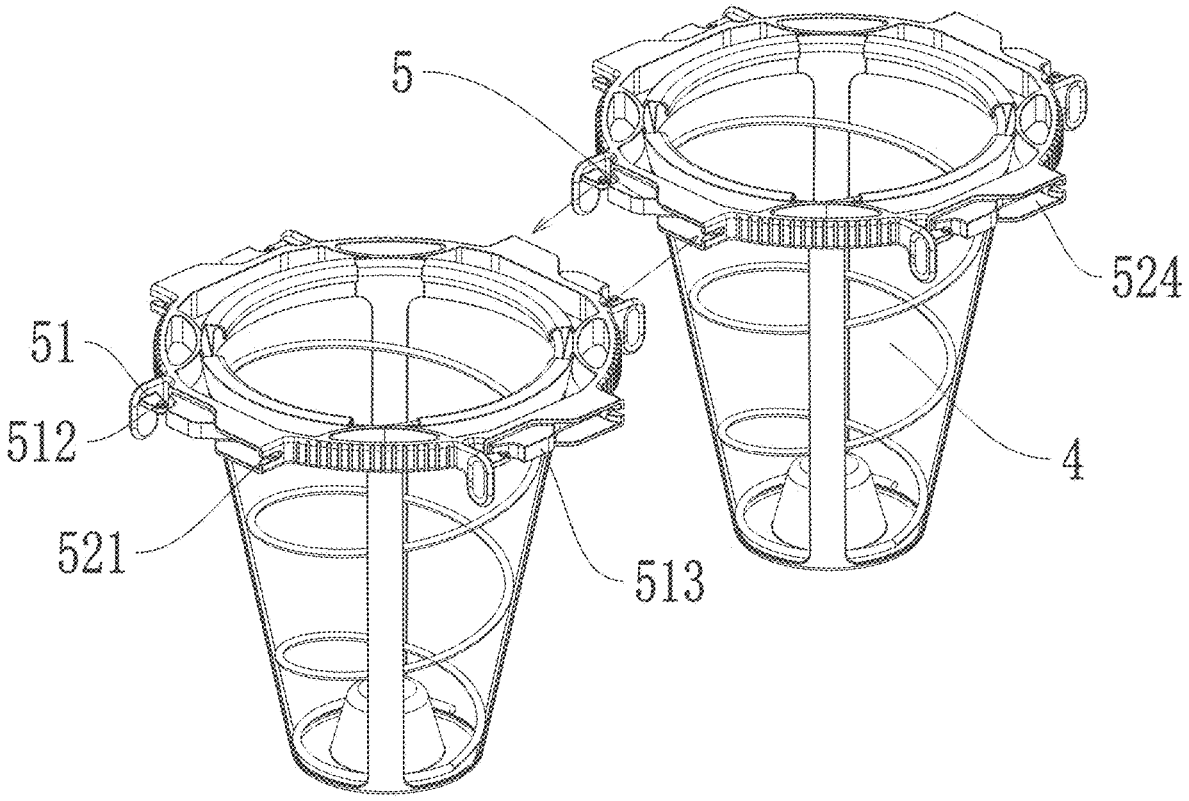
FIG. 2 is a view of a splicing cooperation of two pre-compressed springs (inverted tapered springs) in Embodiment 1 in the present disclosure.
Figure 3:
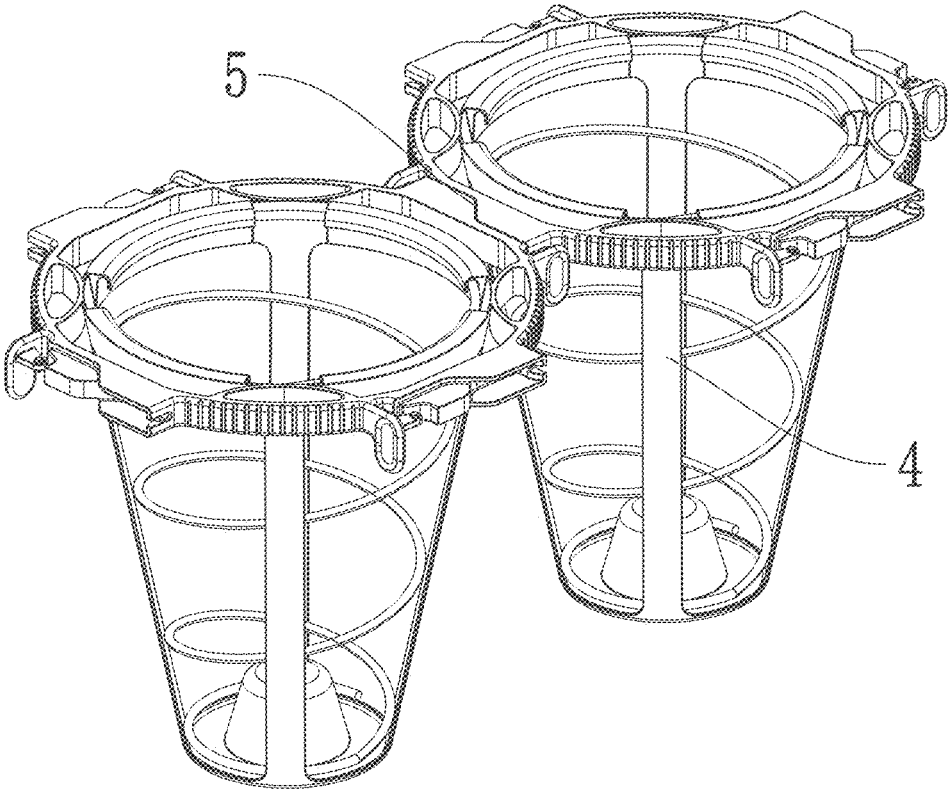
FIG. 3 is a view of the two pre-compressed springs (the inverted tapered springs) after being spliced in Embodiment 1 in the present disclosure.
Figure 4:
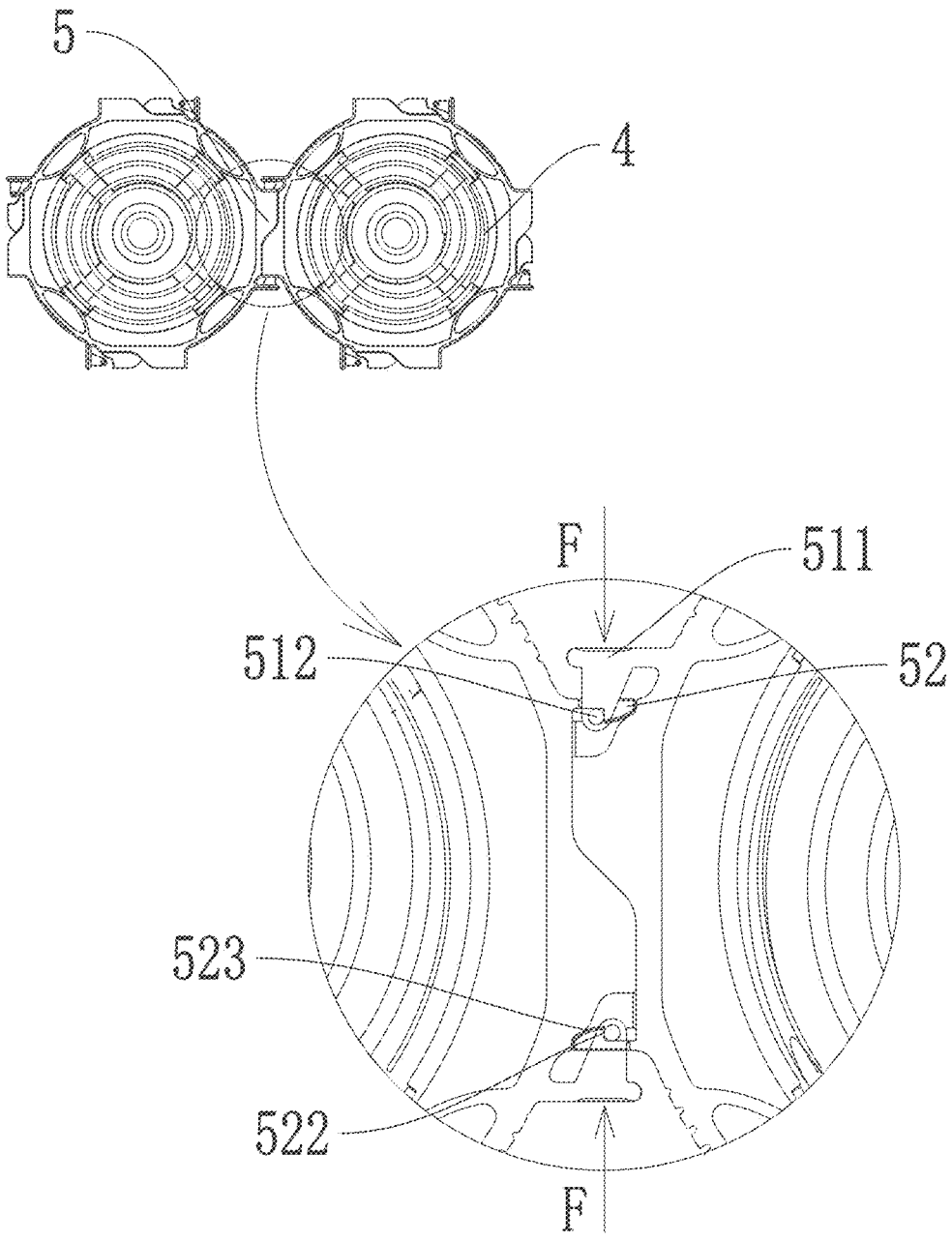
FIG. 4 is a sectional view of a spliced structure of the two pre-compressed springs (the inverted tapered springs) in Embodiment 1 in the present disclosure.
Figure 5:
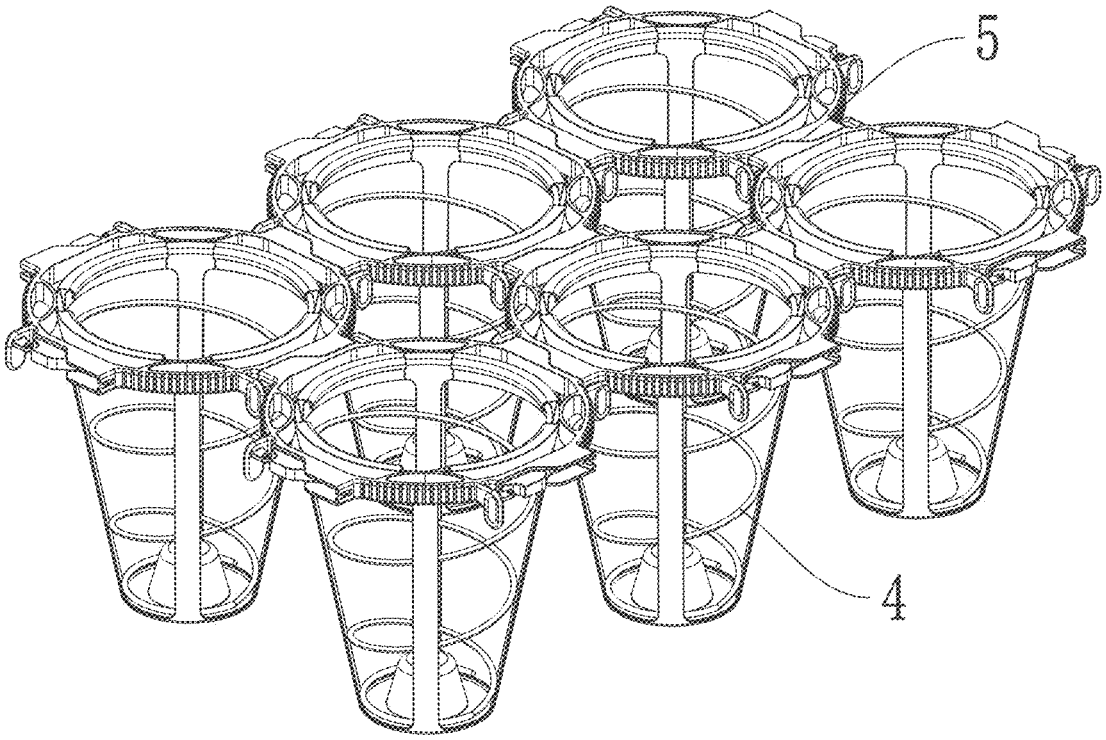
FIG. 5 is a view of a spliced connection of a plurality of pre-compressed springs (the inverted tapered springs) in Embodiment 1 in the present disclosure.
Figure 6:
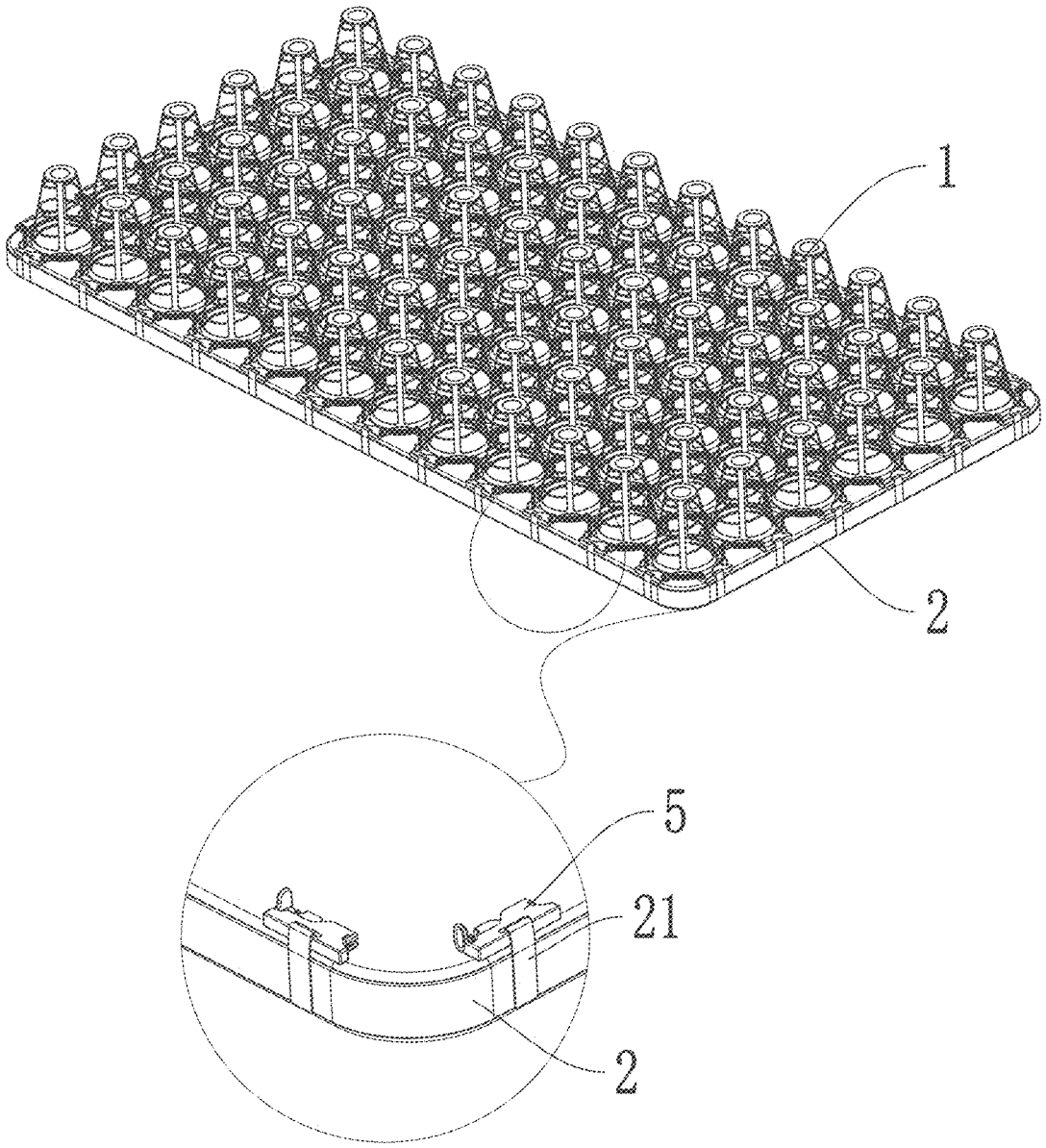
FIG. 6 is a diagrammatic view of a buckled connection of a spring module and a soft cushion layer in Embodiment 1 in the present disclosure.
Figure 7:
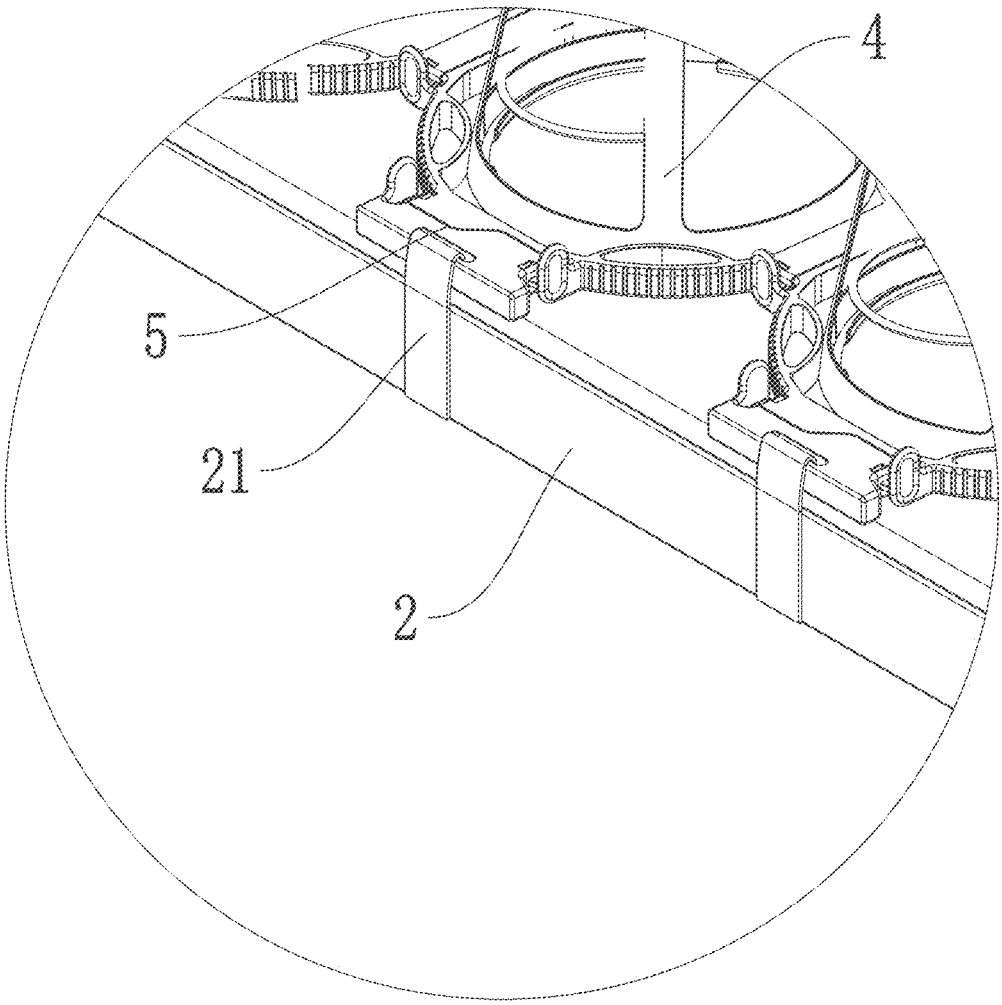
FIG. 7 is an enlarged view of a part of the buckled connection of the spring module and the soft cushion layer in Embodiment 1 in the present disclosure.
Figure 8:
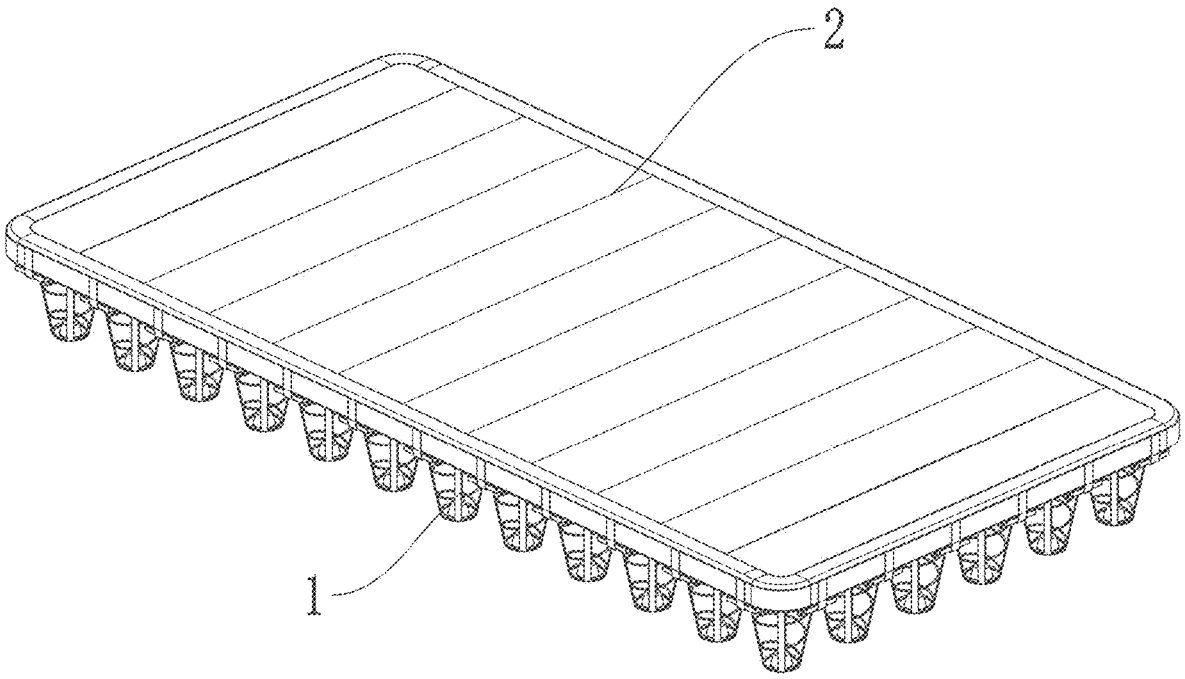
FIG. 8 is a view of a usage state of an elastic mattress in Embodiment 1 in the present disclosure.
Figure 43:
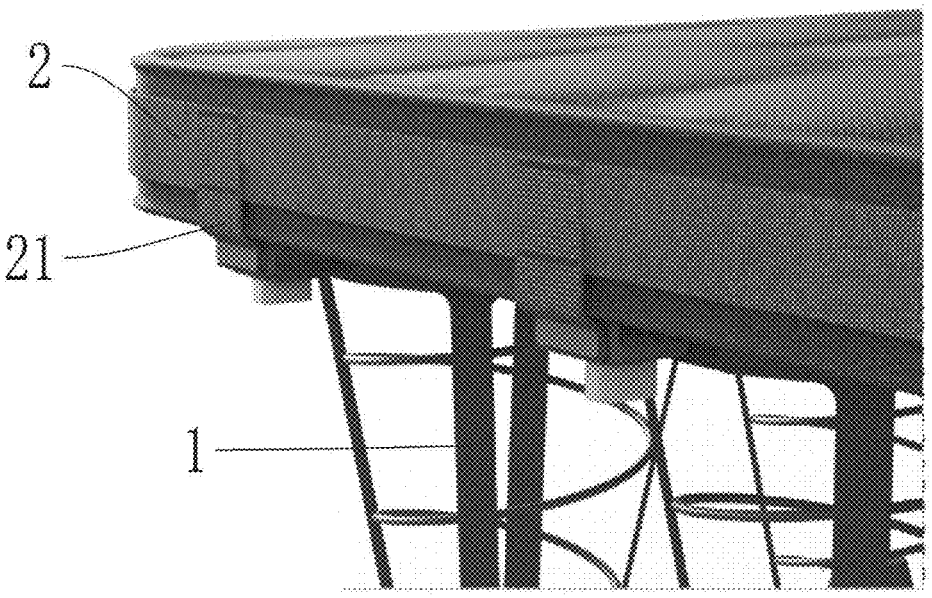
FIG. 43 is an enlarged view of a part of a usage state of an elastic mattress in embodiments in the present disclosure.
Figure 44:
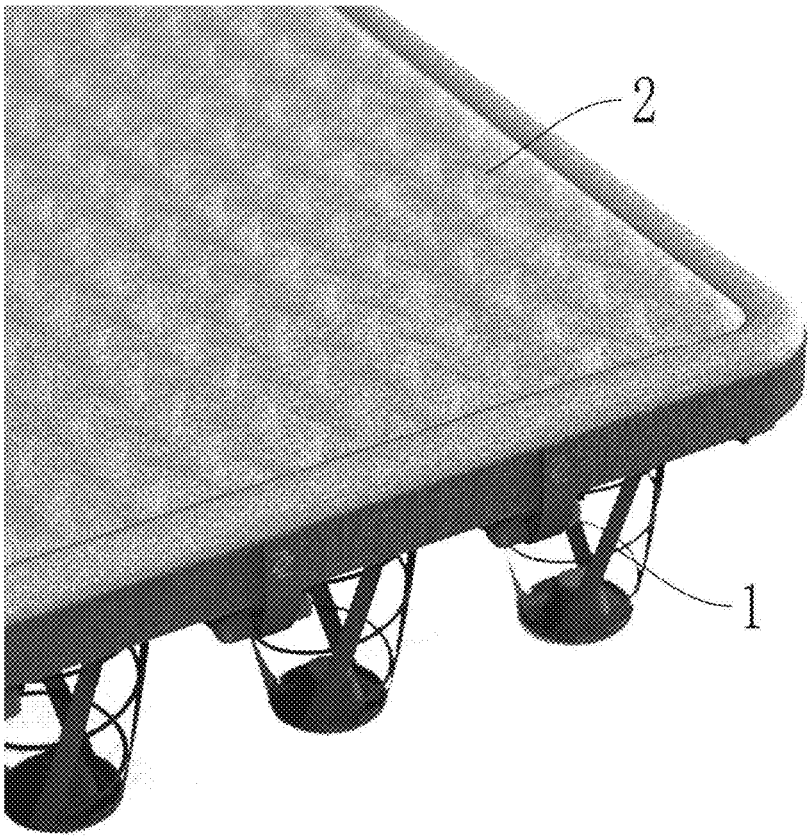
FIG. 44 is an enlarged view of a part of the elastic mattress after being spliced into an entity in embodiments in the present disclosure.
Figure 45:
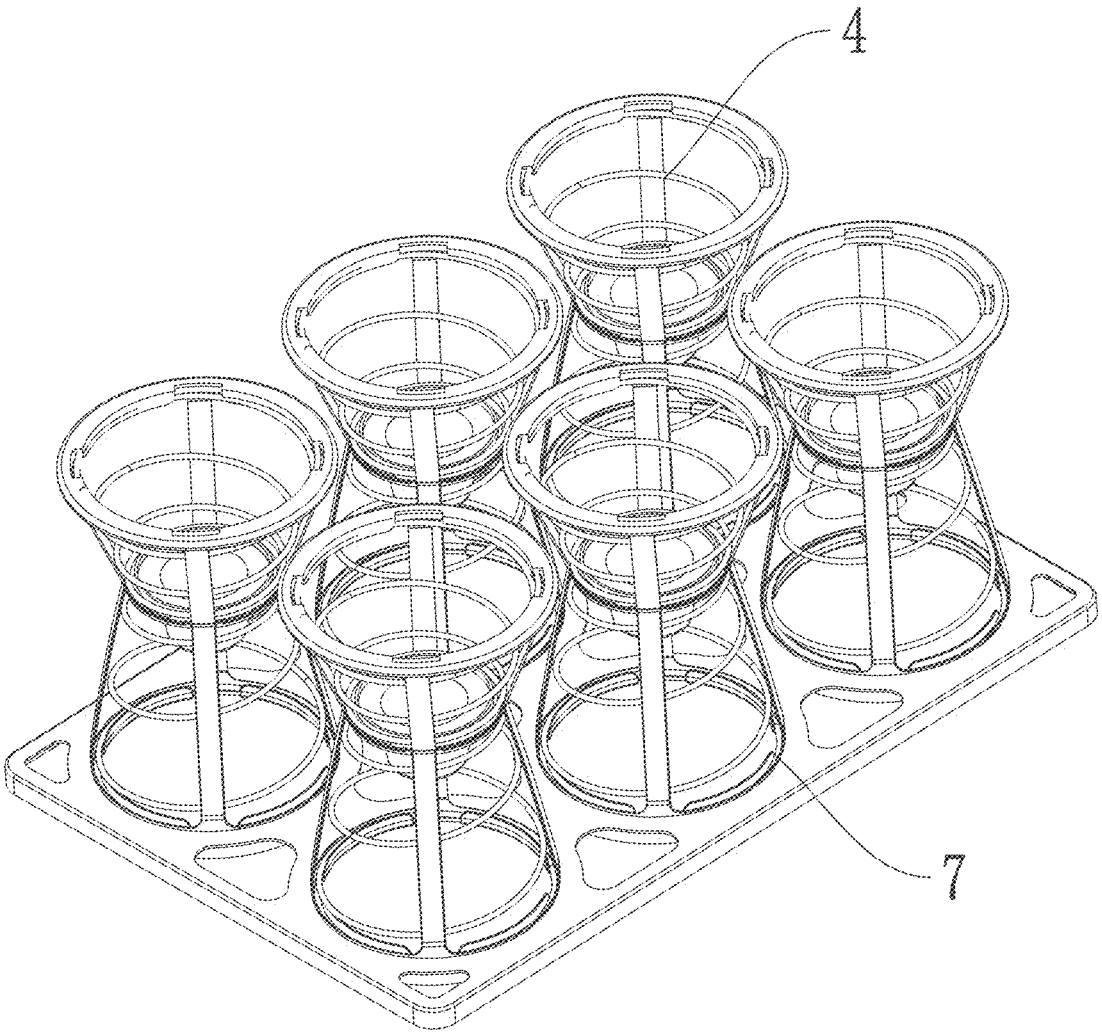
FIG. 45 is a diagrammatic view of a structure of a spring module in Embodiment 10 in the present disclosure.
Figure 46:
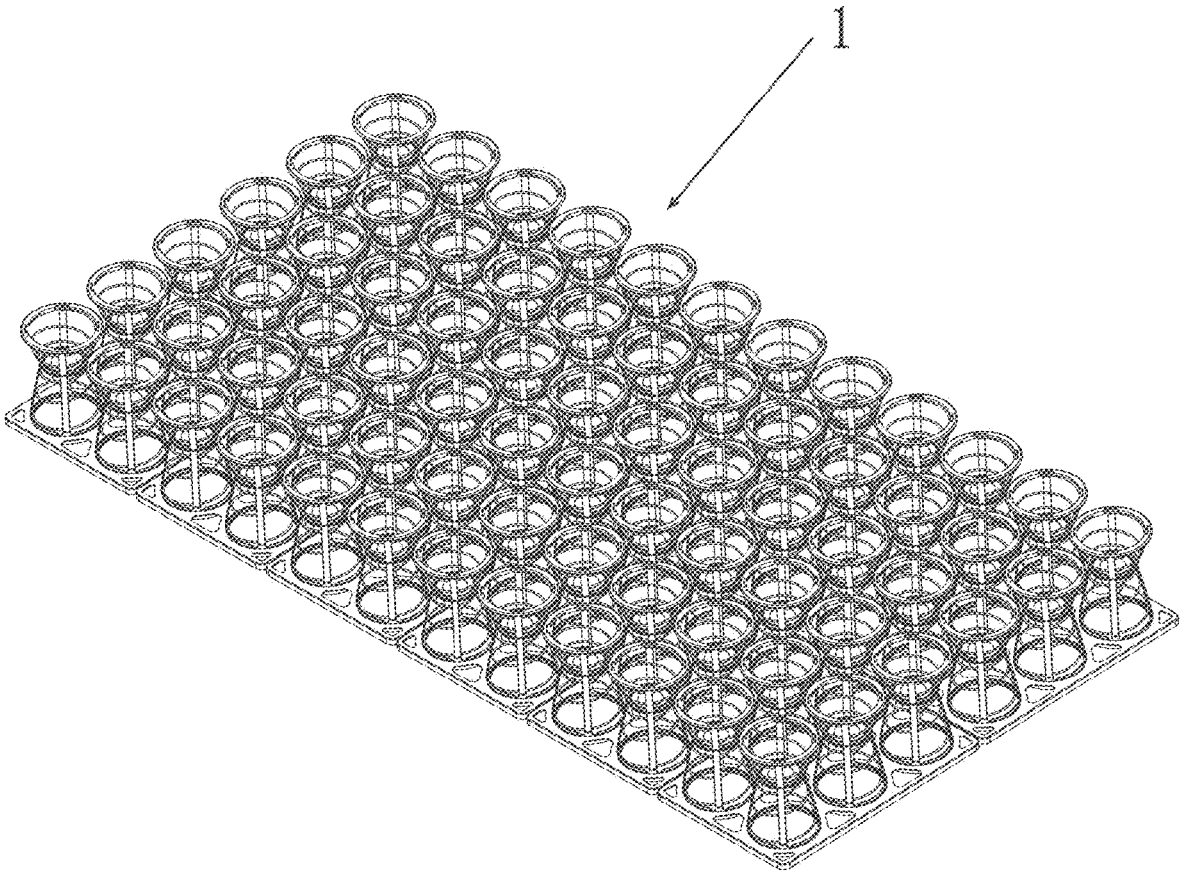
FIG. 46 is a diagrammatic view of a whole structure of the spring module in Embodiment 10 in the present disclosure.
Figure 47:
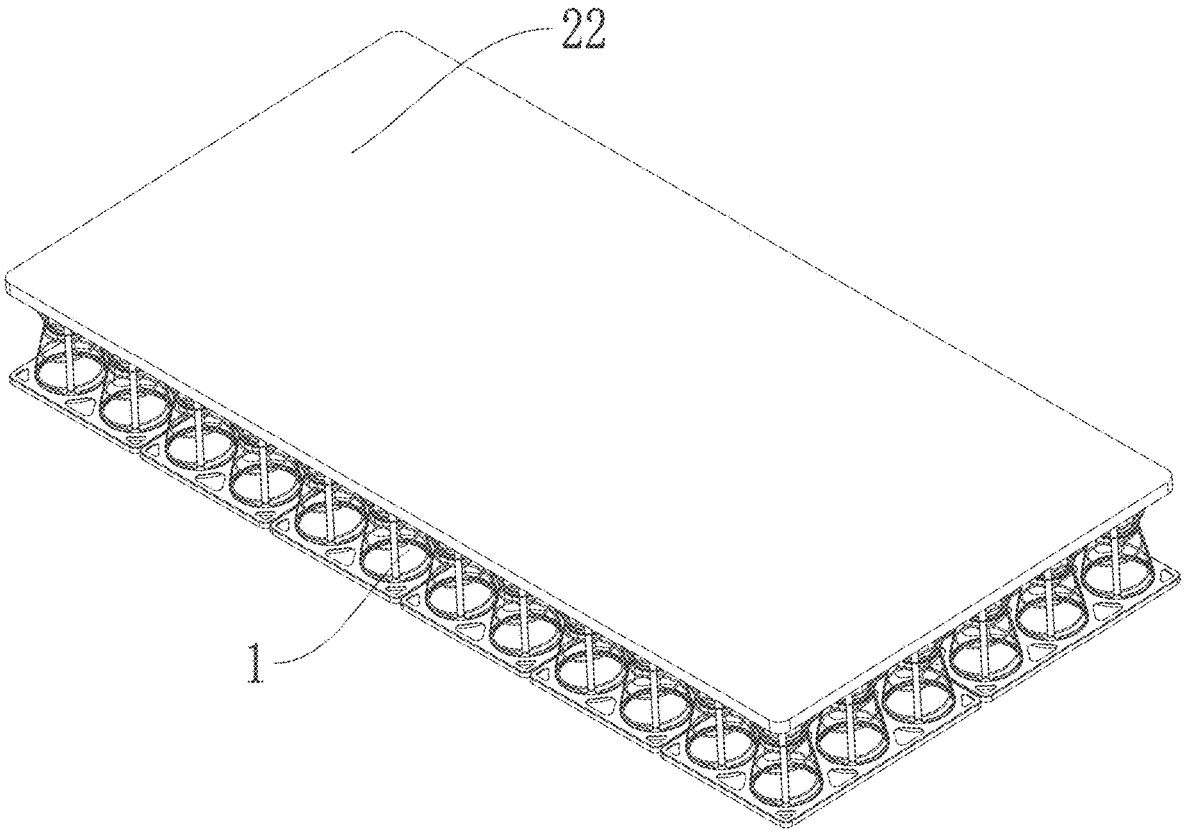
FIG. 47 is a diagrammatic view of the spring module laid with a soft cushion layer in Embodiment 10 in the present disclosure.
Figure 48:
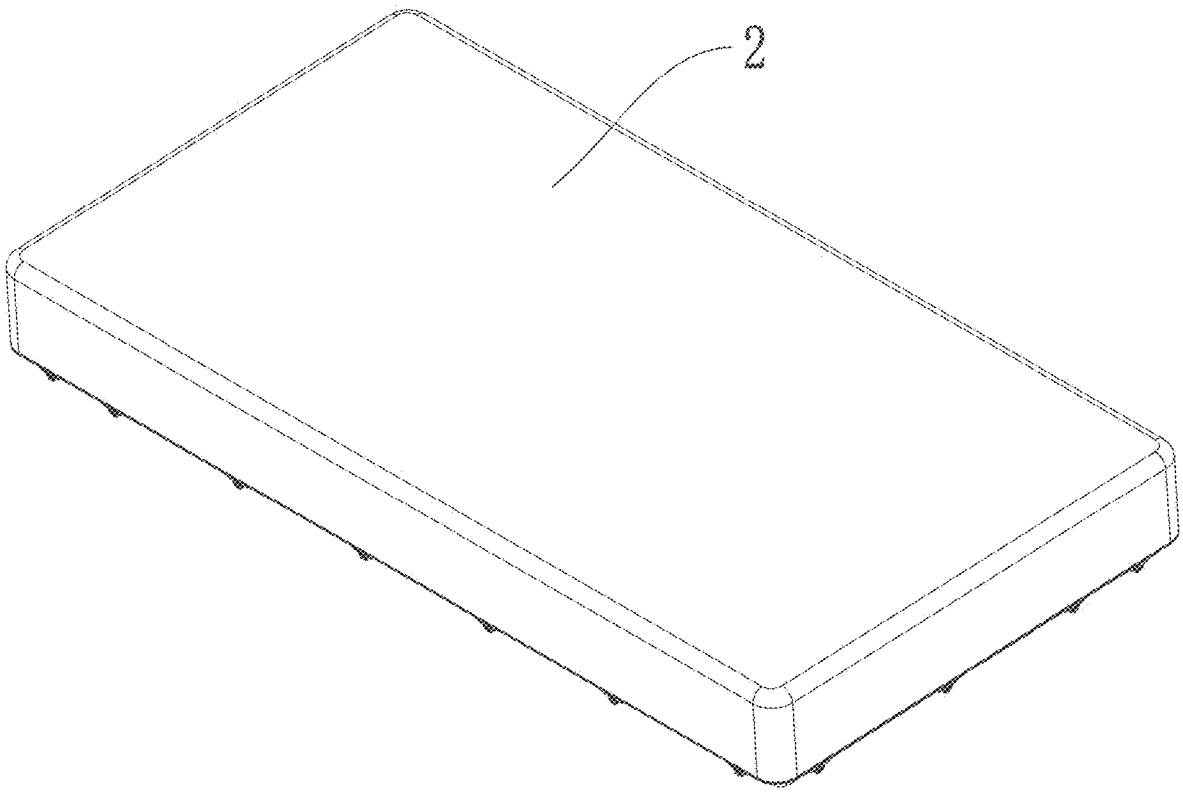
FIG. 48 is a view of a usage state of an elastic mattress in Embodiment 10 in the present disclosure.
Figure 49:
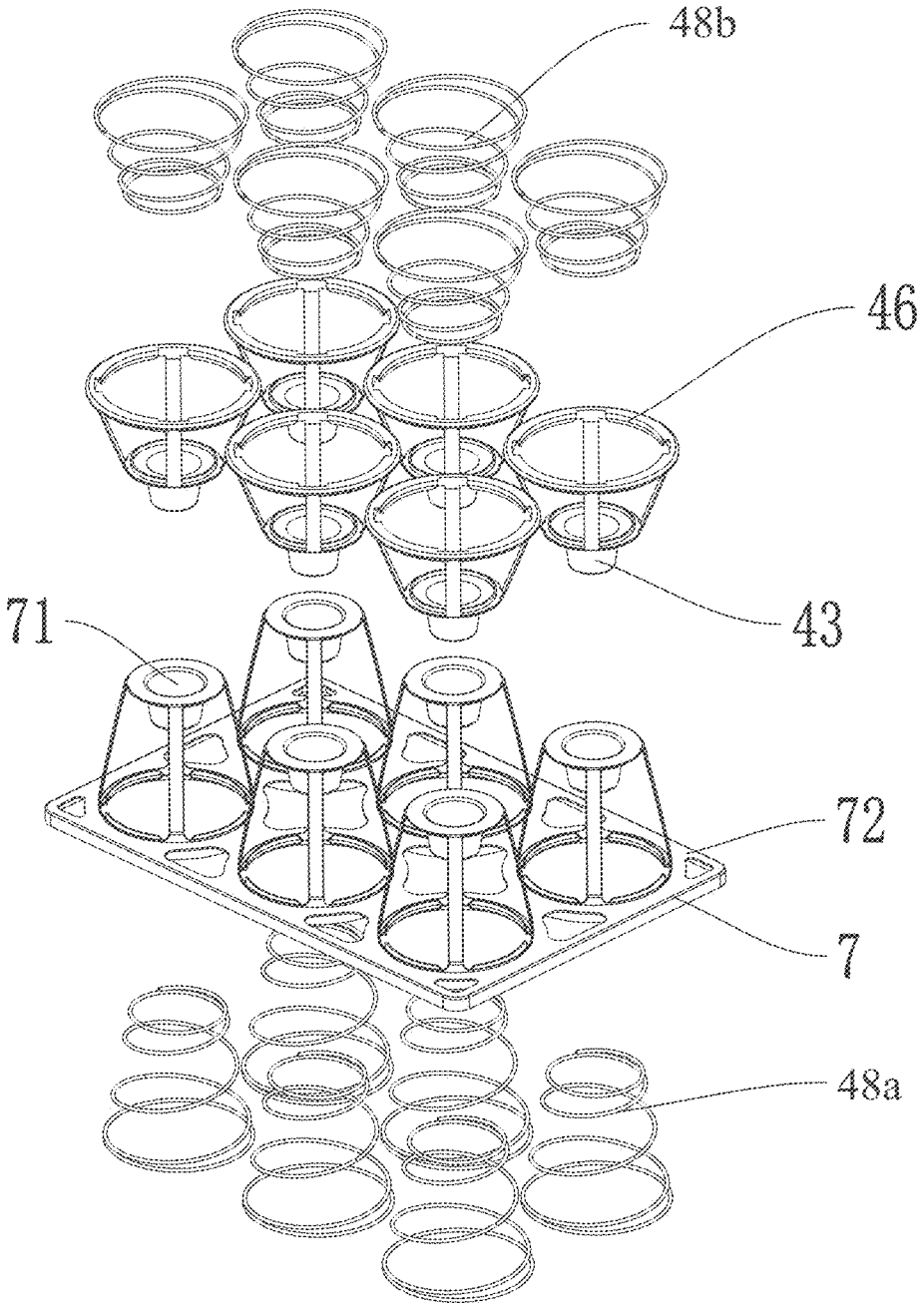
FIG. 49 is an exploded view of the spring module in Embodiment 10 in the present disclosure.
Figure 50:
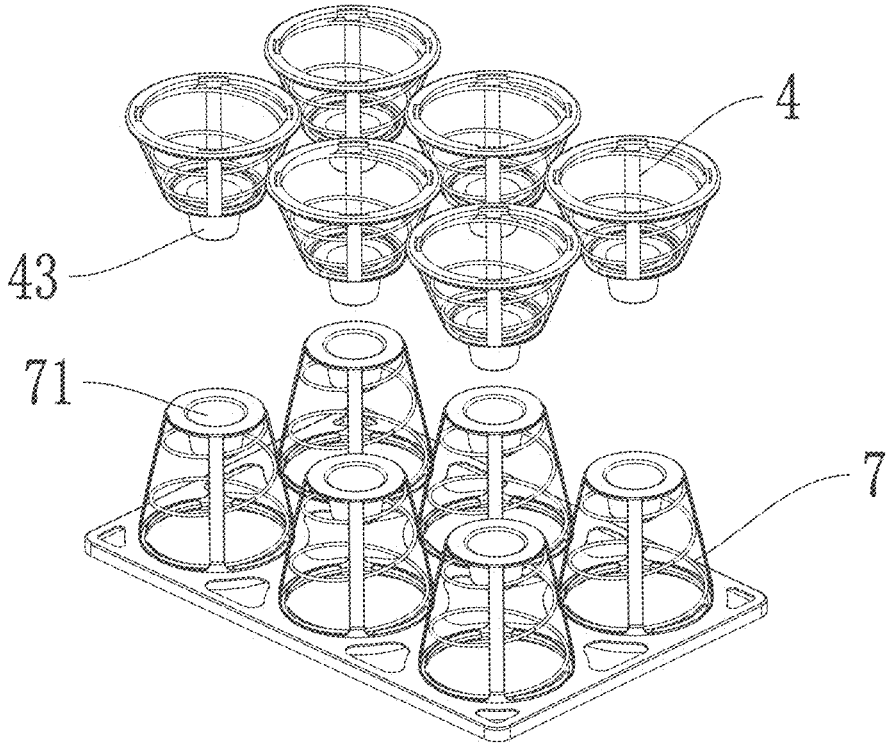
FIG. 50 is a diagrammatic view of a plug-in connection structure between a plurality of pre-compressed springs and a connecting base of a bottom layer in Embodiment 10 in the present disclosure.
Figure 51:
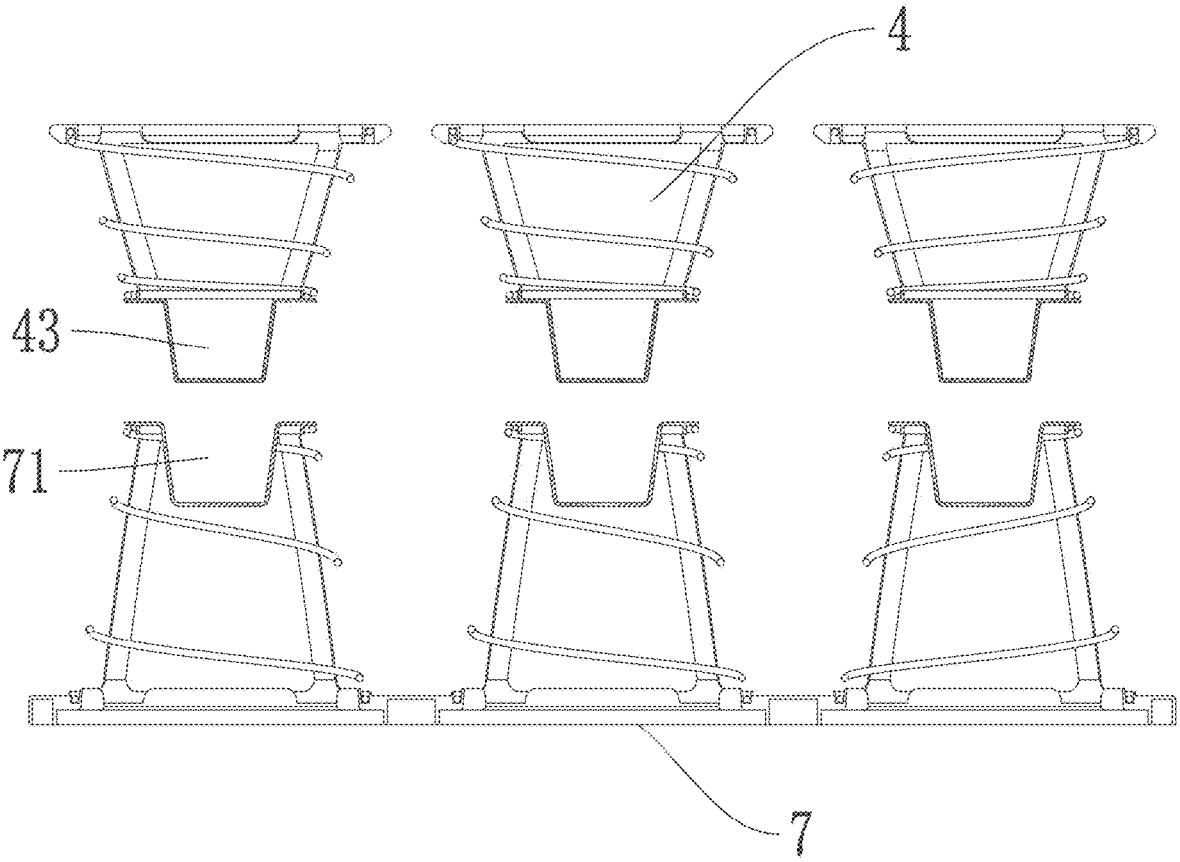
FIG. 51 is a sectional view of a plug-in connection structure between the plurality of pre-compressed springs and the connecting base of the bottom layer in Embodiment 10 in the present disclosure.
Figure 68:
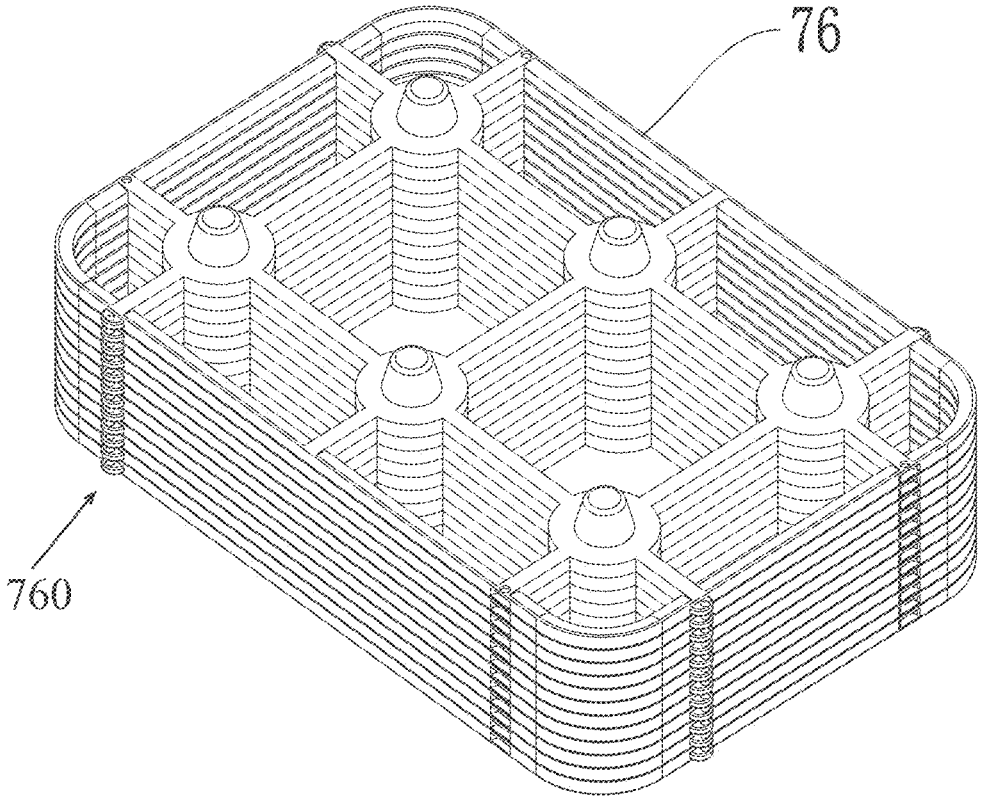
FIG. 68 is a diagrammatic view of the connecting base being folded for storage in Embodiment 17 in the present disclosure.

Referring to FIGS. 1-68, this embodiment provides an elastic mattress (e.g., FIGS. 43-44), and the elastic mattress comprises a spring module 1 and a soft cushion layer 2 laid on an upper layer of the spring module 1. The spring module 1 is a plurality of pre-compressed springs 4 defining staggered or array arrangements. The plurality of pre-compressed springs 4 are inverted tapered springs 48. The plurality of pre-compressed springs 4 have large end surfaces 41 and small end surfaces 42 (i.e., each of the plurality of pre-compressed springs 4 has a large end surface 41 and a small end surface 42). The small end surfaces 42 are downwardly disposed to form a bottom surface, and the large end surfaces 41 are upwardly disposed to form a lying supporting surface. Connection structures 5 are disposed on upper ends of the plurality of pre-compressed springs 4, and adjacent pre-compressed springs 4 of the plurality of pre-compressed springs 4 are connected together by corresponding ones of the connection structures 5 or by one or more third connecting members 6 connected to corresponding ones of the connection structures 5. A plurality of straps 21 with pull buckles are disposed on side edges around the soft cushion layer 2. The plurality of straps 21 with pull buckles form a detachable connection with corresponding ones of the connection structures 5 on corresponding ones of the plurality of pre-compressed springs 4 or corresponding ones of the one or more third connecting members 6 connected to the corresponding ones of the plurality of pre-compressed springs 4. The corresponding ones of the plurality of pre-compressed springs 4 are located at an outer periphery of the spring module 1.

Embodiment 1

Referring to FIGS. 1-8, an elastic mattress comprises a spring module 1 and a soft cushion layer 2 laid on an upper layer of the spring module 1. The spring module is spliced by a plurality of pre-compressed springs 4. The plurality of pre-compressed springs 4 comprise tapered spring sleeves 46 and connecting seats 44 extending from tapered end surfaces of the tapered spring sleeves 46. The tapered spring sleeves 46 are configured to accommodate inverted tapered springs 48 thereinto to apply a pre-compressed force to the plurality of inverted tapered springs 48. The connecting seats 44 are disposed at any position within upper sections as ⅓ of the tapered spring sleeves 46 so as to enable a plurality of connection structures 5 to be disposed.

Side edges of the connecting seats 44 are disposed with the plurality of connection structures 5, and the plurality of connection structures 5 comprise snapping positions 51 and buckling positions 52 (e.g., each of the plurality of connection structures 5 comprises a snapping position 51 and a buckling position 52). One of the snapping positions 51 on one of the plurality of pre-compressed springs 4 form a buckled connection with one of the buckling positions 52 on another of the plurality of pre-compressed springs 4. When the plurality of pre-compressed springs 4 are buckled to form the spring module 1 using the plurality of connection structures 5, the soft cushion layer 2 with a certain thickness is directly laid on a formed lying support surface of the spring module 1. The soft cushion layer 2 can be a whole cushion layer compositely molded or a combination of a plurality of cushion layers with different softness and hardness so as to form the soft cushion layer 2 with different hardness and tactility.

A plurality of straps 21 with pull buckles are disposed on the side edges around the soft cushion layer 2. The plurality of straps 21 with pull buckles form a detachable connection with corresponding ones of the connection structures 5 on corresponding ones of the plurality of pre-compressed springs 4. Corresponding ones of the plurality of pre-compressed springs 4 are located at an outer periphery of the spring module 1, and the soft cushion layer 2 is laid on an upper side of the spring module 1 to form a semi-enclosed form.

The plurality of connection structures 5 designed in this embodiment comprise the snapping positions 51 and the buckling positions 52, and the snapping positions 51 are configured to squeeze the buckling positions 52 to contract inward to release the buckled connection when being buckled in the buckling positions 52.

Specifically, the snapping positions 51 comprise elastic members 511 and snapping points 512 disposed on single sides of the elastic members 511, and the buckling positions 52 comprise U-shaped buckling grooves 521 and steps 522 disposed within the U-shaped buckling grooves 521. End surfaces of the steps 522 are configured to be buckled to the snapping points 512. Single guiding surfaces 523 obliquely extend from insertion openings of the U-shaped buckling grooves 521 to the steps 522 along an inserting direction of the snapping points 512, and the guiding surfaces 523 enable the snapping points 512 to contract inward to provide avoidance for insertion of the snapping positions 51. The elastic members 511 have deformation amounts for the snapping points 512 contracting inward to cooperate with the guiding surfaces 523 to form avoidance structures, or for the snapping points 512 being released from the steps 522.

During operation, the snapping positions 51 are inserted into the U-shaped buckling grooves 521 along the insertion direction, the snapping points 512 contract inward due to the guiding surfaces 523, and at the same time, the elastic members 511 contract inward to accumulate an elastic force. When the snapping points 512 are misaligned with the guiding surfaces 523 along the insertion direction, the snapping points 512 are inserted into the U-shaped buckling grooves 521 and are located on rear sides of the steps 522 along the insertion direction, and the snapping points 512 abut the steps 522 due to rebound resilience of the elastic members 511, so as to be positioned to form the buckled connections. When disassembly is required, the snapping points 512 on both sides of the plurality of connection structures 5 are merely pressed to contract inward to enable the snapping points 512 to be separated from abutting the steps 522 to release the buckled connection.

In this embodiment, the plurality of connection structures 5 comprise single protruding parts 513 and single concave parts 524 between the snapping positions 51 and the buckling positions 52 (e.g., each of the plurality of connection structures 5 comprises a protruding part 513 and a concave part 524 between a snapping position 51 and a buckling position 52). When the buckled connection is formed, one of the protruding parts 513 of the plurality of connection structures 5 on one of the plurality of pre-compressed springs 4 is inserted into one of the concave parts 524 on another of the plurality of pre-compressed springs 4 to form a plug-in connection, and stability of the buckled connection between two of the plurality of connection structures 5 can be increased.

In this embodiment, structures of the plurality of straps 21 with pull buckles of the soft cushion layer 2 configured to form detachable connection with the plurality of connection structures 5 are the same as the plurality of connection structures on the plurality of pre-compressed springs 4 to form an auxiliary buckled structure.

Embodiment 2

Figure 9:
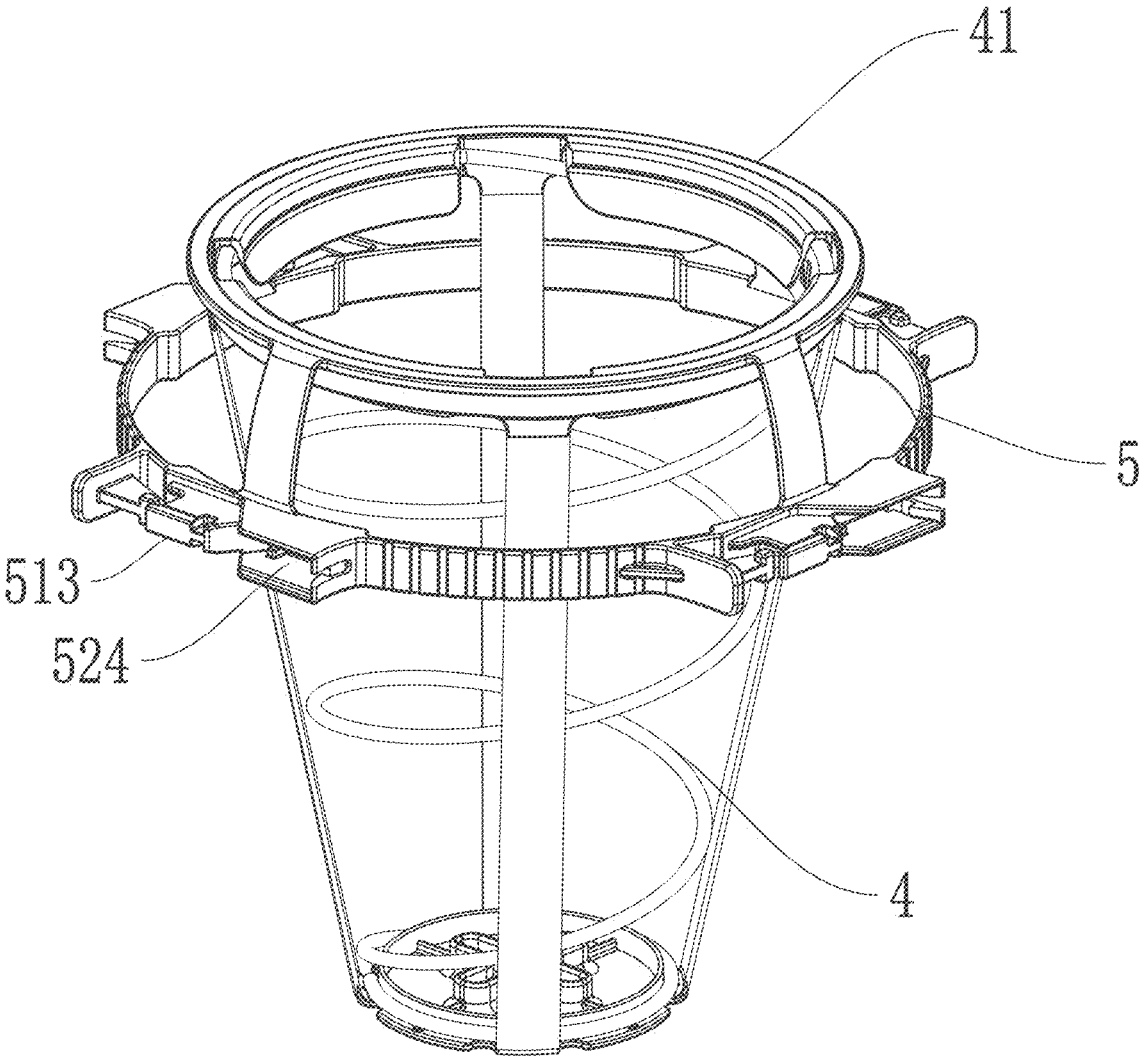
FIG. 9 is a diagrammatic view of a positional relationship of a connection structure disposed on a pre-compressed spring in Embodiment 2 in the present disclosure.
Figure 10:
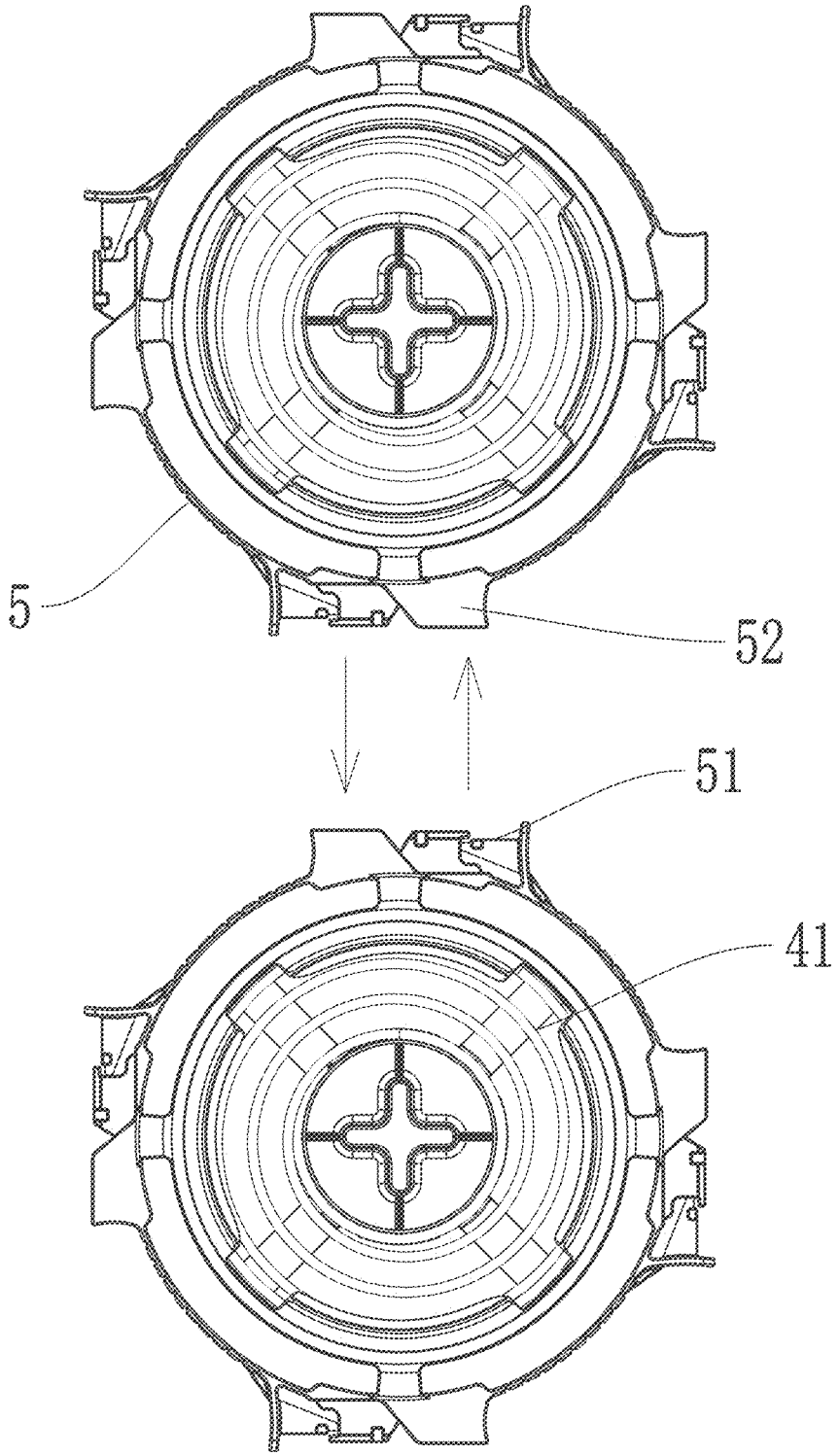
FIG. 10 is a diagrammatic view of a splicing connection of pre-compressed springs using connection structures in Embodiment 2 in the present disclosure.
Figure 11:
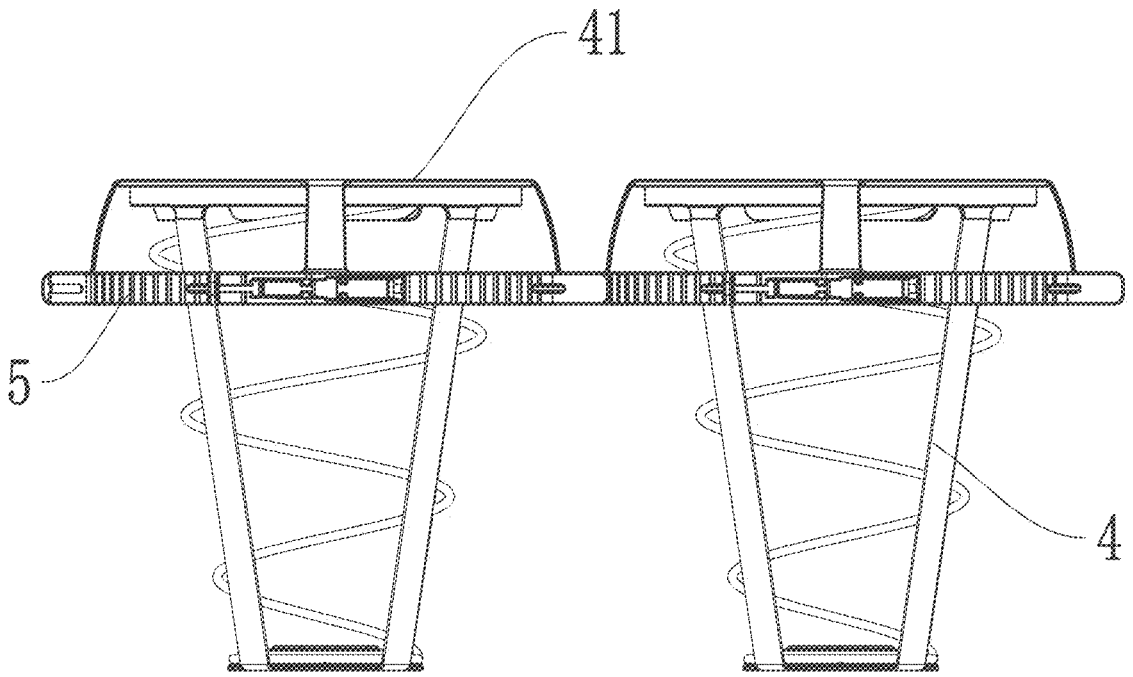
FIG. 11 is a view of a positional relationship of the connection structures on the pre-compressed springs after being spliced by in Embodiment 2 in the present disclosure.
Figure 12:
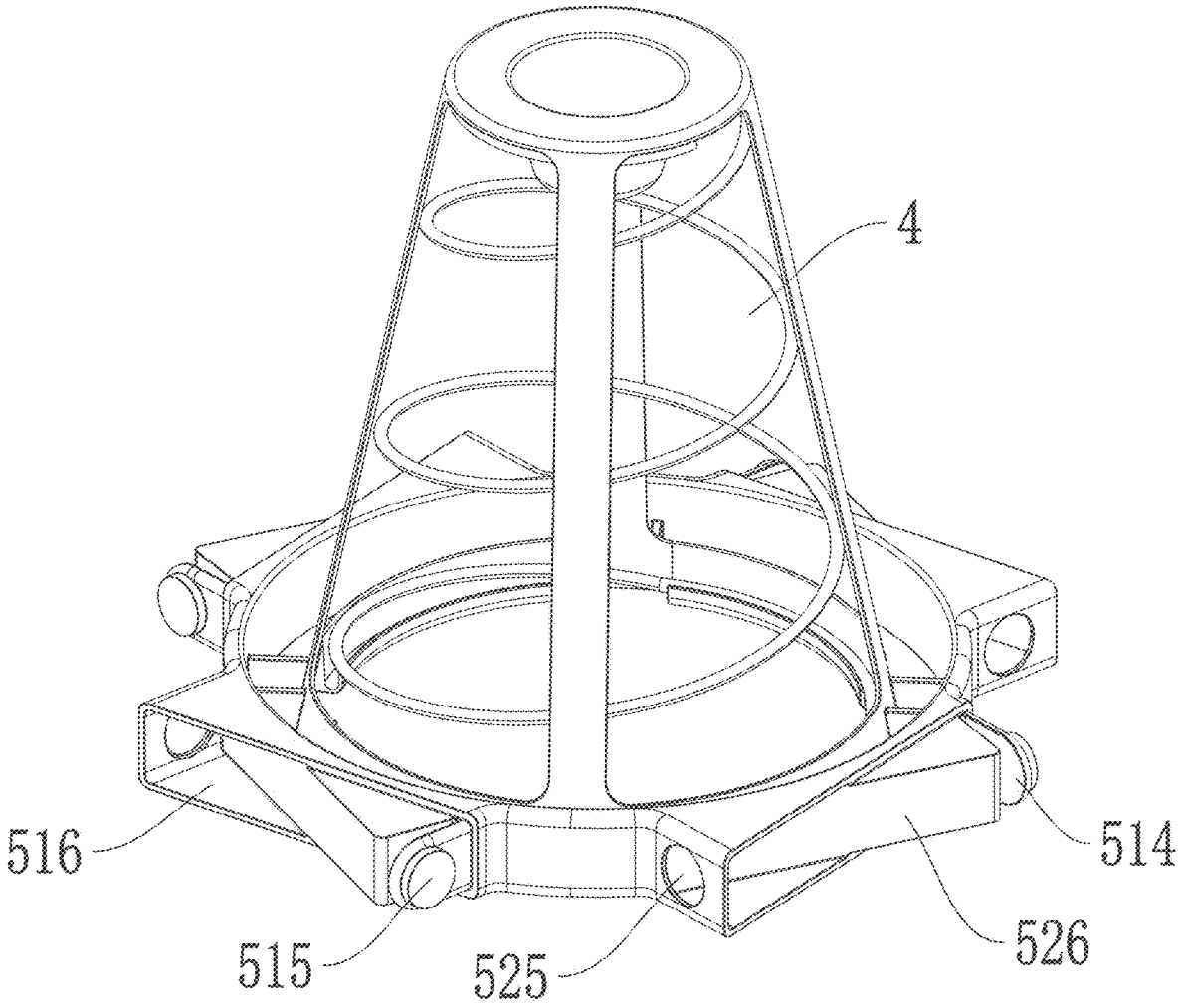
FIG. 12 is a diagrammatic view of a structure of a pre-compressed spring housing an inverted tapered spring in Embodiment 3 in the present disclosure.
Figure 13:
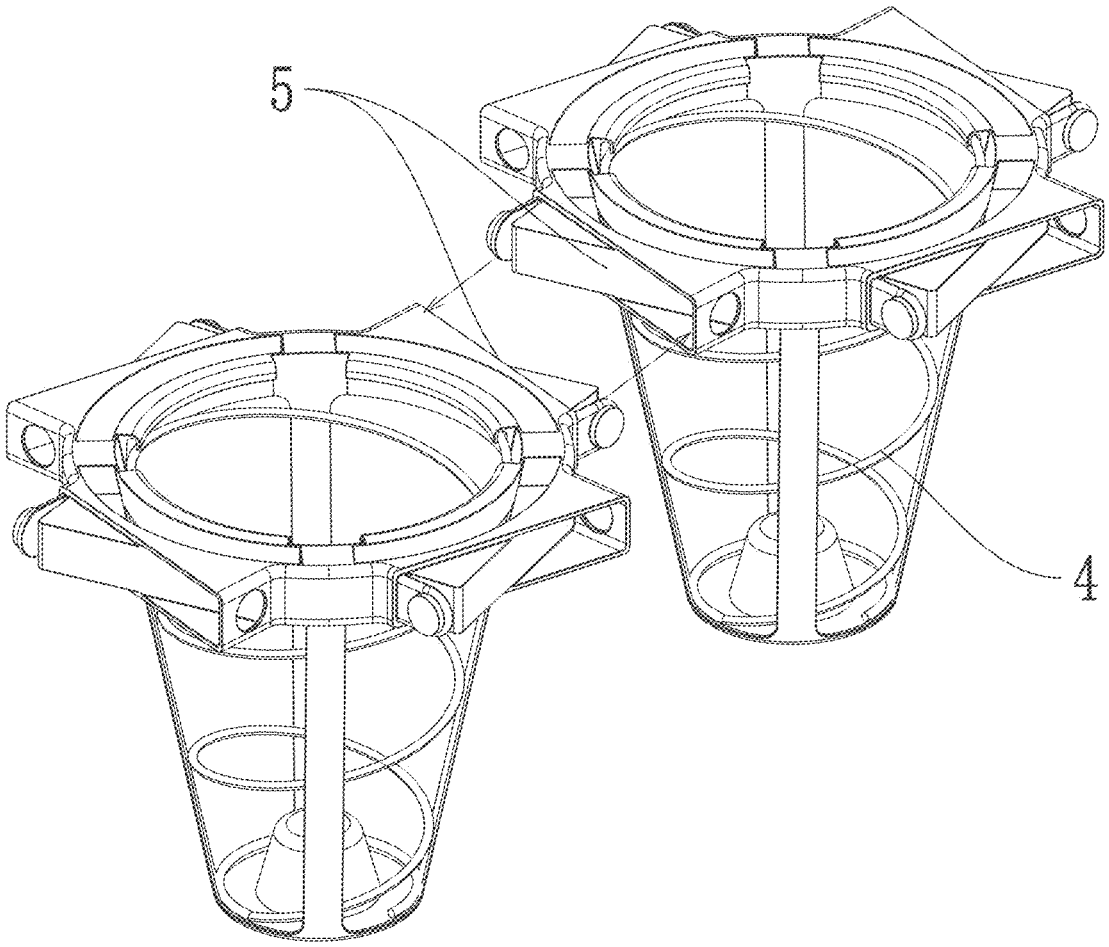
FIG. 13 is a view of a splicing cooperation of two pre-compressed springs (inverted tapered springs) in Embodiment 3 in the present disclosure.
Figure 14:
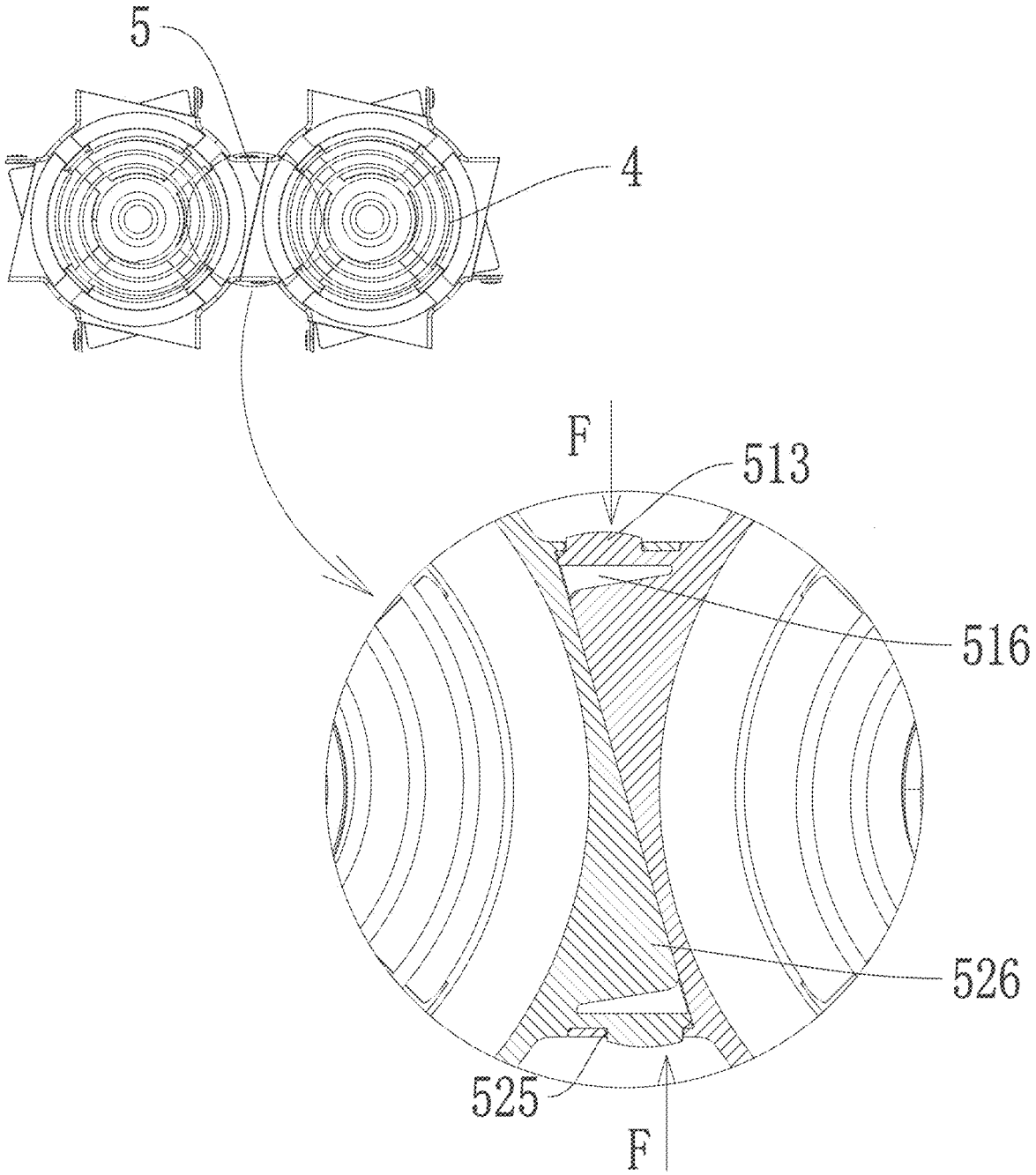
FIG. 14 is a sectional view of a spliced structure of the two pre-compressed springs (the inverted tapered springs) in Embodiment 3 in the present disclosure.
Figure 15:
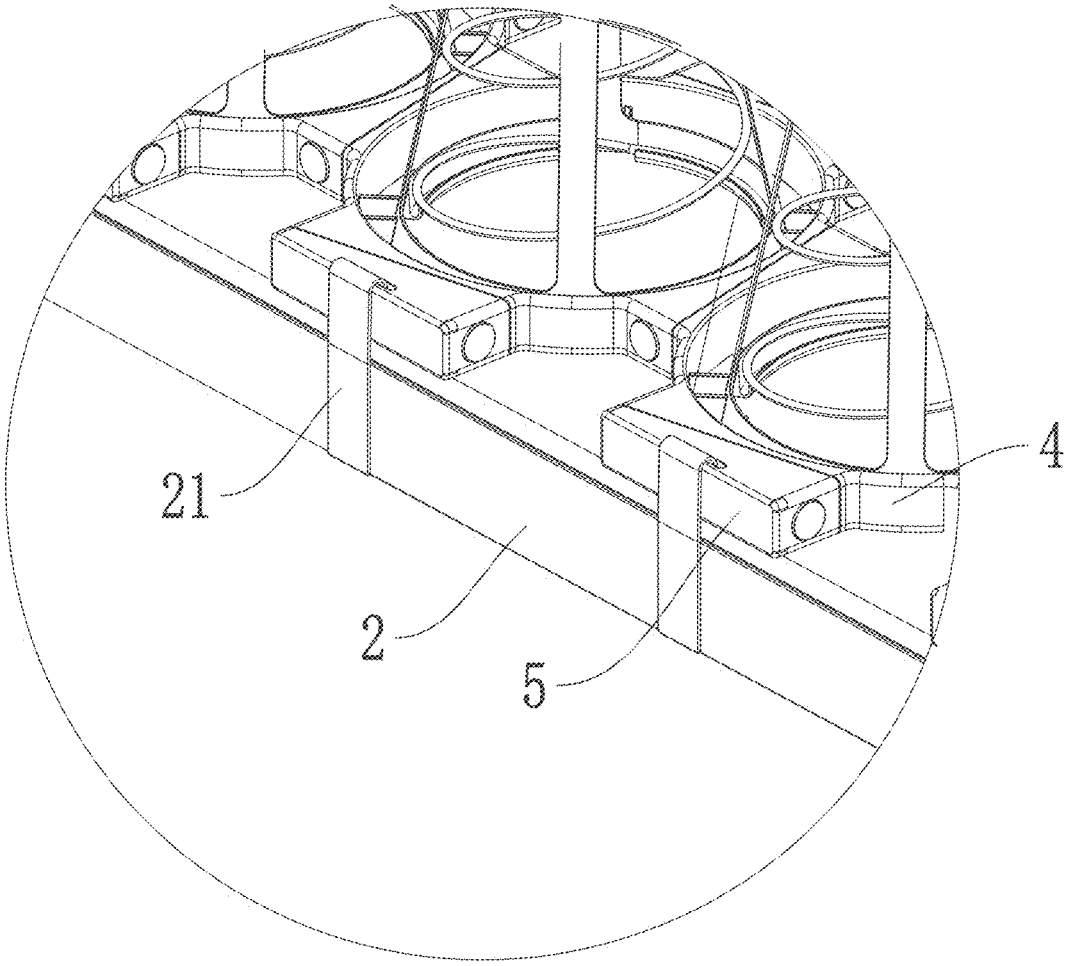
FIG. 15 is an enlarged view of a part of a buckled connection of a spring module and a soft cushion layer in Embodiment 3 in the present disclosure.

Referring to FIGS. 9-11, based on Embodiment 1, position arrangements of the plurality of connection structures 5 on the plurality of pre-compressed springs 4 are provided, and at the same time, position arrangements of the connecting seats 44 extending from the tapered end surfaces of the tapered spring sleeves 46 are provided. The plurality of connection structures 5 can be disposed on the connecting seats 44 or the tapered spring sleeves 46. The plurality of connection structures 5 comprise the snapping positions 51 and the buckling positions 52, and the snapping positions 51 are configured to squeeze the snapping positions 51 to contract inward to release the buckled connection when being buckled in the buckling positions 52.

Specifically, the snapping positions 51 comprise the elastic members 511 and the snapping points 512 disposed on the single sides of the elastic members 511, and the buckling positions 52 comprise the U-shaped buckling grooves 521 and the steps 522 disposed within the U-shaped buckling grooves 521. The end surfaces of the steps 522 are configured to be buckled to the snapping points 512. The guiding surfaces 523 obliquely extend from the insertion openings of the U-shaped buckling grooves 521 to the steps 522 along the inserting direction of the snapping points 512, and the guiding surfaces 523 enable the snapping points 512 to contract inward to provide avoidance for the insertion of the snapping positions 51. The elastic members 511 have the deformation amounts for the snapping points 512 contracting inward to cooperate with the guiding surfaces 523 to form the avoidance structures, or for the snapping points 512 being released from the steps 522.

In this embodiment, the plurality of connection structures 5 comprise the single protruding parts 513 and the single concave parts 524 between the snapping positions 51 and the buckling positions 52 (e.g., each of the plurality of connection structures 5 comprises the protruding part 513 and the concave part 524 between the snapping position 51 and the buckling position 52). When the buckled connection is formed, the one of the protruding parts 513 of the plurality of connection structures 5 on the one of the plurality of pre-compressed springs 4 is inserted into the one of the concave parts 524 on another of the plurality of pre-compressed springs 4 to form a plug-in connection, and the stability of the buckled connection between the two of the plurality of connection structures 5 can be increased. This embodiment differs from Embodiment 1 in that plug-in positioning members cooperate with the protruding parts 513 and the concave parts 524 are provided. The plug-in positioning members comprise positioning slots disposed on the protruding parts 513 and positioning posts disposed on the concave parts 524. There is a certain friction force between the positioning posts and the positioning slots, which provides a certain buckling force between the protruding parts 513 and the concave parts 524 during a plug-in connection, thereby buckling the protruding parts 513 and the concave parts 524 together. The buckling force can be automatically released from being buckled together by a slight external force.

In this embodiment, a structural design is provided in which the plurality of connection structures 5 are not disposed along edges of large end surfaces 41 of the plurality of pre-compressed springs 4. The plurality of connection structures 5 are not disposed on peripheries of the large end surfaces 41, but are disposed at positions below the large end surfaces 41 by at a certain distance.

The positions are not limited to the positions of the plurality of connection structures 5 shown in FIG. 9. In this embodiment, the plurality of connection structures 5 can be disposed at any position within sections of ½ or ⅓ of heights of the plurality of pre-compressed springs 4 and adjacent to the large end surfaces 41. It should be noted that, in addition to the plurality of connection structures 5, one or more positions of the one or more third connecting members 6, in which the one or more third connecting members 6 are connected to the plurality of connection structures 5, can also be disposed at any position within the sections of ½ or ⅓ of the heights of the plurality of pre-compressed springs 4 and adjacent to the large end surfaces 41.

In order to ensure that a non-rigid connection is formed between adjacent pre-compressed springs 4 of the plurality of pre-compressed springs 4, the plurality of connection structures 5 or the one or more third connecting members 6 can be made of elastic materials or flexible materials. The plurality of connection structures 5 are disposed at positions below the large end surfaces 41 to form a connection, enabling the large end surfaces 41 to form a free downward compressed deformation when the large end surfaces 41 are used as the lying supporting surface. The plurality of connection structures 5 are connected together to form a flexible connection. Even if the plurality of connection structures 5 have a downward compressed displacement when being pressed, the flexible connection can reduce a pulling interference force applied on the adjacent pre-compressed springs 4 of the plurality of pre-compressed springs 4 that are connected, thus ensuring elasticity independence of the plurality of pre-compressed springs 4 from each other.

Considering that the plurality of connection structures 5 are mainly to stabilize support of the large end surfaces 41 of the plurality of pre-compressed springs 4 to be more stable when the plurality of pre-compressed springs 4 are spliced to form the spring module 1 for use, and the plurality of pre-compressed springs 4 will not sway left and right relative to each other, resulting in a phenomenon of localized collapse. Therefore, when the positions of the plurality of connection structures 5 are arranged, it is optimal to arrange the plurality of connection structures 5 within upper position sections as no less than ⅓ of the plurality of pre-compressed springs 4 and adjacent to the large end surfaces 41. In doing so, interference between the plurality of pre-compression springs 4 caused by the plurality of connection structures 5 is reduced while ensuring stability of the connection.

It should be noted that, the positional arrangements of the plurality of connection structures 5 or the one or more third connecting members 6 in all embodiments are not limited to be disposed along the edges of the large end surfaces 41 and as described in Embodiment 2, but can be disposed within the upper position sections as no less than ⅓ of the plurality of pre-compressed springs 4 and adjacent to the large end surfaces 41.

Embodiment 3

Referring to FIGS. 12-15, based on Embodiment 1, a main focus of this embodiment is on the plurality of connection structures 5 and the plurality of connection structures 5 differing from the structure of Embodiment 1.

In this embodiment, the plurality of connection structures 5 are designed such that each of the snapping positions 51 comprises an elastic sheet 514 and a buckling block 515 disposed on a side of the elastic sheet 514, and each of the buckling positions 52 comprises a buckling hole 525. The buckling block 515 on one of the plurality of pre-compressed springs 4 forms a bucking connection with the buckling hole 525 on another of the plurality of pre-compressed springs 4. The elastic sheet 514 has a deformation amount for the buckling block 515 contracting inward to be buckled to the buckling hole 525 or to be released from the buckling hole 525.

At the same time, in order to increase a stability of the large end surfaces 41 used as the lying supporting surface and to ensure a stability of a connection of the plurality of connection structures 5 at the same time, each of the plurality of connection structures 5 comprises two protruding parts 526 located between a corresponding one of the snapping positions 51 and a corresponding one of the buckling positions 52. One of two protruding parts 526 comprises a concave cavity 516, and the concave cavity 516 is configured to receive another of the two protruding parts 526. Another of the two protruding parts 526 on one of the connecting seats 44 is plugged into the concave cavity 516 on another of the connecting seats 44, increasing a stability of the buckled connection between two of the plurality of connection structures 5.

In this embodiment, structures of the plurality of straps 21 with pull buckles of the soft cushion layer 2 configured to form detachable connection with the plurality of connection structures 5 are the same as the plurality of connection structures 5 on the plurality of pre-compressed springs 4 to form an auxiliary buckled structure.

Embodiment 4

Figure 16:
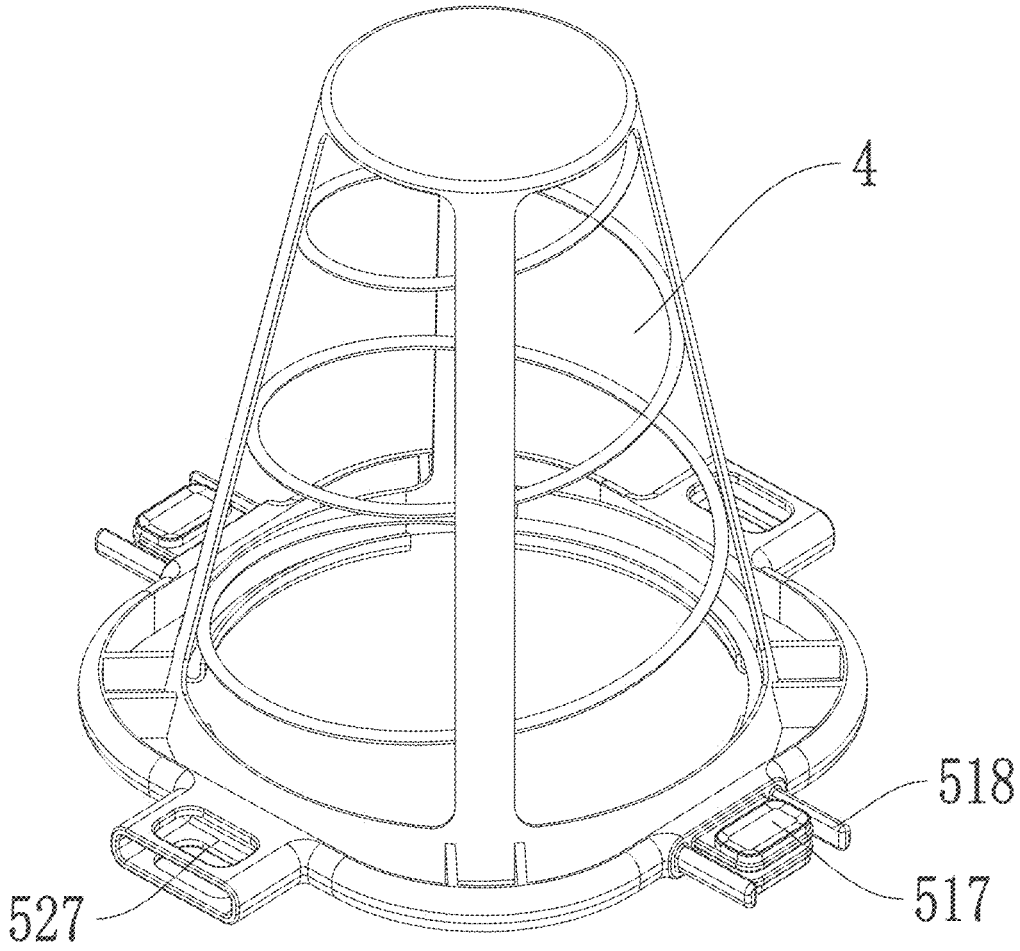
FIG. 16 is a diagrammatic view of a structure of a pre-compressed spring housing an inverted tapered spring in Embodiment 4 in the present disclosure.
Figure 17:
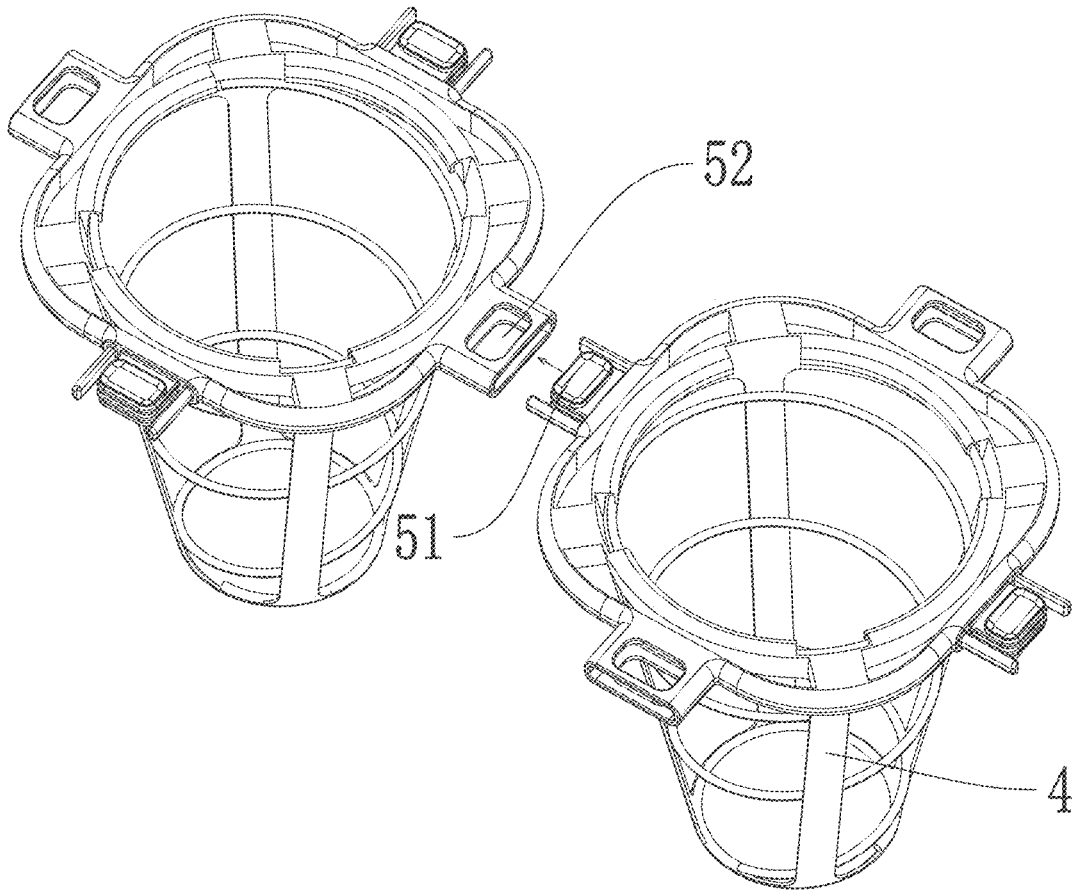
FIG. 17 is a view of a splicing cooperation of two pre-compressed springs (inverted tapered springs) in Embodiment 4 in the present disclosure.
Figure 18:
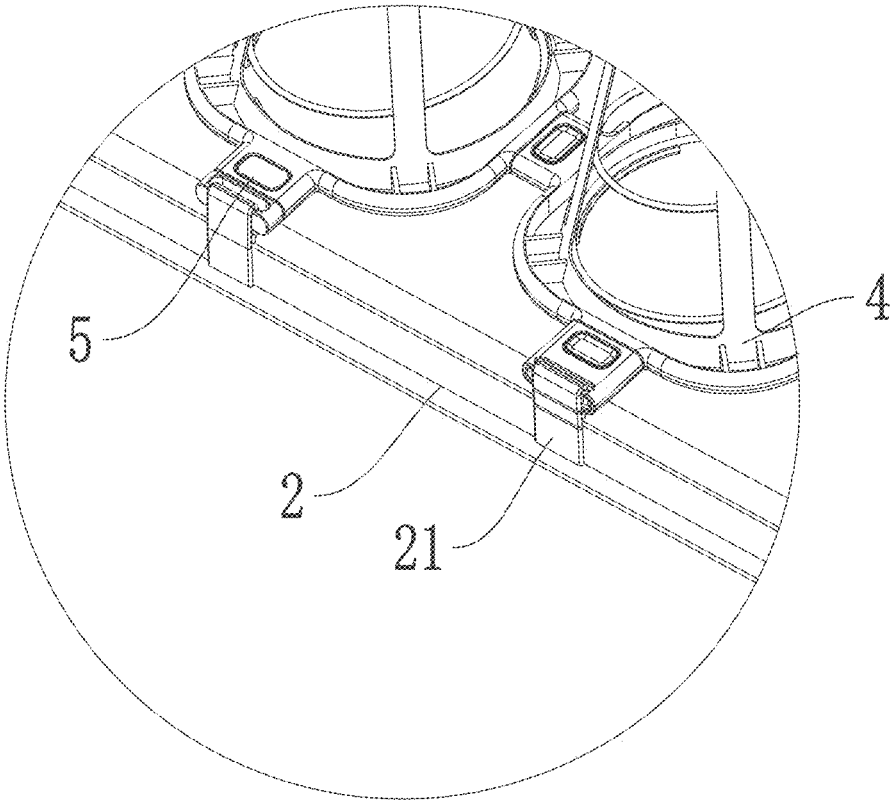
FIG. 18 is an enlarged view of a part of a buckled connection of a spring module and a soft cushion layer in Embodiment 4 in the present disclosure.
Figure 19:
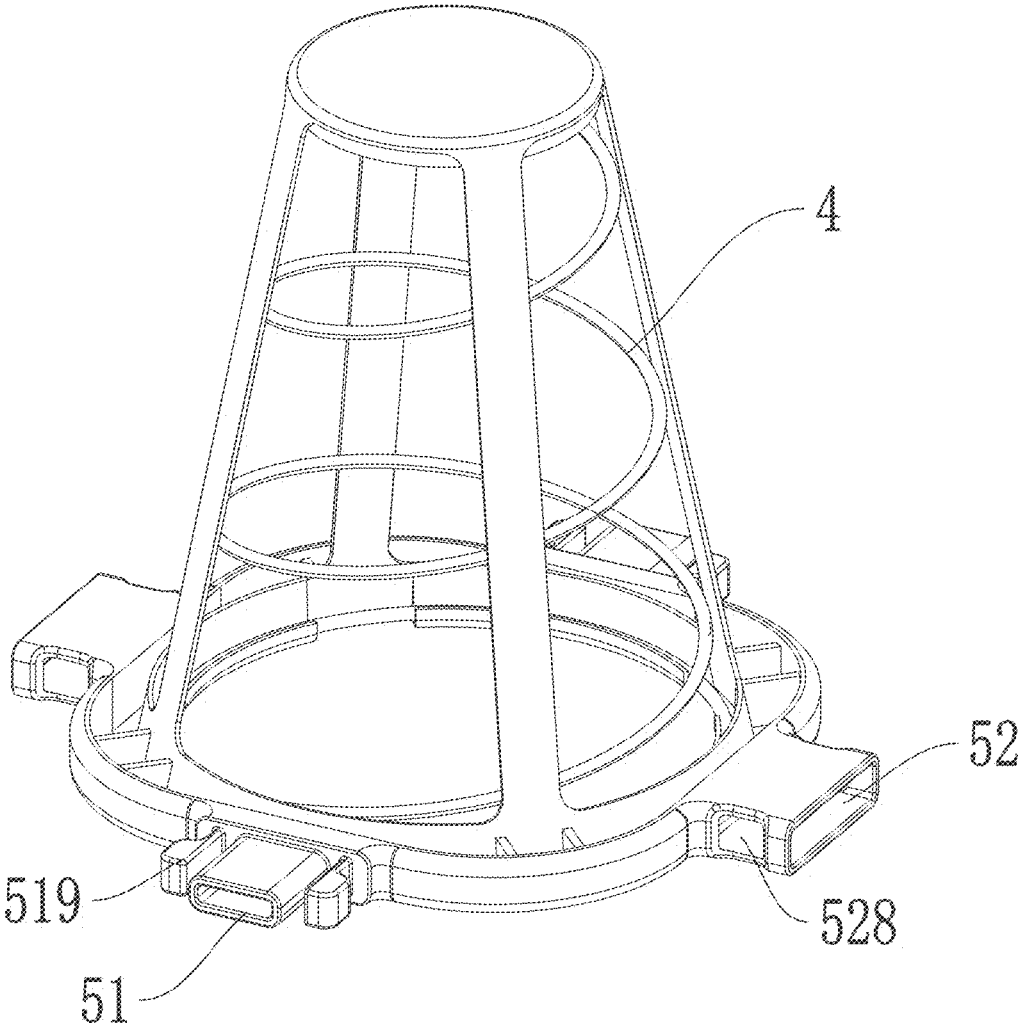
FIG. 19 is a diagrammatic view of a structure of a pre-compressed spring housing an inverted tapered spring in Embodiment 5 in the present disclosure.
Figure 20:
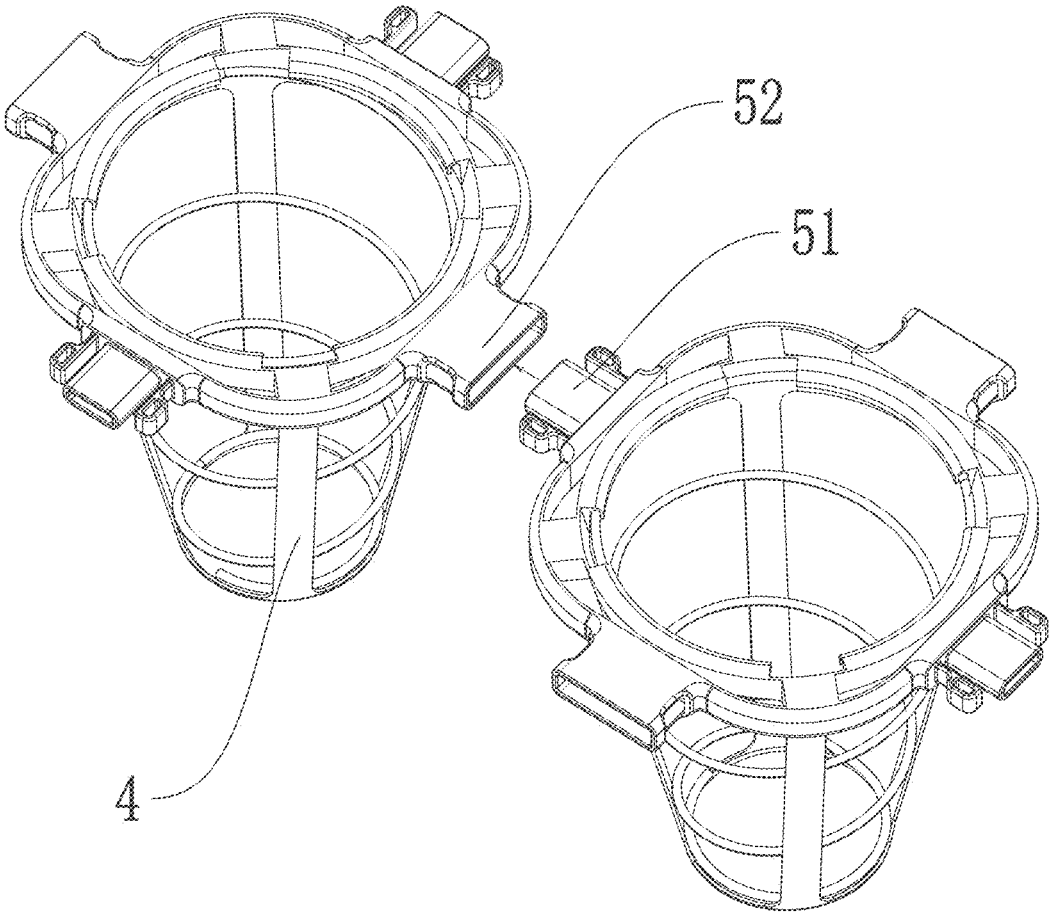
FIG. 20 is a view of a splicing cooperation of two pre-compressed springs (inverted tapered springs) in Embodiment 5 in the present disclosure.
Figure 21:
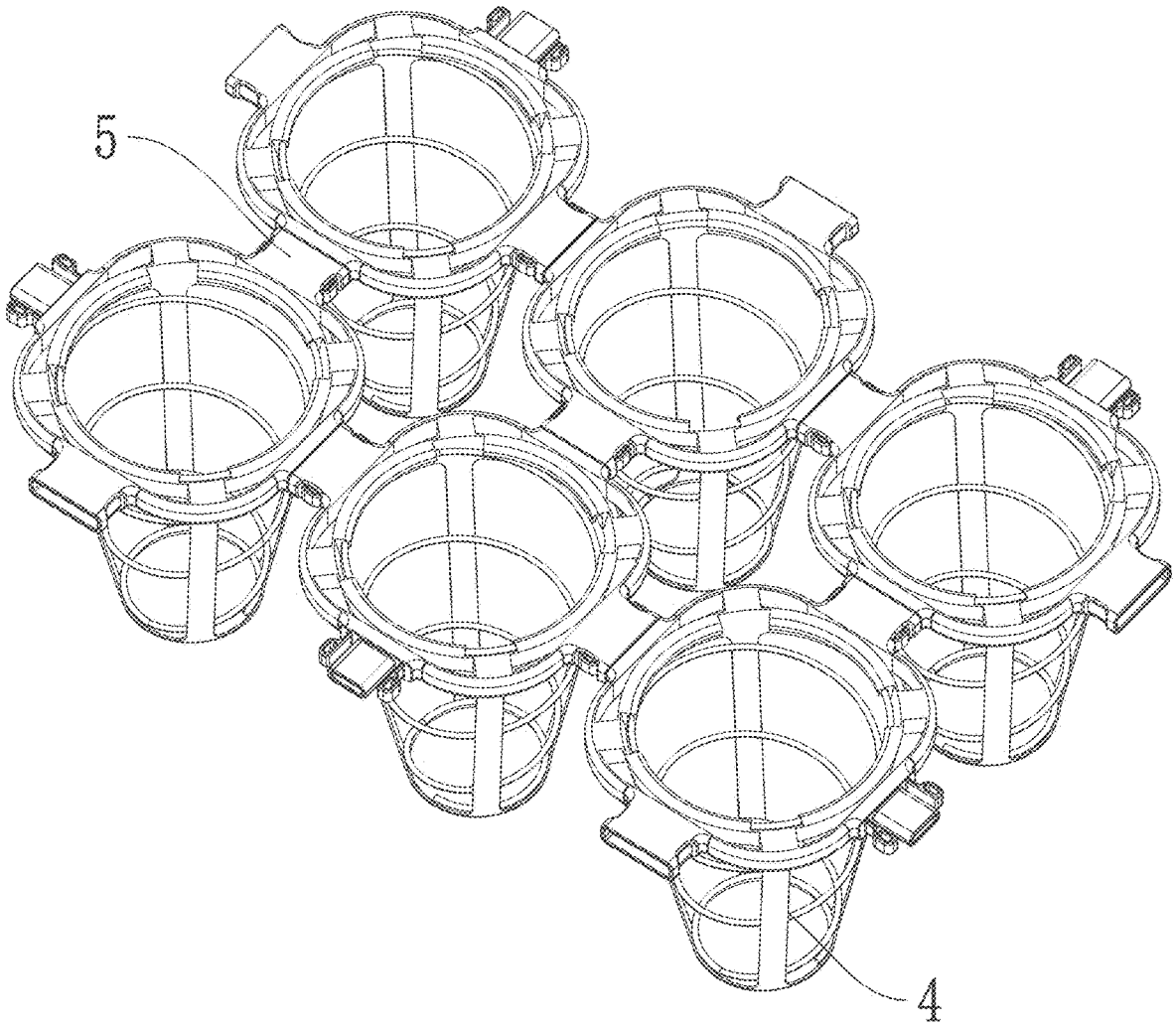
FIG. 21 is a view of a spliced connection of a plurality of pre-compressed springs (the inverted tapered springs) in Embodiment 5 in the present disclosure.
Figure 22:
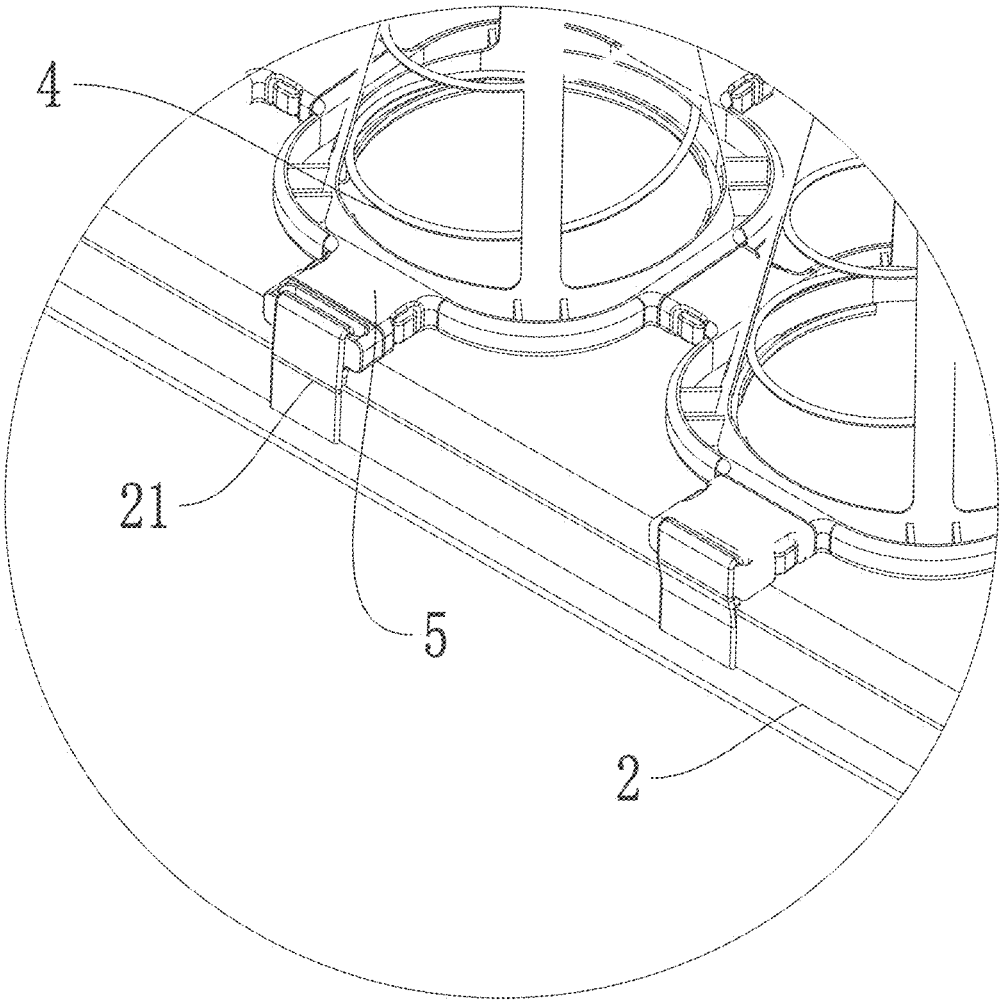
FIG. 22 is an enlarged view of a part of a buckled connection of a spring module and a soft cushion layer in Embodiment 5 in the present disclosure.
Figure 23:
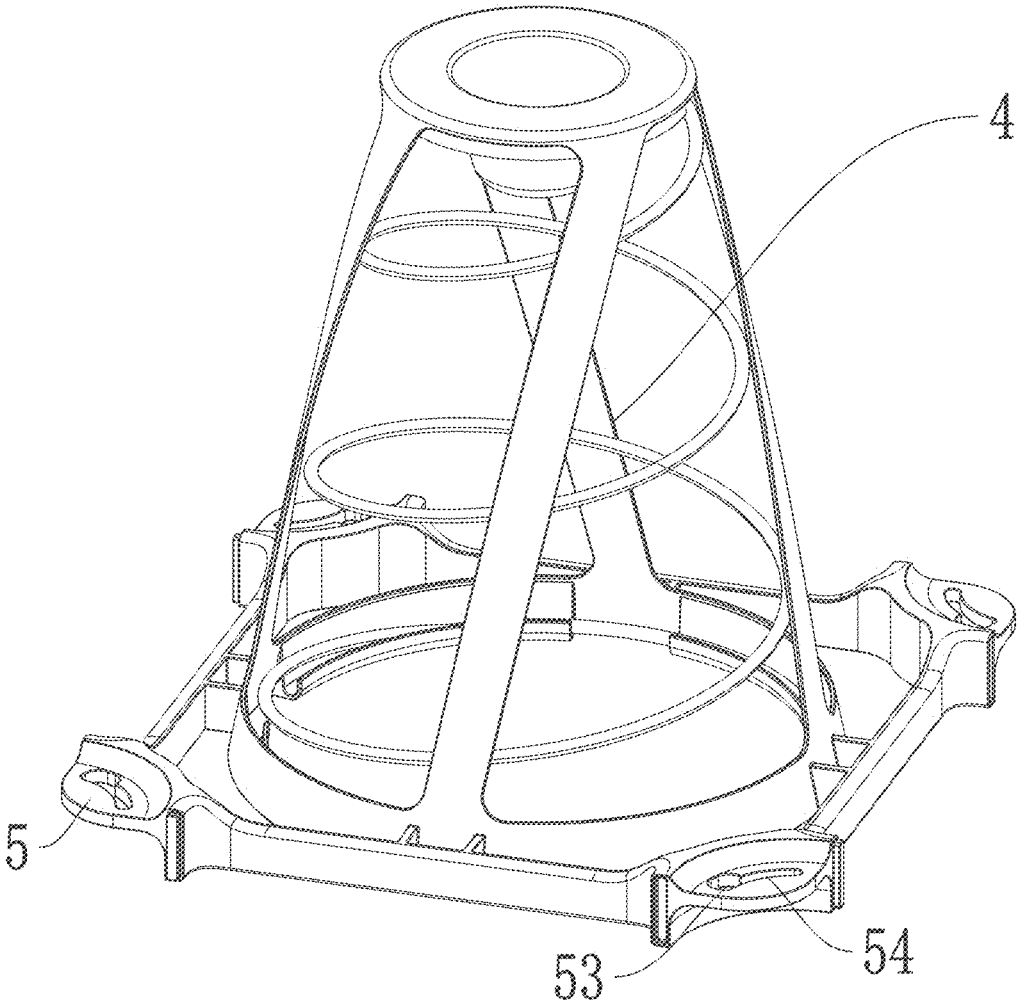
FIG. 23 is a diagrammatic view of a structure of a pre-compressed spring housing an inverted tapered spring in Embodiment 6 in the present disclosure.
Figure 24:
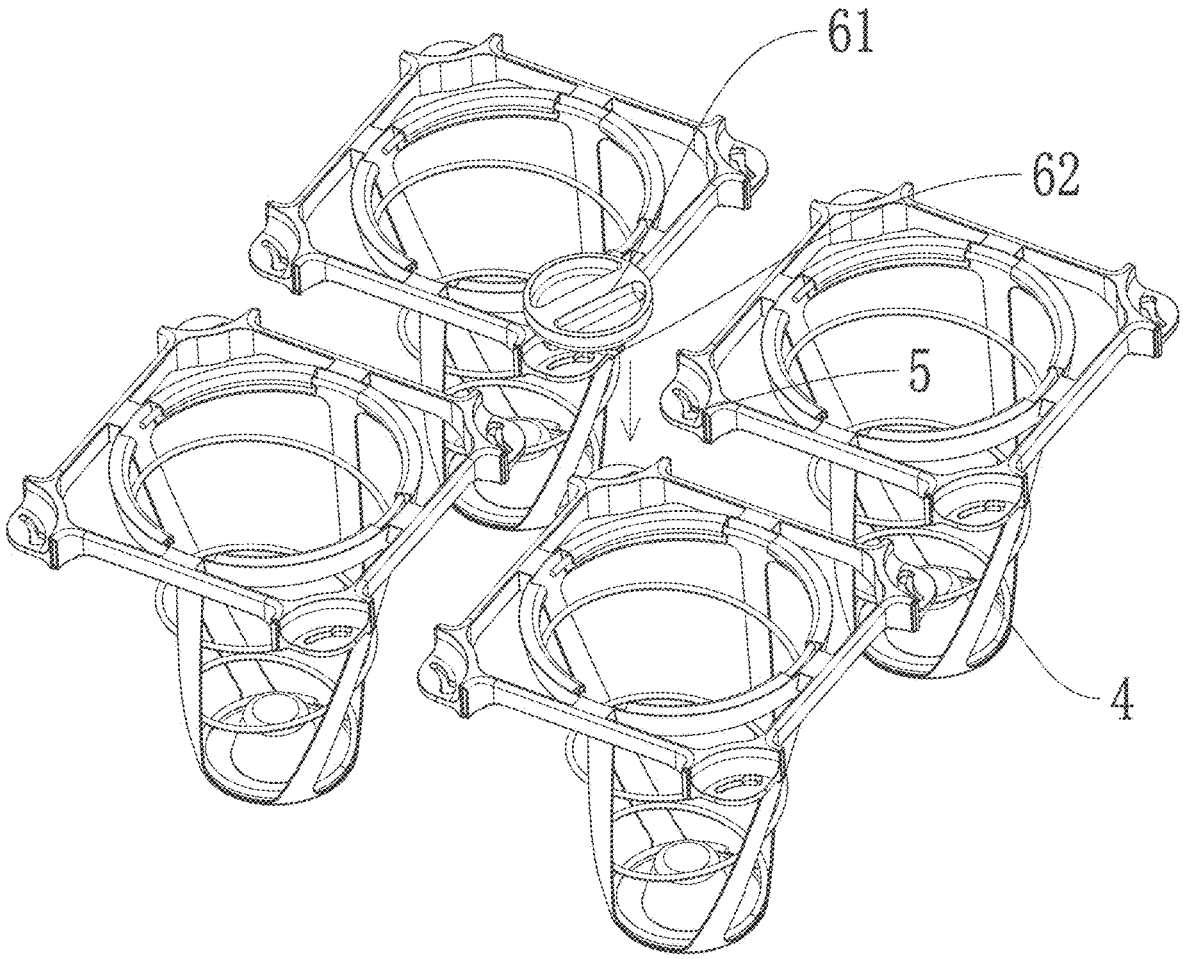
FIG. 24 is a view of a splicing cooperation of four pre-compressed springs (inverted tapered springs) in Embodiment 6 in the present disclosure.
Figure 25:
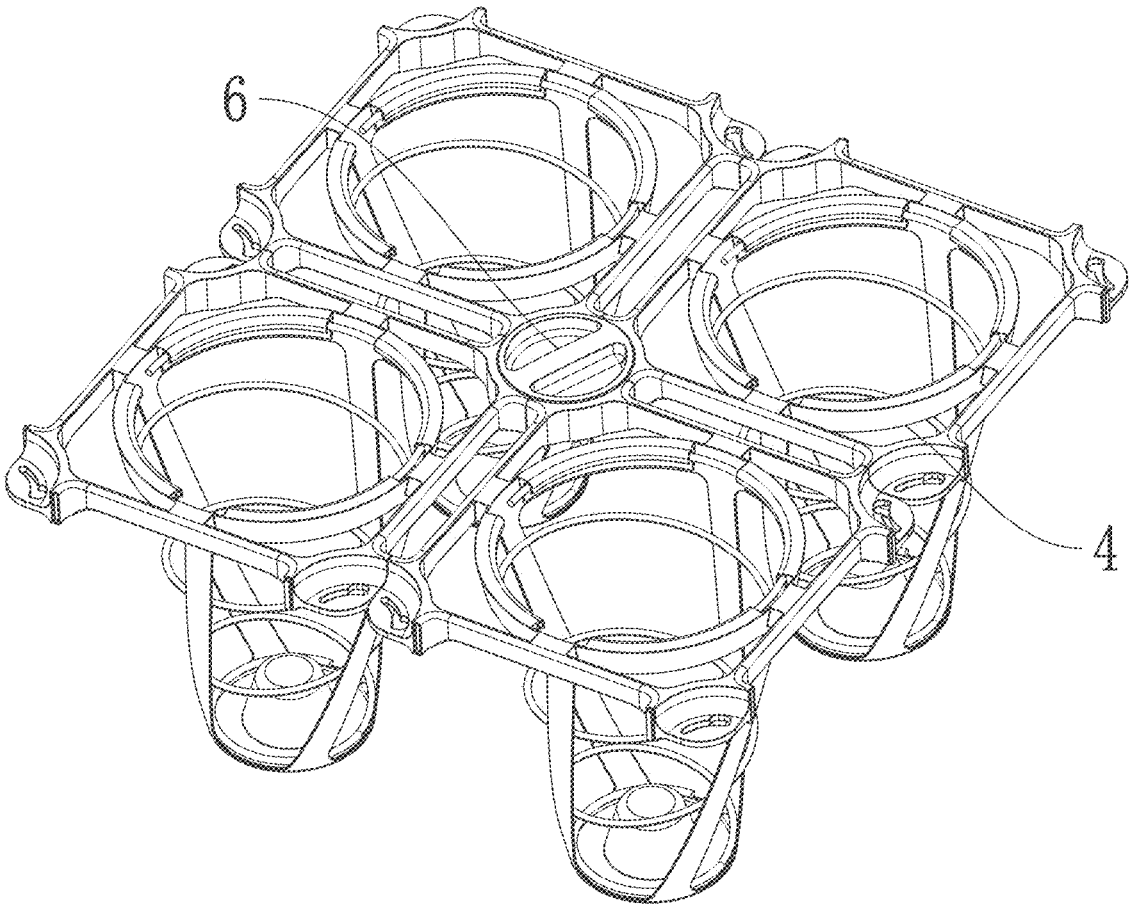
FIG. 25 is a view of the four pre-compressed springs (the inverted tapered springs) after being spliced in Embodiment 6 in the present disclosure.
Figure 26:
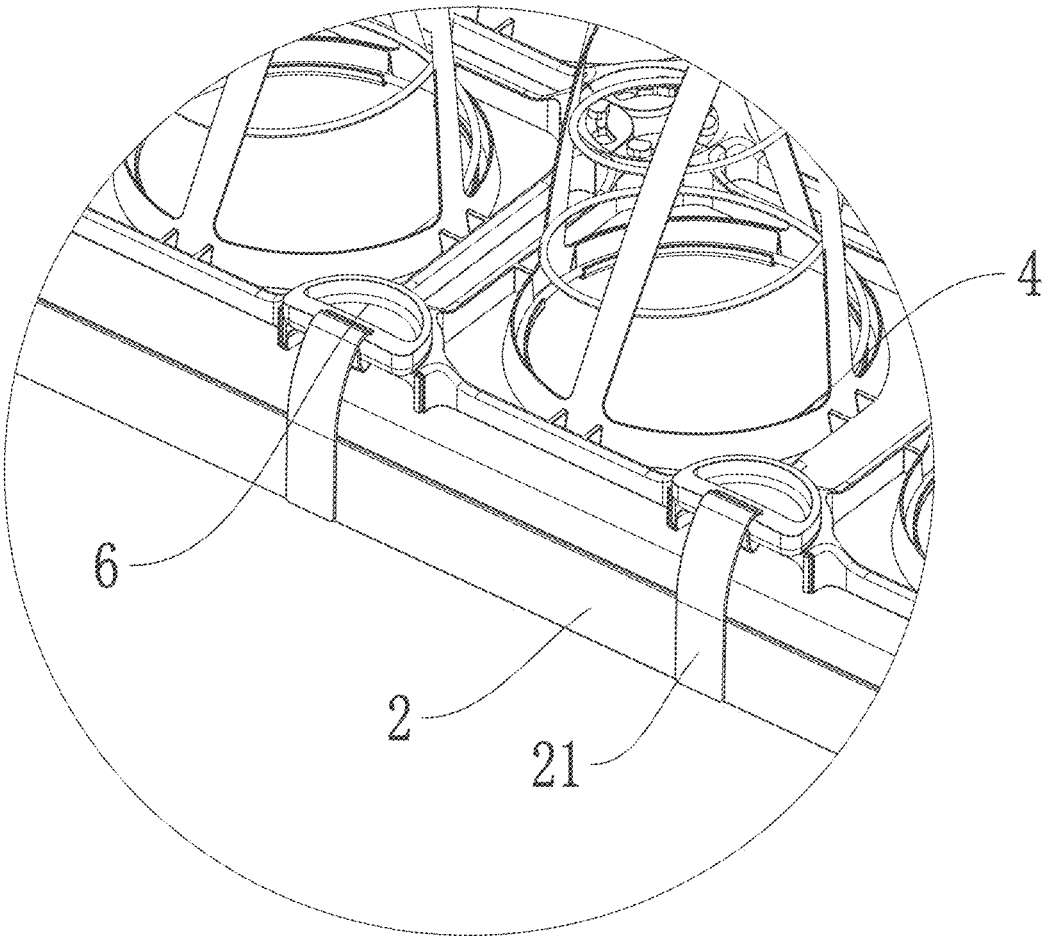
FIG. 26 is an enlarged view of a part of a buckled connection of a spring module and a soft cushion layer in Embodiment 6 in the present disclosure.
Figure 27:
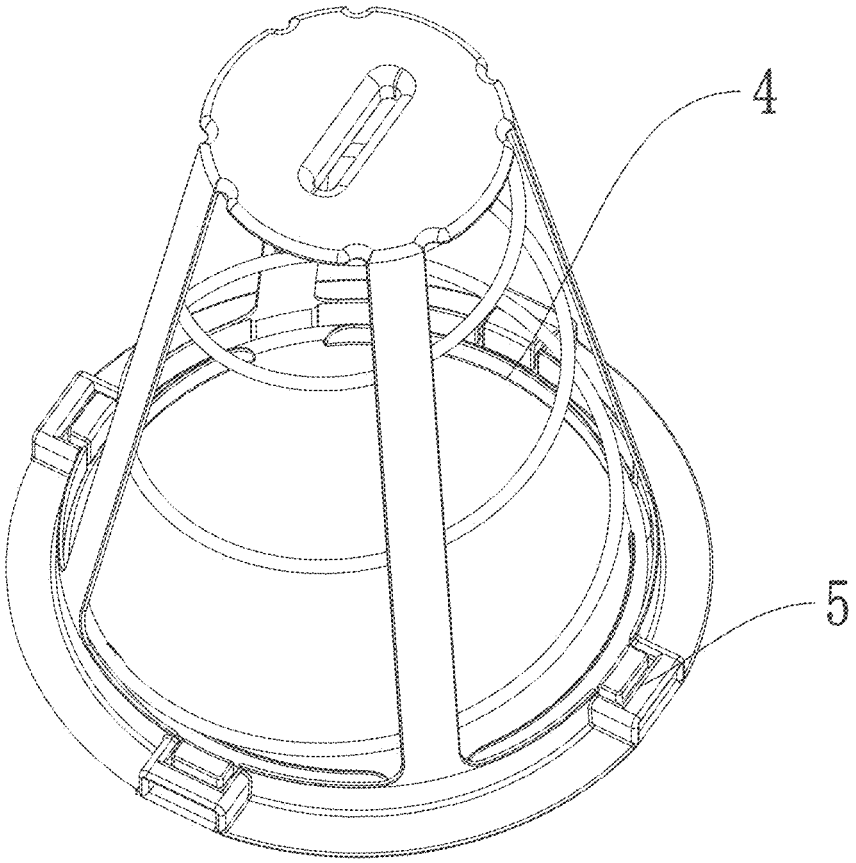
FIG. 27 is a diagrammatic view of a structure of a pre-compressed spring housing an inverted tapered spring in Embodiment 7 in the present disclosure.
Figure 28:
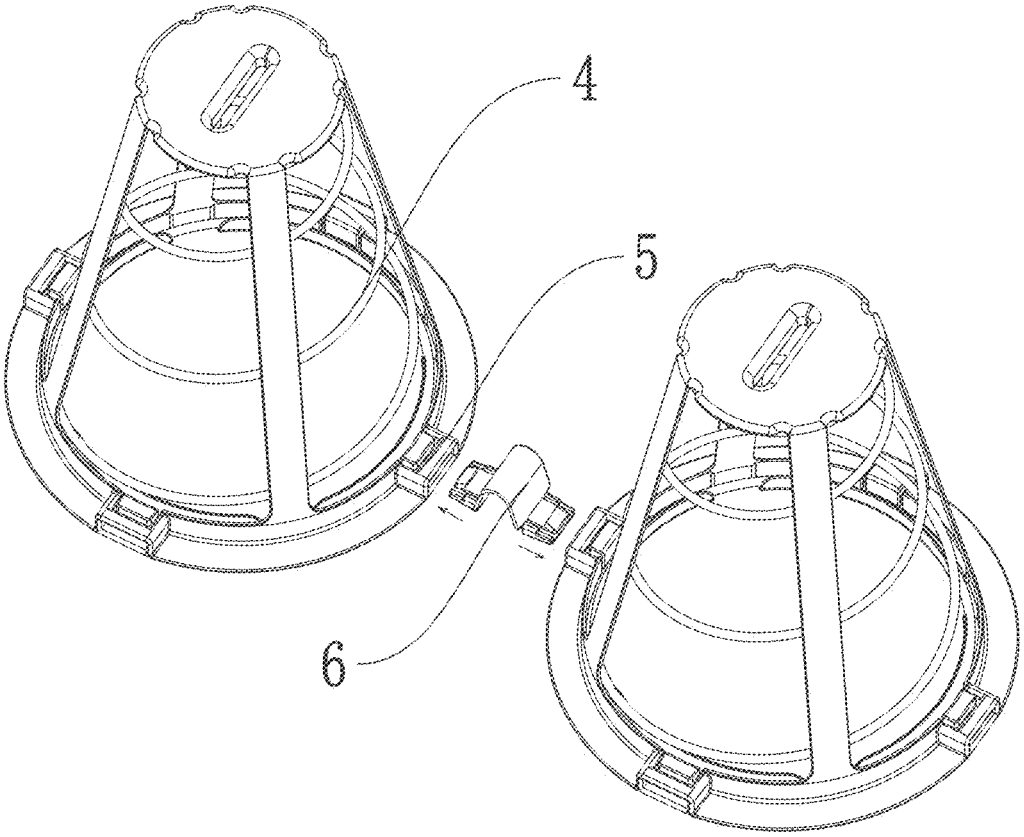
FIG. 28 is a view of a tapered splicing cooperation of two pre-compressed springs (inverted tapered springs) in Embodiment 7 in the present disclosure.
Figure 29:
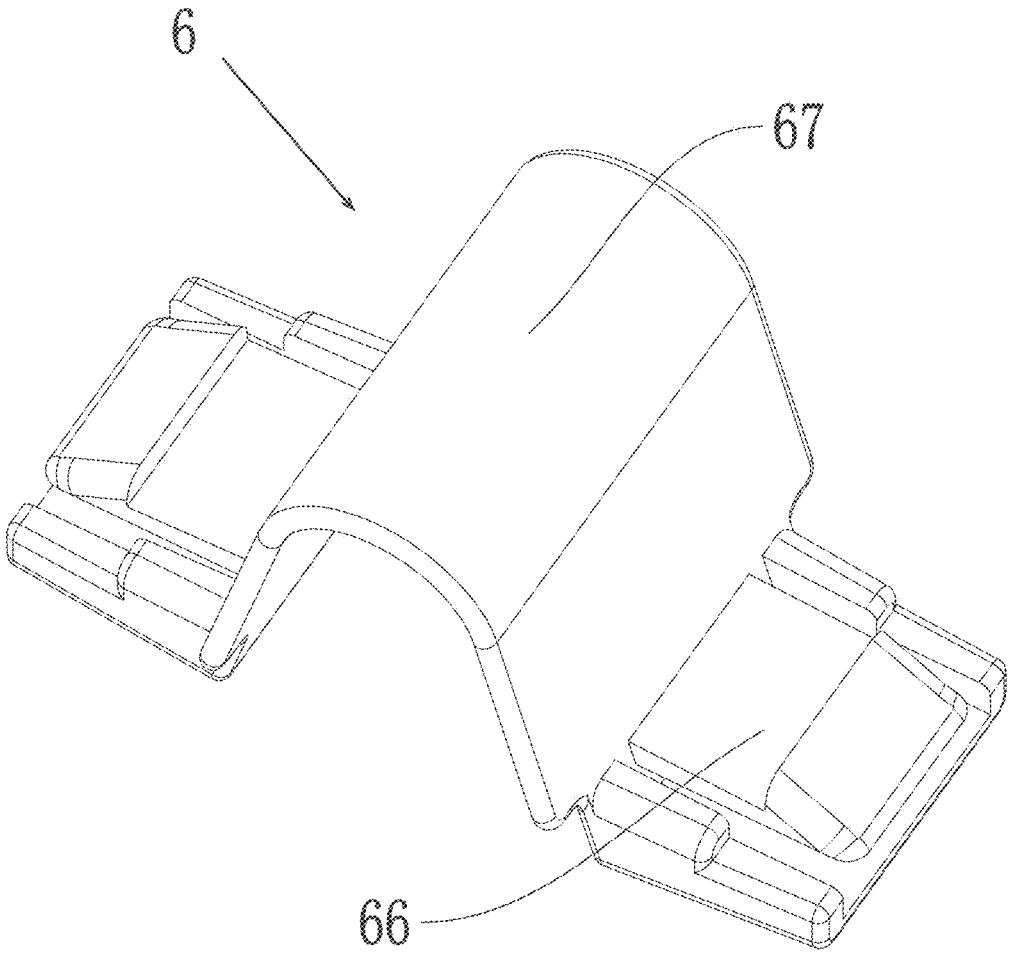
FIG. 29 is a diagrammatic view of a structure of a third connecting member in Embodiment 7 in the present disclosure.
Figure 30:
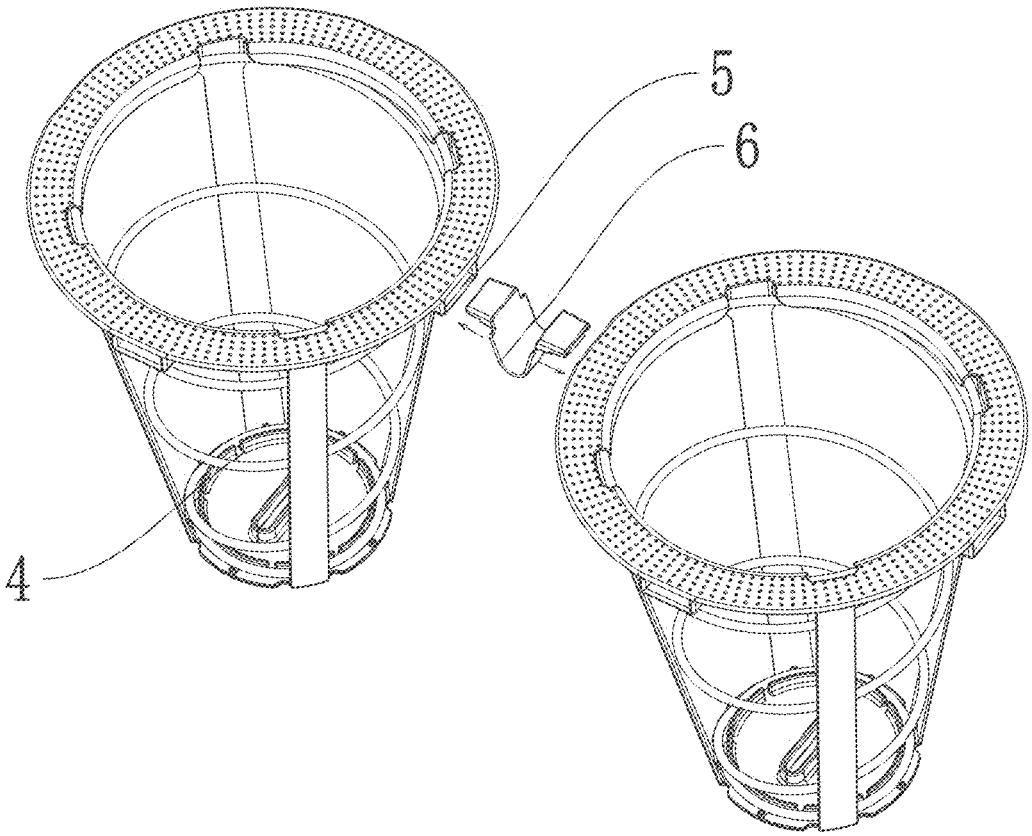
FIG. 30 is a view of an inverted tapered splicing cooperation of the two pre-compressed springs (inverted tapered springs) in Embodiment 7 in the present disclosure.
Figure 31:
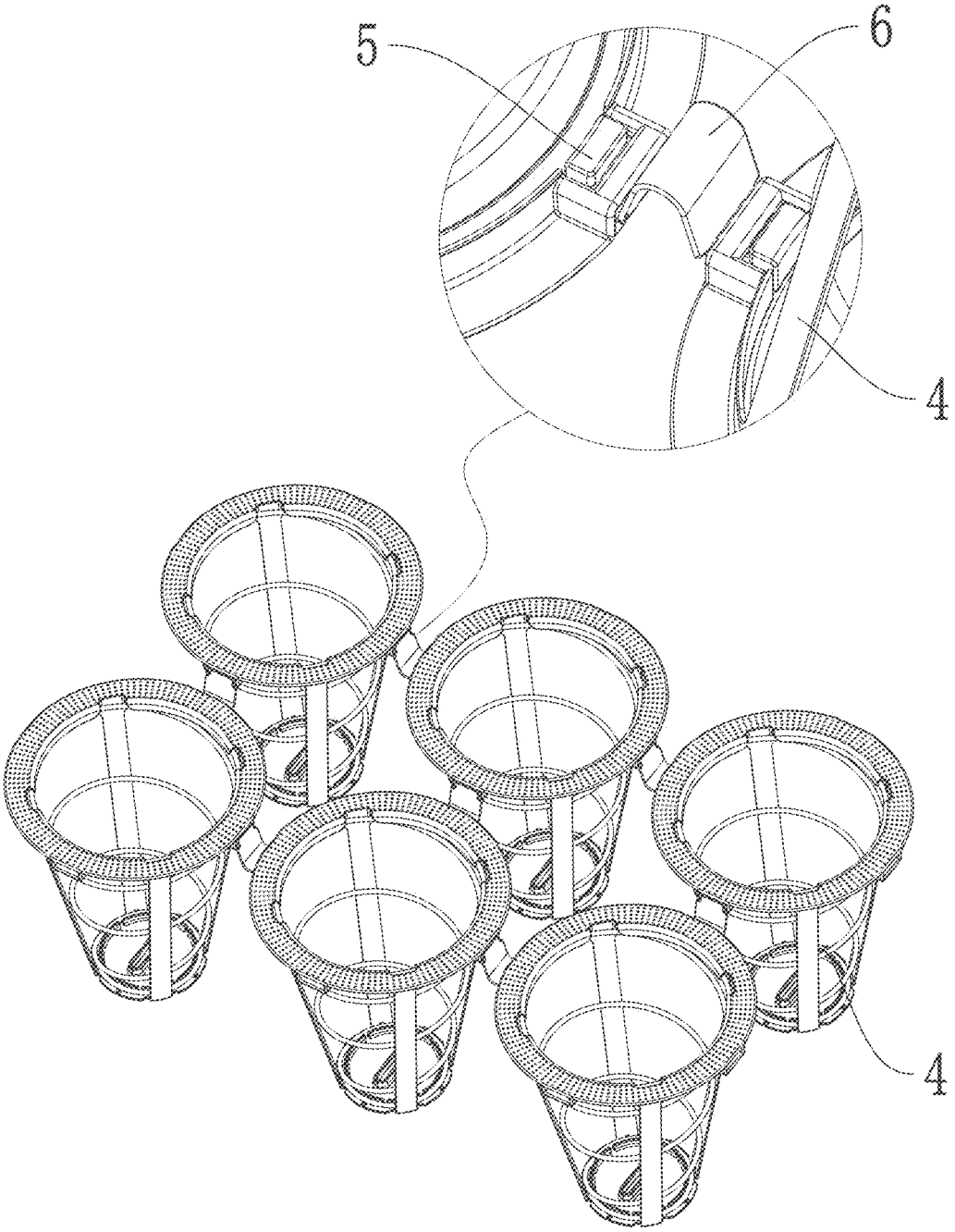
FIG. 31 is a view of a plurality of pre-compressed springs (inverted tapered springs) after being spliced in an inverted tapered shape in Embodiment 7 in the present disclosure.
Figure 32:
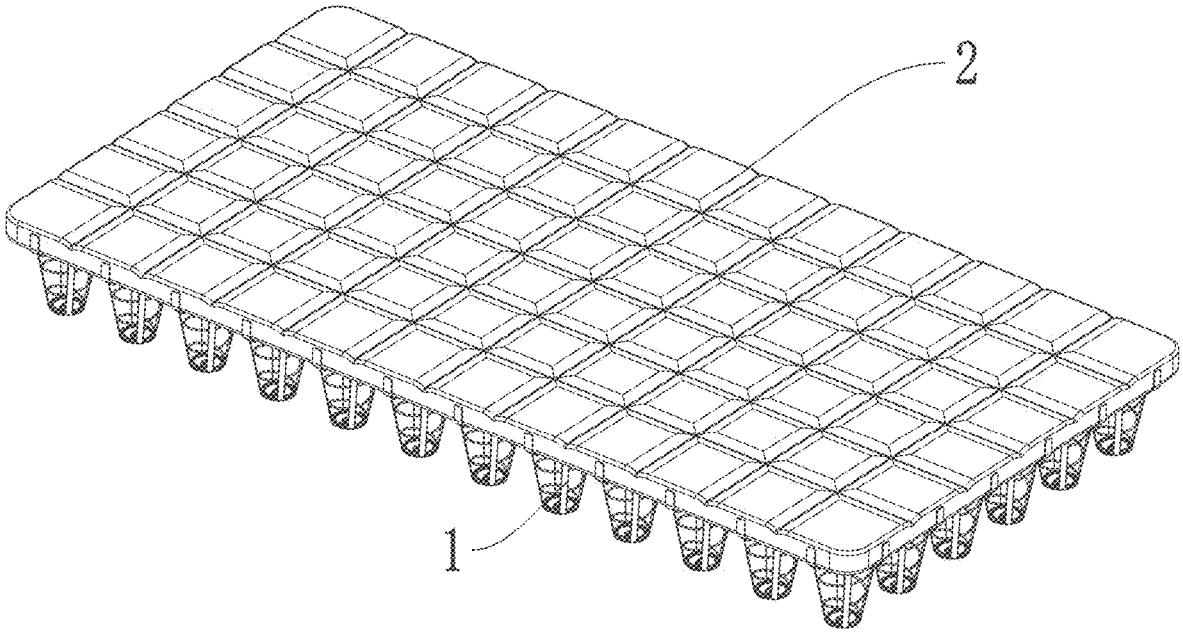
FIG. 32 is a diagrammatic view of a buckled connection of a spring module and a soft cushion layer in Embodiment 1 in the present disclosure.
Figure 33:
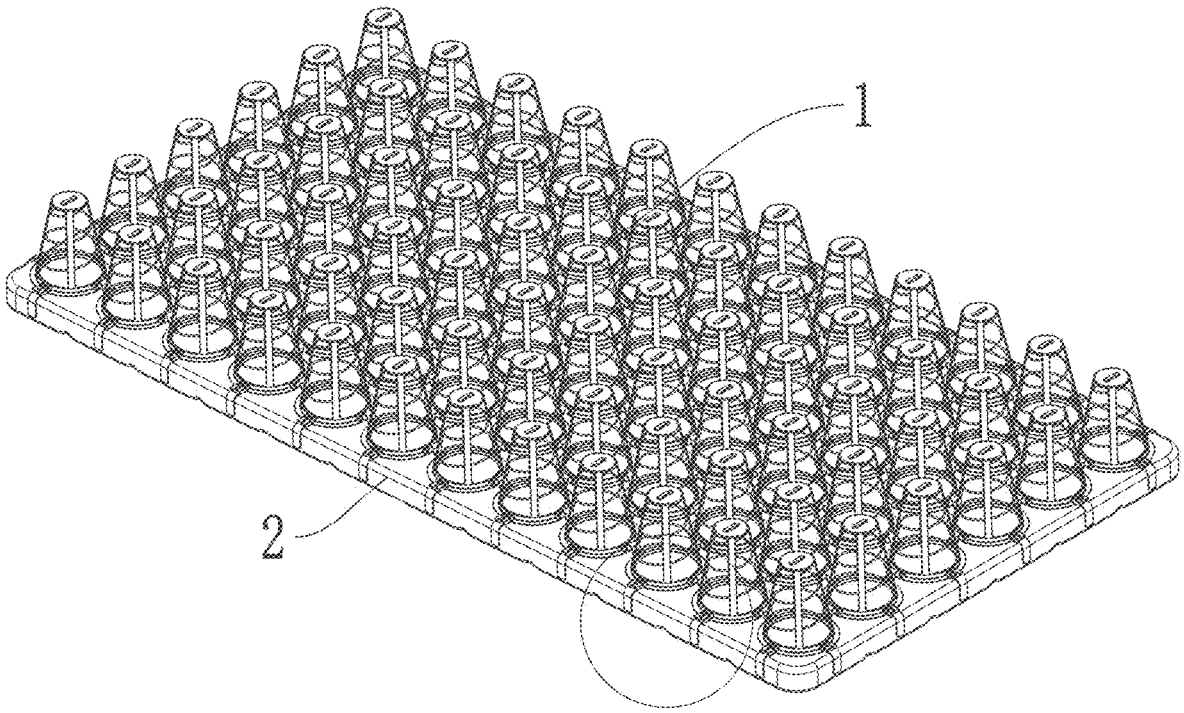
FIG. 33 is a diagrammatic view of a whole structure of the spring module in Embodiment 7 in the present disclosure.
Figure 34:
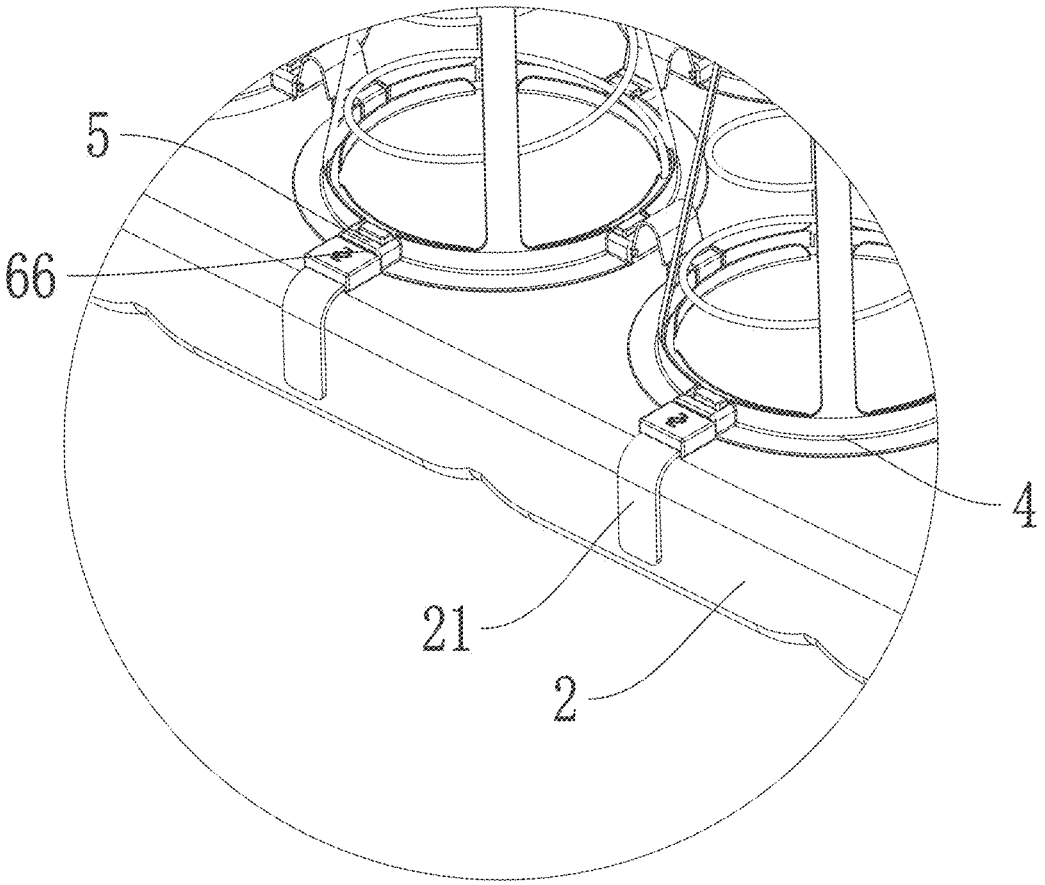
FIG. 34 is an enlarged view of a part of the buckled connection of the spring module and the soft cushion layer in Embodiment 7 in the present disclosure.
Figure 35:
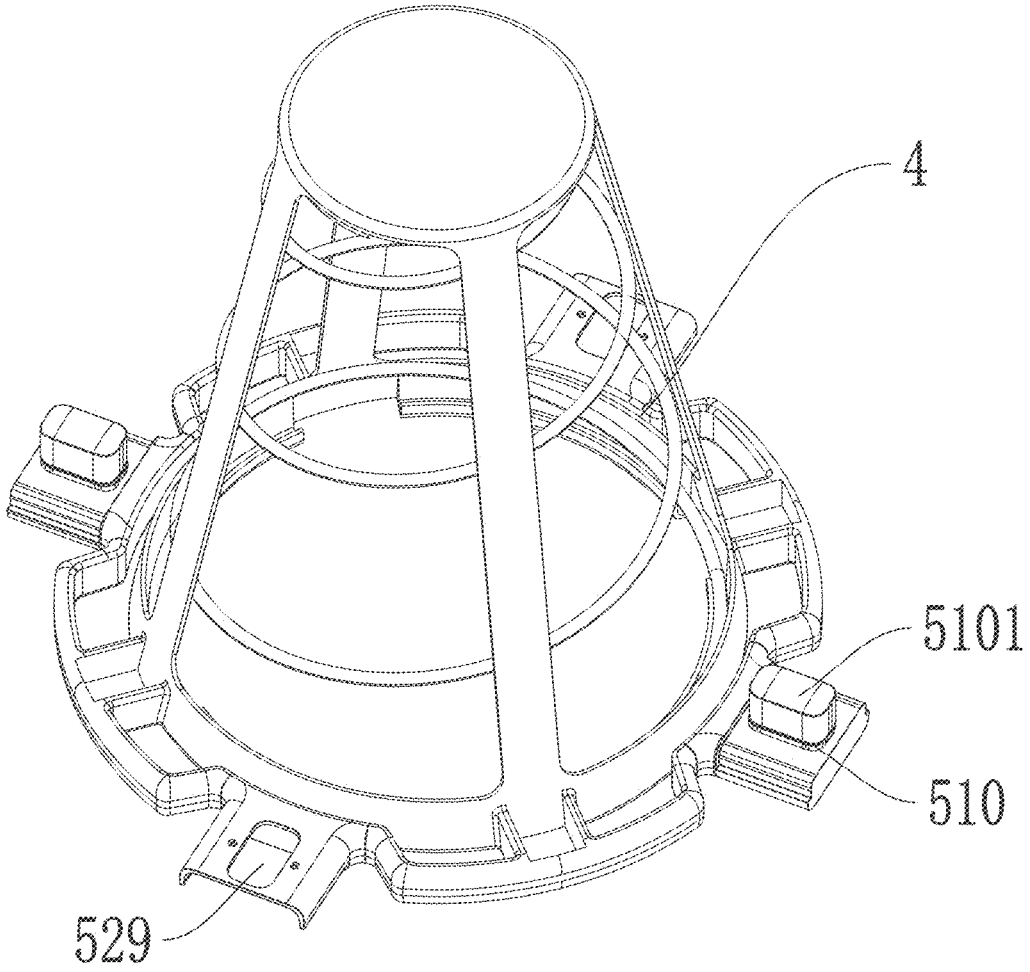
FIG. 35 is a diagrammatic view of a structure of a pre-compressed spring housing an inverted tapered spring in Embodiment 8 in the present disclosure.
Figure 36:
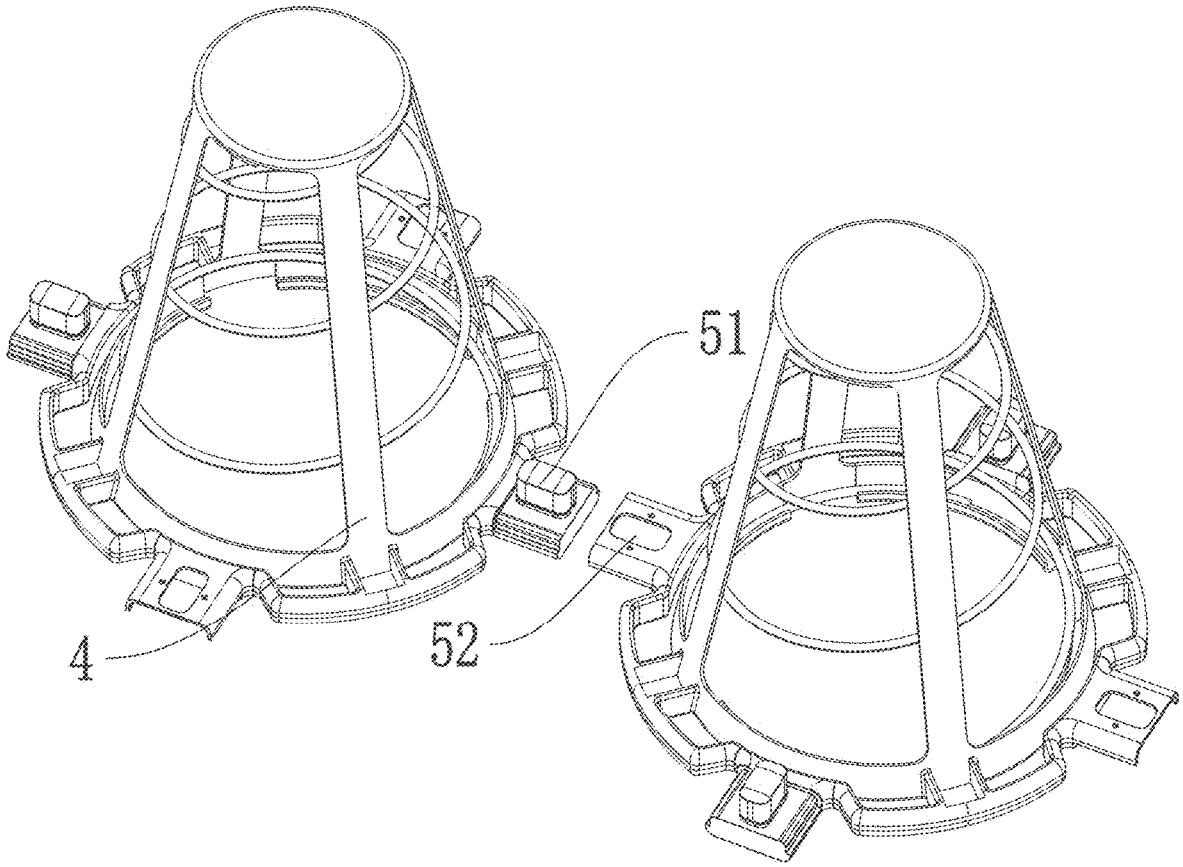
FIG. 36 is a view of a splicing cooperation of two pre-compressed springs (inverted tapered springs) in Embodiment 8 in the present disclosure.
Figure 37:
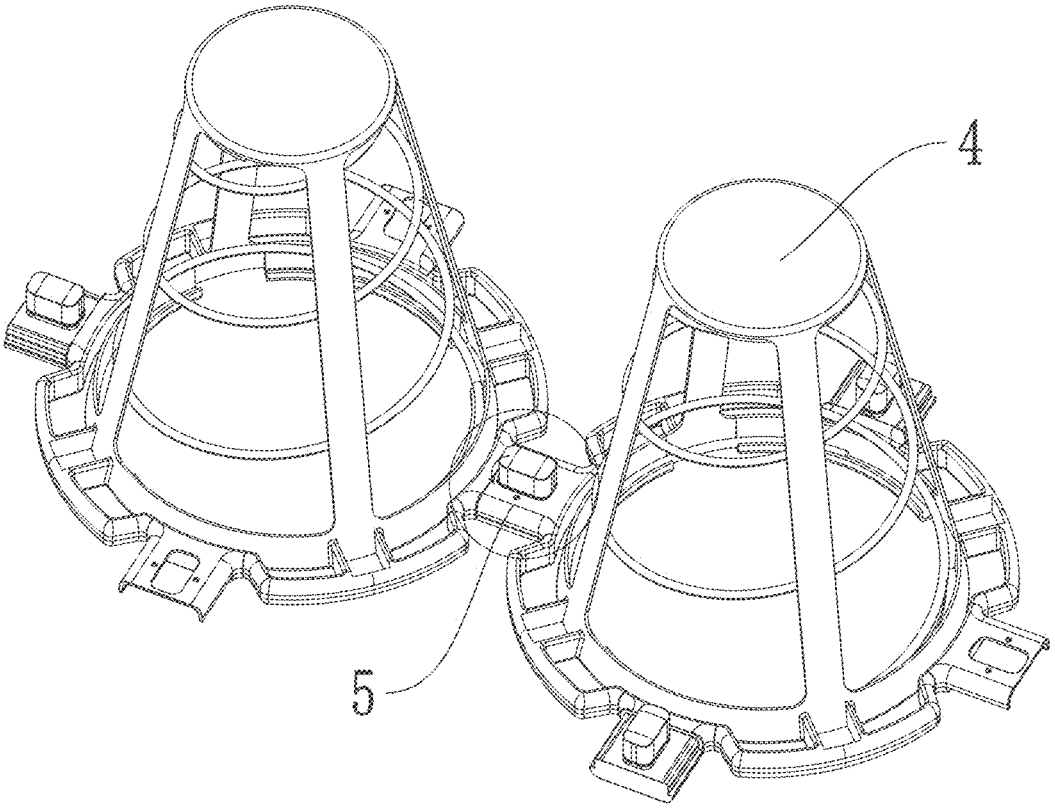
FIG. 37 is a view of the two pre-compressed springs (the inverted tapered springs) after being spliced in Embodiment 8 in the present disclosure.
Figure 38:
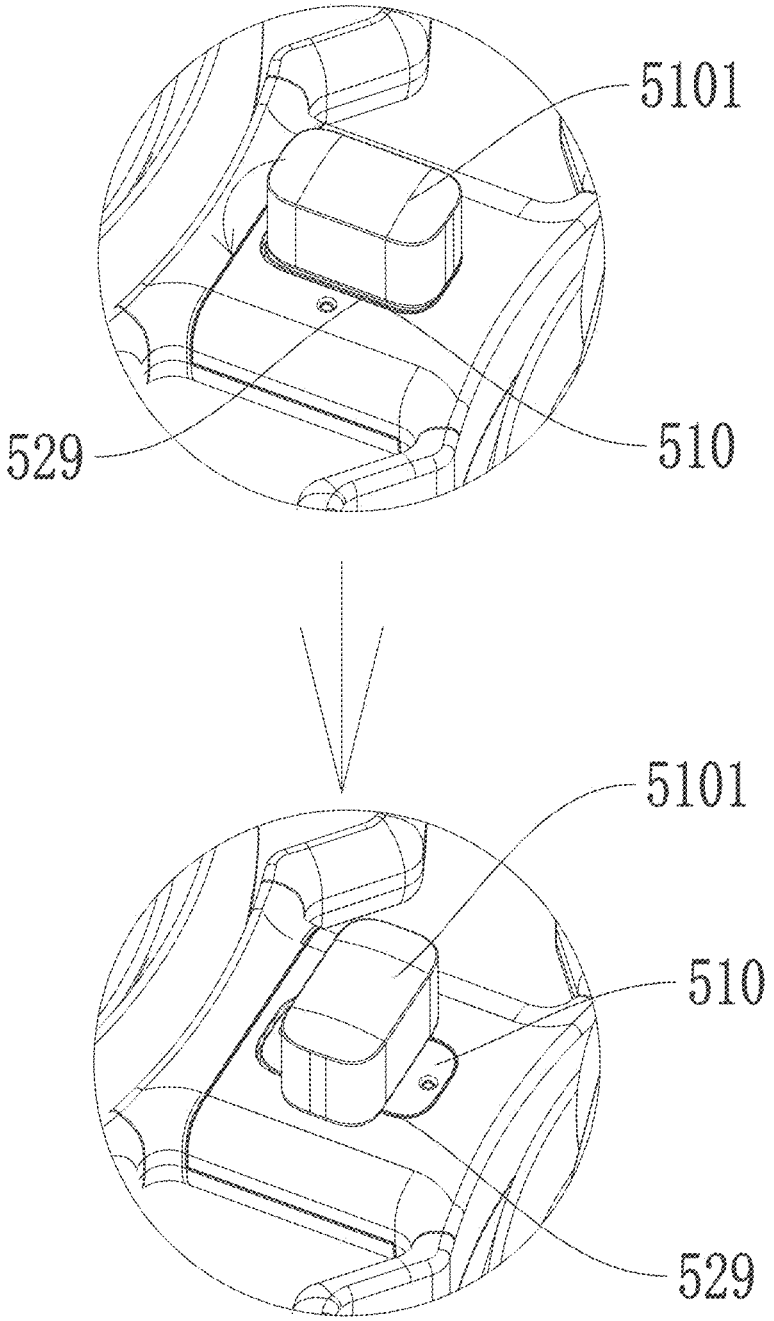
FIG. 38 is an enlarged view of a part of connection structures of the two pre-compressed springs (the inverted tapered springs) in Embodiment 8 in the present disclosure.
Figure 39:
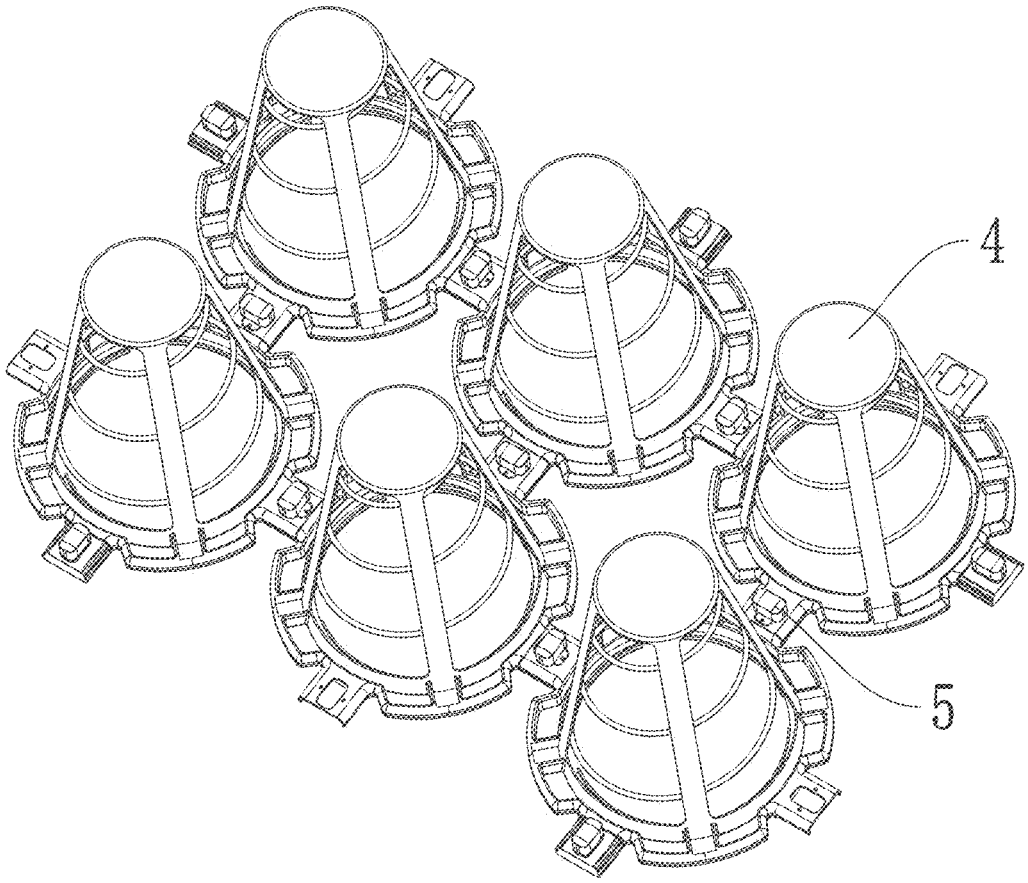
FIG. 39 is a view of a plurality of pre-compressed springs (the inverted tapered springs) after being spliced in Embodiment 8 in the present disclosure.
Figure 40:
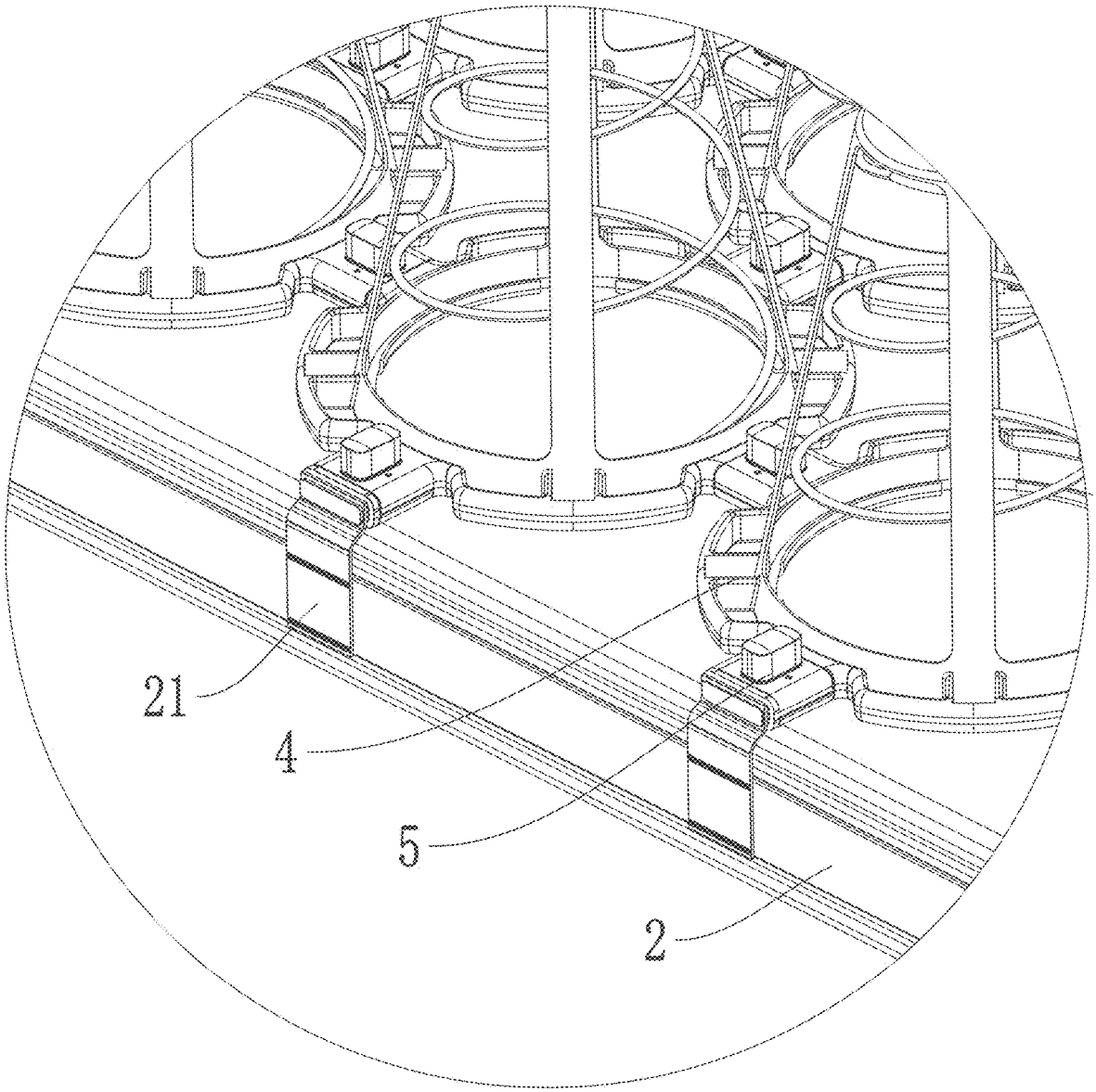
FIG. 40 is an enlarged view of a part of a buckled connection of a spring module and a soft cushion layer in Embodiment 8 in the present disclosure.

Referring to FIGS. 16-18, based on Embodiment 1, a main focus of this embodiment is on the plurality of connection structures 5 and the plurality of connection structures 5 differing from the structure of Embodiment 1.

In this embodiment, the plurality of connection structures 5 are designed such that each of the snapping positions 51 comprises protrusions 517 with elastic sheets and opposite to each other. The protrusions 517 with the elastic sheets are disposed in an up-and-down direction. Each of the buckling positions 52 comprises slotted holes 527 corresponding to the protrusions 517 with the elastic sheets, and the protrusions 517 with the elastic sheets are buckled in the slotted holes 527 to form a buckled connection. There is a certain interval between two of the protrusions 517 with the elastic sheets, and the interval is used as a movement amount of the two of the protrusions 517 with the elastic sheets for contracting inward, so that the protrusions 517 with the elastic sheets contract inward to form a buckled connection with the slotted holes 527 or release the buckled connection with the slotted holes 527.

Each of the snapping positions 51 further comprises guiding rods 518 disposed on two sides of the protrusions 517 with the elastic sheets for alignment with the buckling positions 52 when the snapping positions 51 are buckled.

In this embodiment, structures of the plurality of straps 21 with pull buckles of the soft cushion layer 2 configured to form detachable connection with the plurality of connection structures 5 are the same as the plurality of connection structures 5 on the plurality of pre-compressed springs 4 to form an auxiliary buckled structure.

Embodiment 5

Referring to FIGS. 19-22, based on Embodiment 1, a focus of this embodiment is on the plurality of connection structures 5 and the plurality of connection structures 5 differing from the structure of Embodiment 1.

In this embodiment, the plurality of connection structures 5 are designed such that each of the snapping positions 51 comprises elastic protrusions 519 opposite to each other. The elastic protrusions 519 are disposed in a left-and-right direction. Each of the buckling positions 52 comprises locking holes 528 corresponding to the elastic protrusions 519, and the elastic protrusions 519 are buckled in the locking holes 528 to form a buckled connection. There is a certain interval between two of the elastic protrusions 519, and the interval is used as a movement amount of the two of the elastic protrusions 519, so that the elastic protrusions 519 contract inward to form a buckled connection with the locking holes 528 or to release the buckled connection with the locking holes 528.

Two of the locking holes 528 of each of the buckling positions 52 are disposed on side edges of each of the buckling positions 52. A distance between the two of the locking holes 528 is less than a length of a cross-section of each of the buckling positions 52, and a distance between the two of the elastic protrusions 519 is matched with the length of the cross section of each of the buckling positions 52. The two of the elastic protrusions 519 are disposed in a corresponding one of the buckling positions 52 along an insertion direction, and hole positions of the two of the locking holes 528 are positioned at the two of the elastic protrusions 519 to achieve the buckled connection.

In this embodiment, structures of the plurality of straps 21 with pull buckles of the soft cushion layer 2 configured to form detachable connection with the plurality of connection structures 5 are the same as the plurality of connection structures 5 on the plurality of pre-compressed springs 4 to form an auxiliary buckled structure.

Embodiment 6

Referring to FIGS. 23-26, the elastic mattress comprises a spring module 1 and a soft cushion layer 2 laid on an upper layer of the spring module 1. The spring module 1 is a plurality of pre-compressed springs 4 defining staggered or array arrangements. The plurality of pre-compressed springs 4 comprise tapered spring sleeves 46 and connecting seats 44 extending from tapered end surfaces of the tapered spring sleeves 46. The tapered spring sleeves 46 are configured to accommodate inverted tapered springs 48 thereinto to apply a pre-compressed force to the plurality of inverted tapered springs. The connecting seats 44 are disposed at any position within upper sections as ⅓ of the tapered spring sleeves 46 so as to enable a plurality of connection structures 5 to be disposed.

Side edges of the connecting seats 44 are disposed with the plurality of connection structures 5, and one of the plurality of connection structures 5 on one of the plurality of pre-compressed springs 4 forms a buckled connection with one of the plurality of connection structures 5 on another of the plurality of pre-compressed springs 4 by one or more third connecting members 6. When the plurality of pre-compressed springs 4 are buckled to form the spring module 1 using the plurality of connection structures 5 and the one or more third connecting members 6, the soft cushion layer 2 with a certain thickness is directly laid on a formed lying supporting surface of the spring module 1. The soft cushion layer 2 can be a whole cushion layer compositely molded or a combination of a plurality of cushion layers with different softness and hardness so as to form the soft cushion layer 2 with different hardness and tactility.

A plurality of straps 21 with pull buckles are disposed on the side edges around the soft cushion layer 2. The plurality of straps 21 with pull buckles form a detachable connection with corresponding ones of the connection structures 5 on corresponding ones of the plurality of pre-compressed springs 4. Corresponding ones of the plurality of pre-compressed springs 4 are located at an outer periphery of the spring module 1, and the soft cushion layer 2 is laid on an upper side of the spring module 1 to form a semi-enclosed form.

The plurality of connection structures 5 of this embodiment comprise insertion holes 53 and snapping slots 54. The insertion holes 53 are in communication with the snapping slots 54, and widths of the snapping slots 54 are smaller than diameters of the insertion holes 53. The one or more third connecting members 6 comprise one or more rotating parts 61 and one or more protrusions 62 disposed on one or more end surfaces of the one or more rotating parts 61. One or more diameters of one or more end portions of the one or more protrusions 62 are matched with the insertion holes 53, and the one or more diameters of the one or more end portions of the one or more protrusions 62 are larger than the snapping slots 54. When the one or more end portions of the one or more protrusions 62 are disposed below the insertion holes 53 after passing through the insertion holes 53, the one or more protrusions 62 further slide into the snapping slots 54 to enable the one or more end portions of the one or more protrusions 62 to be buckled to bottoms of the snapping slots 54 for positioning.

In this embodiment, two adjacent pre-compressed springs 4 of the plurality of pre-compressed springs 4 are connected by the one or more third connecting members 6. Each of the one or more third connecting members 6 comprises four of the one or more protrusions 62, and four of the plurality of pre-compressed springs 4 are used as a group to form a buckled connection by one of the one or more third connecting members 6. When the one or more protrusions 62 are disposed in the insertion holes 53, the one or more third connecting members 6 enable the one or more rotating parts 61 to rotate so as to enable the one or more protrusions 62 to be disposed in the snapping slots 54 to form the buckled connection or to be disposed in the insertion holes 53 to release the buckled connection.

When the one or more rotating parts 61 drive the one or more protrusions 62 to be inserted into various ones of the insertion holes 53 on corresponding ones of the plurality of pre-compressed springs 4, the one or more rotating parts 61 rotate counterclockwise to drive the one or more protrusions 62 to slide into the snapping slots 54, so that the snapping slots 54 and the one or more protrusions 62 form the buckled connection. The one or more rotating parts 61 then rotate clockwise to drive the one or more protrusions 62 to slide into the insertion holes 53 to release the buckled connection.

In this embodiment, structures of the plurality of straps 21 with pull buckles of the soft cushion layer 2 configured to form detachable connection with the plurality of connection structures 5 are the same as the one or more third connecting members 6, and the one or more third connecting members 6 on the plurality of straps 21 with pull buckles comprise protrusions 62 to form an auxiliary buckled structure.

Embodiment 7

Referring to FIGS. 27-FIG. 34, the elastic mattress comprises a spring module 1 and a soft cushion layer 2 laid on an upper layer of the spring module 1. The spring module 1 is a plurality of pre-compressed springs 4 defining staggered or array arrangements. The plurality of pre-compressed springs 4 comprise tapered spring sleeves 46 and connecting seats 44 extending from tapered end surfaces of the tapered spring sleeves 46. The tapered spring sleeves 46 are configured to accommodate inverted tapered springs 48 thereinto to apply a pre-compressed force to the plurality of inverted tapered springs 48. The connecting seats 44 are disposed at any position within upper sections as ⅓ of the tapered spring sleeves 46 so as to enable a plurality of connection structures 5 to be disposed.

Side edges of the connecting seats 44 are disposed with a plurality of snapping slots 54, and pairs of the plurality of pre-compressed springs 4 are buckled to the plurality of snapping slots 54 through one or more third connecting members 6. Each of the one or more third connecting members 6 comprises two elastic snapping ends 66 and a connecting part 67 connected to the two elastic snapping ends 66. The connecting part 67 has elastic deformation amounts for the two elastic snapping ends 66 to move away from each other. The two elastic snapping ends 66 are squeezed to contract inward to release the buckled connection when the two elastic snapping ends 66 are buckled in the snapping slots 54. A length of the connecting part 67 of each of the one or more third connecting members 6 can be used to adjust a gap between the pairs of the plurality of pre-compressed springs 4 within a certain range, adjusting a footprint of the spring module 1 within a small range, so that an area of the spring module 1 has a certain small adjustable amount. In addition, each of the one or more third connecting members 6 form a flexible connection between two of the plurality of pre-compressed springs 4 by the elastic deformation amount of the connecting part 67. Compared with a rigid connection, pressure can be cushioned to a great extent, avoiding a rigid break of a connection between the plurality of pre-compressed springs 4 due to excessive pressure, so as to protect a service life of the spring module 1. In addition, each of the one or more third connecting members 6 form the flexible connection between the two of the plurality of pre-compressed springs 4 by the elastic deformation amount of the connecting part 67. When a pressure is applied to the plurality of pre-compressed springs 4, the flexible connection is used as a transition cushion to reduce an interference amount in the rigid connection, and an interference amount of two adjacent pre-compressed springs 4 of the plurality of pre-compressed springs 4 is smaller compared with the rigid connection.

When the plurality of pre-compressed springs 4 are buckled using the one or more third connecting members 6 to form the spring module 1, the soft cushion layer 2 with a certain thickness is directly laid on a lying supporting surface of the formed spring module 1. The soft cushion layer 2 can be a whole cushion layer compositely molded or a combination of a plurality of cushion layers with different softness and hardness so as to form the soft cushion layer 2 with different hardness and tactility.

A plurality of straps 21 with pull buckles are disposed on side edges around the soft cushion layer 2. The plurality of straps 21 with pull buckles form a detachable connection with corresponding ones of the connection structures 5 on corresponding ones of the plurality of pre-compressed springs 4. Corresponding ones of the plurality of pre-compressed springs 4 are located at an outer periphery of the spring module 1, and the soft cushion layer 2 is laid on an upper side of the spring module to form a semi-enclosed form.

In this embodiment, structures of the plurality of straps 21 with pull buckles of the soft cushion layer 2 configured to form detachable connection with the plurality of connection structures 5 are the same as the one or more third connecting members 6, and the one or more third connecting members 6 on the plurality of straps 21 with pull buckles comprise elastic snapping ends 66 to form an auxiliary buckled structure.

Embodiment 8

Referring to FIGS. 35-40, based on Embodiment 1, a focus of this embodiment is on the plurality of connection structures 5, and the plurality of connection structures 5 differing from the structure of Embodiment 1 are provided.

In this embodiment, the plurality of connection structures 5 are designed such that parts of the snapping positions 51 pass through the buckling positions 52 when being disposed in the buckling positions 52, and the parts of the snapping positions 51 passing through the buckling positions 52 rotate to form the buckled connection or release the buckled connection.

A specific structure is that each of the snapping positions 51 comprises a buckling member 510 and a rotating member 5101 configured to rotate relative to the buckling member 510. Each of the buckling positions 52 comprises a hole slot 529 configured for the buckling member 510 and the rotating member 5101 to pass through. The rotating member 5101 and the buckling member 510 are arranged in sequence along an insertion direction of each of the snapping positions 51, and the rotating member 5101 is configured to rotate to be misaligned with the hole slot 529, enabling the buckling member 510 to be locked in hole slot 529.

In this embodiment, structures of the plurality of straps 21 with pull buckles of the soft cushion layer 2 configured to form detachable connection with the plurality of connection structures 5 are the same as the plurality of connection structures 5 of the plurality of pre-compressed springs to form an auxiliary buckled structure.

Embodiment 9

Figure 41:
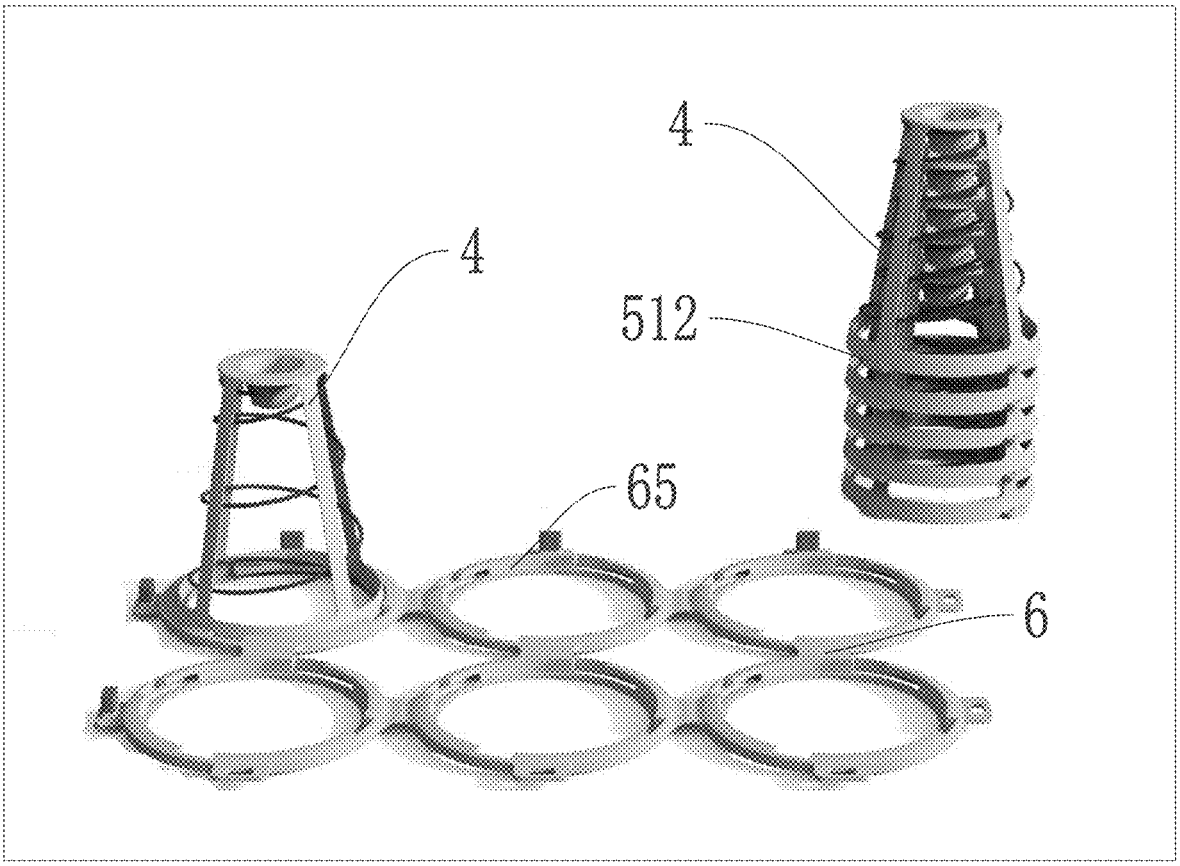
FIG. 41 is a view of a connection structure of pre-compressed springs and a third connecting member in Embodiment 9 in the present disclosure.
Figure 42:
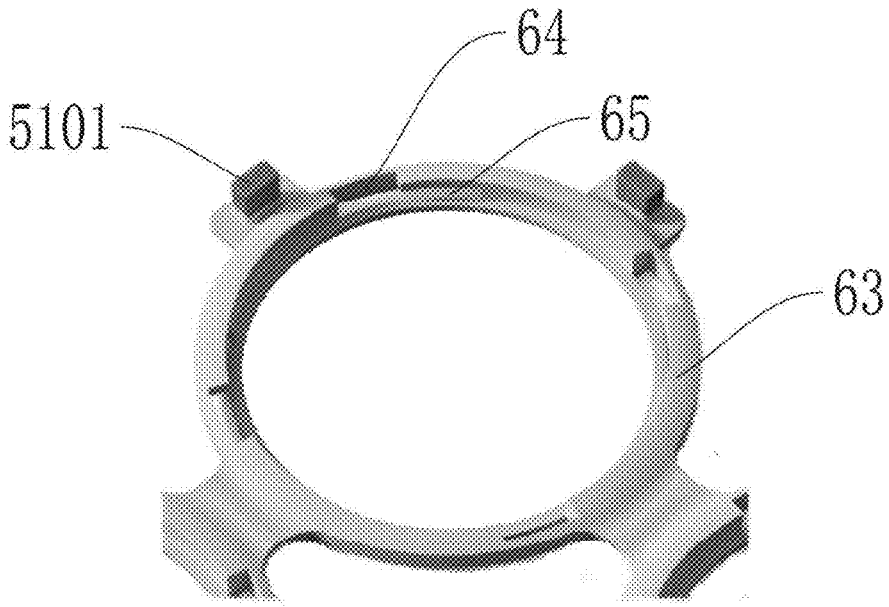
FIG. 42 is a diagrammatic view of a structure of the third connecting member in Embodiment 9 in the present disclosure.

Referring to FIGS. 41 and 42, based on Embodiment 6, this embodiment provides one or more third connecting members 6 having one or more structures different from the one or more third connecting members 6 in Embodiment 6.

In this embodiment, the one or more third connecting members 6 and the plurality of connection structures 5 on the plurality of pre-compressed springs 4 are described as follows. The plurality of connection structures 5 comprise snapping points 512 disposed on the plurality of pre-compressed springs 4. In this embodiment, the snapping points 512 are disposed on side edges of the tapered spring sleeves 46 of the plurality of pre-compressed springs 4 adjacent to large end surfaces 41 of the tapered spring sleeves 46. The one or more third connecting members 6 comprise a plurality of buckling rings 63. The one or more third connecting members 6 are made of elastic materials or flexible materials and can be folded at will, and shapes are changed to facilitate storage when being not assembled to the plurality of pre-compressed springs 4.

Specifically, each of the plurality of buckling rings 63 of the one or more third connecting members 6 comprises an annular groove 65 and an avoidance opening 64. The avoidance opening 64 is configured to enable a corresponding one of the snapping points 512 on the plurality of pre-compressed springs 4 to be plugged in. When each of the snapping points 512 on the plurality of pre-compressed springs 4 is disposed in the annular groove 65 through the avoidance opening 64, each of the plurality of pre-compressed springs 4 can rotate to enable the corresponding one of the snapping points 512 to slide in the annular groove 65, so that each of the snapping points 512 is misaligned with the avoidance opening 64. At this time, each of the snapping points 512 is buckled in the annular groove 65 for being prevented from moving upward by the annular grooves 65.

In this embodiment, each of the one or more third connecting members 6 can be assembled to at least six of the plurality of pre-compressed springs 4. Structures of the plurality of buckling rings 63 are designed such that individuals of the plurality of buckling rings 63 are disposed at certain intervals, and the plurality of buckling rings 63 are independent from one another. After the plurality of pre-compressed springs 4 are assembled, independence between individuals of the plurality of pre-compressed springs 4 is ensured, and there is no interference between adjacent pre-compressed springs 4 of the plurality of pre-compressed springs 4 when being pressed, which ensures a more stable support.

In this embodiment, considering an assembly of the soft cushion layer 2, the plurality of connection structures 5 described in Embodiment 8 are disposed on an outer side of each of the one or more third connecting members 6. The outer side of each of the one or more third connecting members 6 comprises the buckling member 510 and the rotating member 5101 configured to rotate relative to the buckling member 510. One of the plurality of straps 21 with pull buckles of the soft cushion layer 2 configured to form detachable connection with a corresponding one of the plurality of connection structures 5 is a hole slot 529 configured for the buckling member 510 and the rotating member 5101 to pass through, and the hole slot 529 on the one of the plurality of straps 21 with pull buckles forms an auxiliary buckled structure with a corresponding one of the plurality of connection structures 5.

Embodiment 10

Referring to FIGS. 45-51, the elastic mattress further comprises a connecting base 7 for supporting a spring module 1 spliced by a plurality of pre-compressed springs 4. The connecting base 7 is formed by splicing a plurality of pre-compressed springs 4 housing forward tapered springs 48*a* on a spring connecting seat 72. Small end surfaces 42 of a plurality of pre-compressed springs 4 housing inverted tapered springs 48*b* extend downward to form tapered protrusions 43, and small end surfaces 42 of the plurality of pre-compressed springs 4 housing the forward tapered springs 48*a* extend downward to form tapered concave cavities 71. The tapered protrusions 43 are inserted into the tapered concave cavities 71 to form a buckled connection. The spring connecting seat 72 uses large end surfaces 41 of the plurality of pre-compressed springs 4 housing the forward tapered springs 48*a* as a ground support, ensuring stability of the whole elastic mattress.

On the connecting base 7, the small end surfaces 42 of the plurality of pre-compressed springs 4 housing the inverted tapered springs 48*b* and the small end surfaces 42 of the plurality of pre-compressed springs 4 housing the forward tapered springs 48*a* form a buckled connection. The formed elastic mattress utilizes drum-like structures for support, enhancing cushioning strength with respect to stress and improving overall comfort of the elastic mattress.

The buckled connection of the connecting base and the plurality of pre-compressed springs 4 use a structure of the tapered protrusions 43 and the tapered concave cavities 71.

When the plurality of pre-compressed springs 4 are stressed, a tapered downward cooperation is tighter when being pressed more, creating a tapered interference fit to enable the buckled connection to be more stable.

In this embodiment, an elastic strength of the plurality of pre-compressed springs 4 housing the inverted tapered springs 48*b* can be selected to be greater an elastic strength of the plurality of pre-compressed springs 4 housing the forward tapered springs 48*a*. The spring module 1 formed by the plurality of pre-compressed springs 4 has more elasticity, enhancing comfort of a lying support. The connecting base 7 formed by the plurality of pre-compressed springs 4 has less elasticity, is not easy to deform, and enables a support to be more stable.

In this embodiment, the spring module 1 is formed by a buckled connection of the plurality of pre-compressed springs 4 housing the forward tapered springs 48*a* and the plurality of pre-compressed springs 4 housing the inverted tapered springs 48*b*. The plurality of pre-compressed springs 4 define a connection but not a rigid connection. Within the formed spring module 1, there is no interference from other connections between two adjacent pre-compressed springs 4 of the plurality of pre-compressed springs 4 to ensure left and right pre-compressed springs 4 of the plurality of pre-compressed springs 4 to have independent compression movement when being stressed. Elastic variations caused by stress applied to individual pre-compressed springs 4 of the plurality of pre-compressed springs 4 only occur on upper and lower pressure surfaces, without traction and interference from elastic variation of other springs in left and right directions.

In this embodiment, a pad 22 can be optionally placed on the lying supporting surface of the formed spring module 1, followed by a soft cushion layer 2, or the soft cushion layer 2 with a certain thickness can be directly placed. The soft cushion layer 2 and the pad 22 can be a whole cushion layer compositely molded or a combination of a plurality of cushion layers with different softness and hardness to form the soft cushion layer 2 and the pad 22 having different hardness and tactility.

The soft cushion layer 2 can be laid on an upper side or on the upper side and around the spring module 1 to form enclosed or semi-enclosed forms without covering a bottom surface of the connecting base 7. In this embodiment, the connecting base 7 comprises the plurality of connection structures 5 that form a buckled connection with a plurality of straps 21 with pull buckles around the soft cushion layer 2.

Embodiment 11

Figure 52:
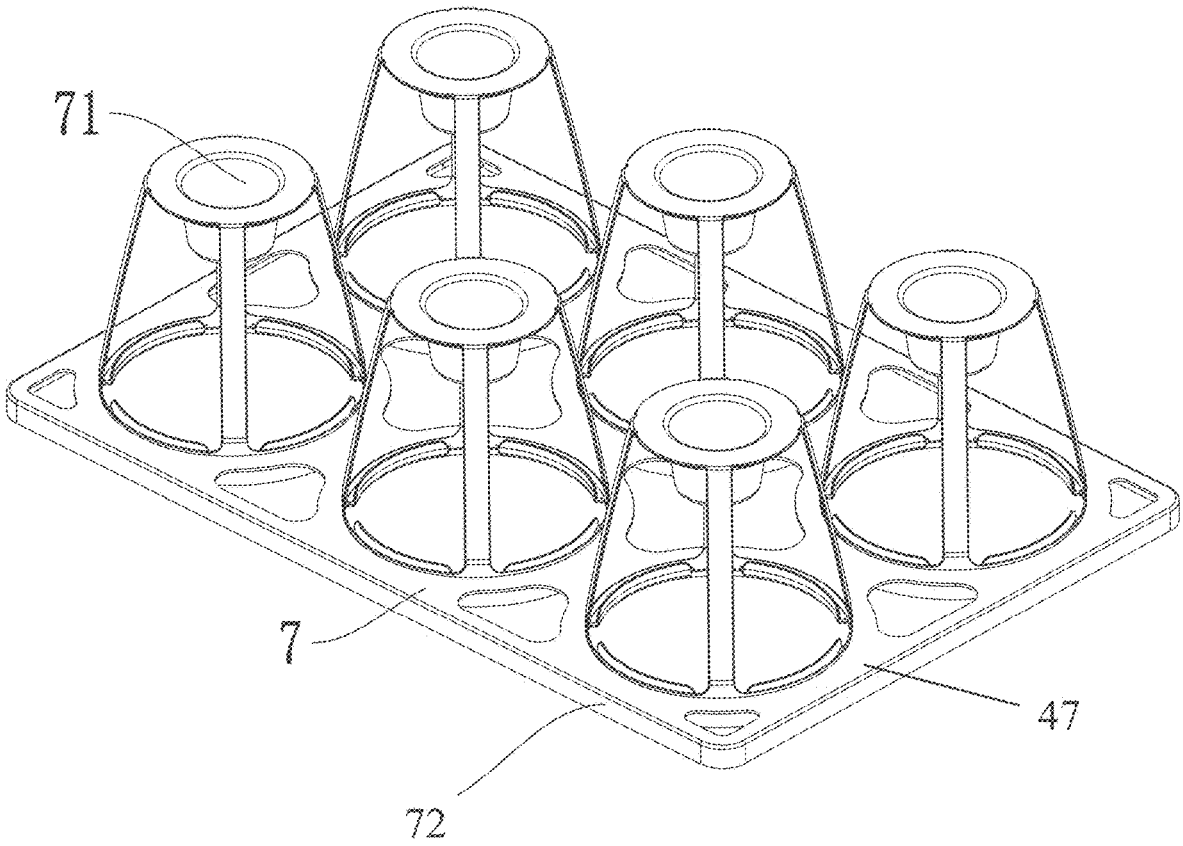
FIG. 52 is a diagrammatic view of a structure of a connecting base in Embodiment 11 in the present disclosure.

Referring to FIG. 52, different from Embodiment 10, in the plurality of pre-compressed springs 4 housing the forward tapered springs 48*a* assembled on the connecting base 7, spring fixing seats 47 configured to enable the forward tapered springs 48*a* to be pre-compressed are fixedly buckled to the spring connecting seat 72 of the connecting base 7 in this embodiment. The spring fixing seats 47 comprise tapered accommodating cavities that cooperate with the spring connecting seats 72 to secure the forward tapered springs 48*a*.

Embodiment 12

Figure 53:
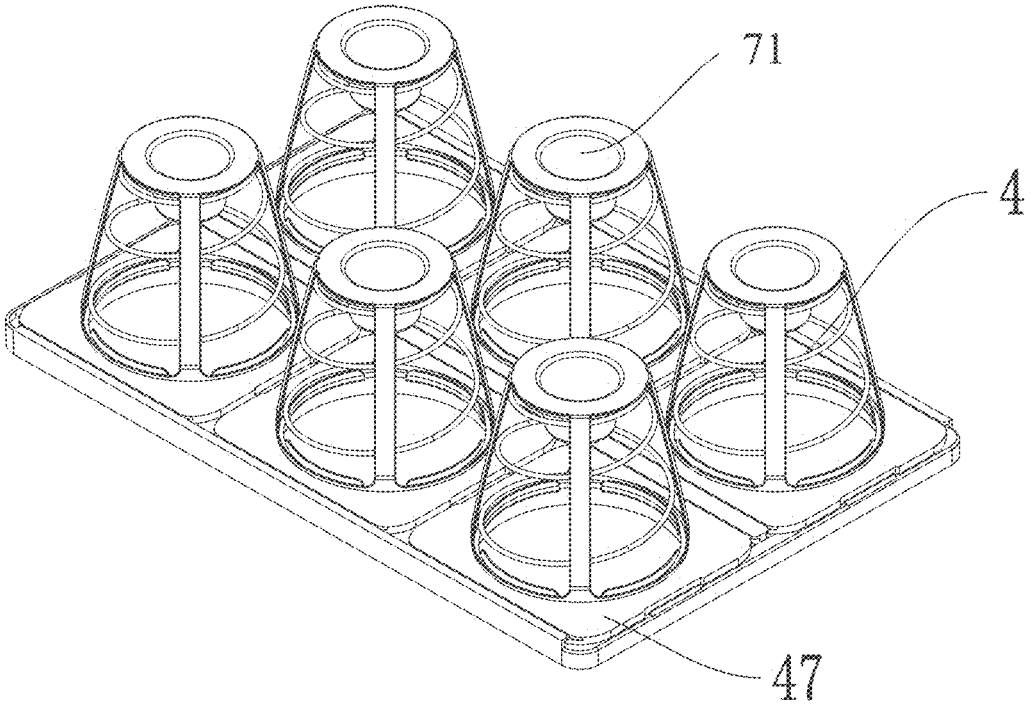
FIG. 53 is a diagrammatic view of a structure of a connecting base in Embodiment 12 in the present disclosure.
Figure 54:
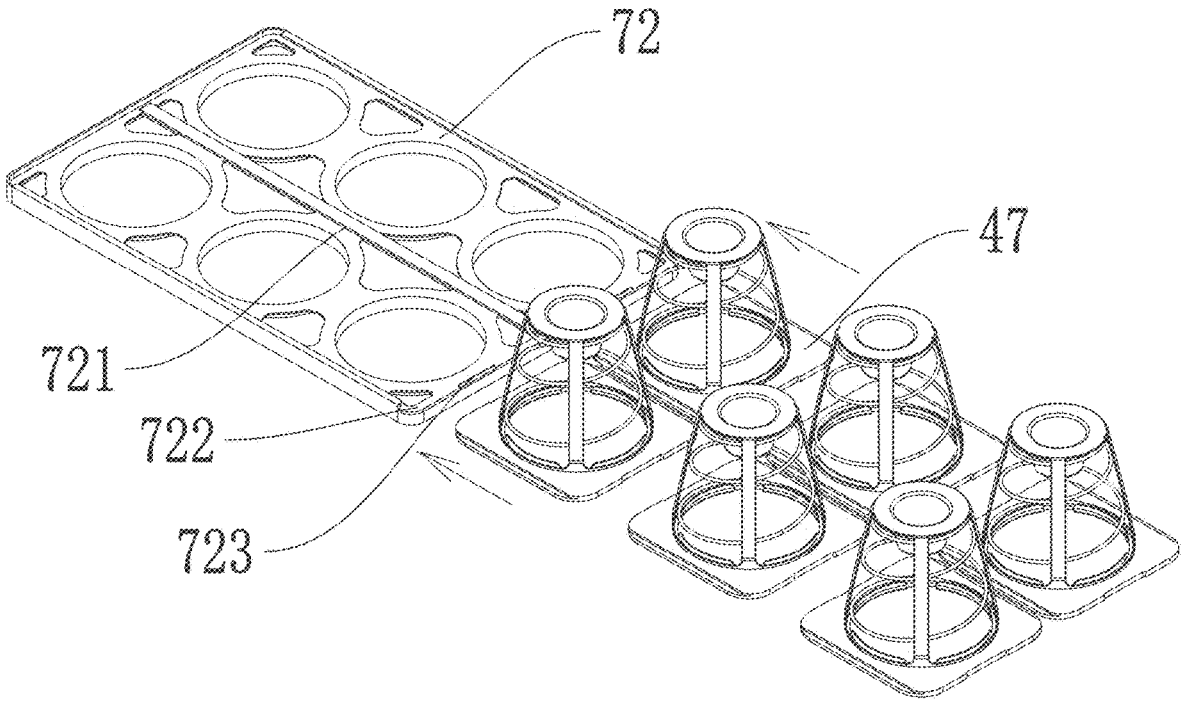
FIG. 54 is an exploded view of the structure of the connecting base in Embodiment 12 in the present disclosure.

Referring to FIGS. 53 and 54, different from Embodiment 10, in the plurality of pre-compressed springs 4 housing the forward tapered springs 48*a* assembled on the connecting base 7, spring fixing seats 47 configured to enable the forward tapered springs 48*a* to be pre-compressed are detachably buckled to the spring connecting seat 72 in this embodiment.

Specifically, the spring connecting seat 72 comprises sliding rails 721 configured to be slidably connected to the spring fixing seats 47, and the sliding rails 721 inhibit the spring fixing seats 47 from being separated from the spring connecting seat 72 in a vertical direction. One end of the spring connecting seat 72 has a sliding-in opening 722 for the spring fixing seats 47. A positioning structure 723 is disposed adjacent to the sliding-in opening 722 and corresponding to a position of a first one of the spring fixing seats 47, and the positioning structure 723 is used to prevent the spring fixing seats 47 from sliding out of the sliding-in opening 722.

Embodiment 13

Figure 55:
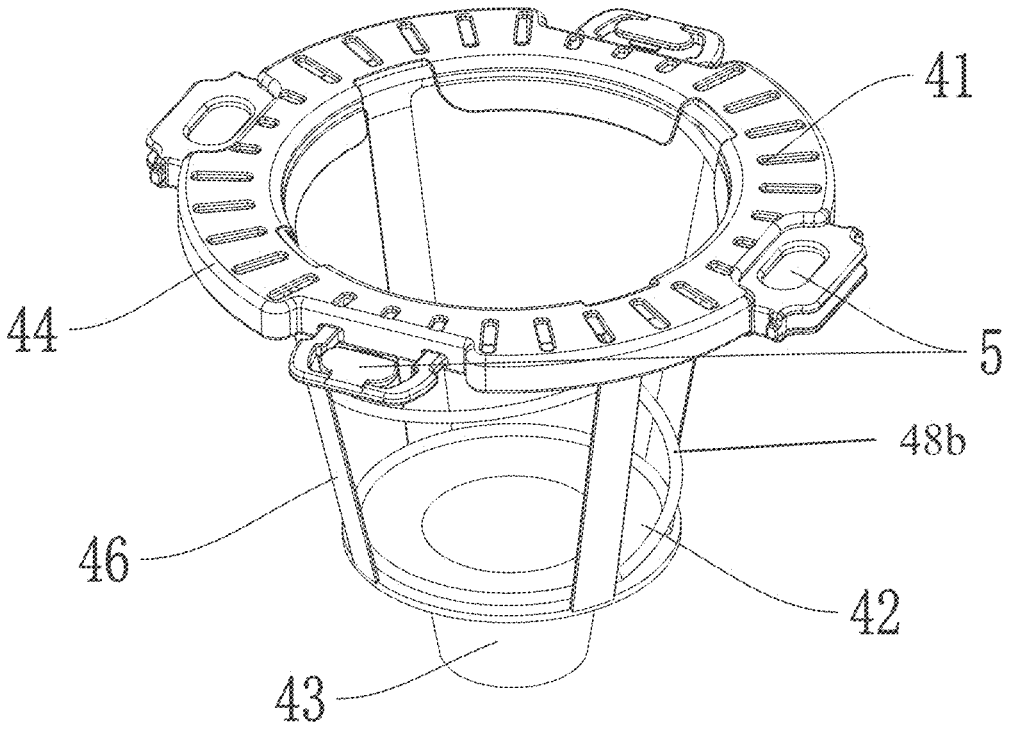
FIG. 55 is a view of a structure of a pre-compressed spring housing an inverted tapered spring in Embodiment 13 in the present disclosure.
Figure 56:
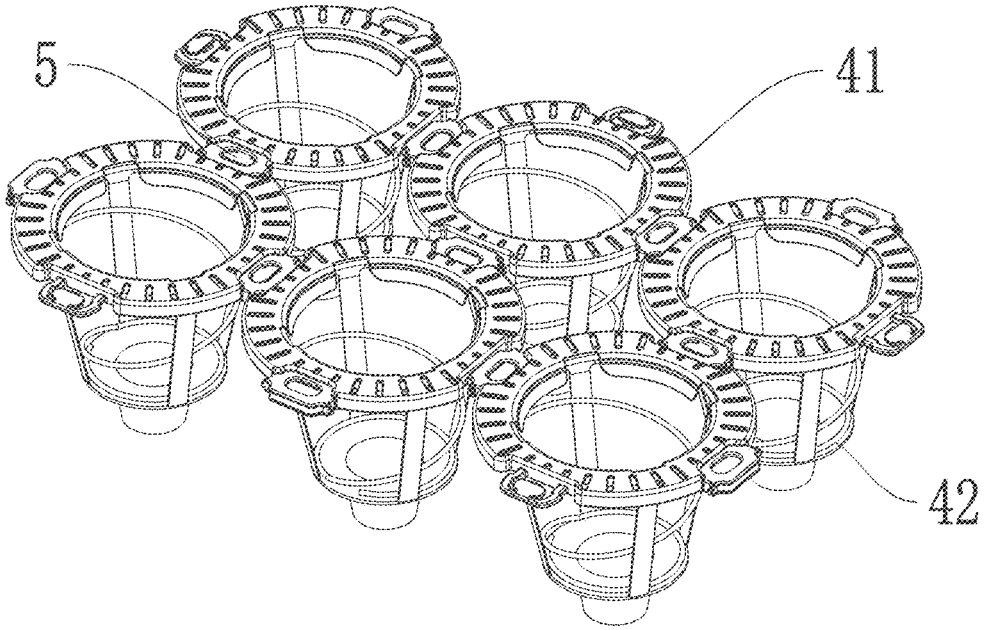
FIG. 56 is a view of a spliced connection of a plurality of pre-compressed springs housing inverted tapered springs in Embodiment 13 in the present disclosure.

Referring to FIGS. 55 and 56, different from Embodiment 10, when the plurality of pre-compressed springs 4 housing inverted tapered springs 48*b* form the spring module 1 in this embodiment, the plurality of connection structures 5 are disposed at any position within upper sections as ⅓ of adjacent pre-compressed springs 4 of the plurality of pre-compressed springs 4 and adjacent to large end surfaces 41.

Specifically, the plurality of pre-compressed springs 4 housing the inverted tapered springs 48*b* comprise tapered spring sleeves 46 and connecting seats 44 extending from tapered end surfaces of the tapered spring sleeves 46. The tapered spring sleeves 46 are configured to accommodate the inverted tapered springs 48*b* to form a pre-compressed force on the inverted tapered springs 48*b*. The connecting seats 44 are disposed at any position within upper sections as ⅓ of the tapered spring sleeves 46 and are configured to be disposed with the plurality of connection structures 5.

Side edges of the connecting seats 44 are disposed with the plurality of connection structures 5. The plurality of connection structures 5 comprise snapping positions 51 and buckling positions 52 (e.g., each of the plurality of connection structures 5 comprises a snapping position 51 and a buckling position 52). One of the snapping positions 51 on one of the plurality of pre-compressed springs 4 forms a buckled connection with one of the buckling positions 52 of another of the plurality of pre-compressed springs 4. The snapping positions 51 and the buckling positions 52 are designed to be buckling structures having buckle buttons, and the snapping positions 51 are configured to squeeze buckling positions 52 to contract inward to release the buckled connection when being buckled in the buckling positions 52.

In this embodiment, the plurality of connection structures 5 are added to the large end surfaces 41 of the plurality of pre-compressed springs 4 housing the inverted tapered springs 48*b*, which prevents the plurality of pre-compressed springs 4 having wide tops and narrow bottoms from swaying unstably when being reversely mounted and being stressed and increases a connection stability between the adjacent pre-compressed springs 4.

Embodiment 14

Figure 57:
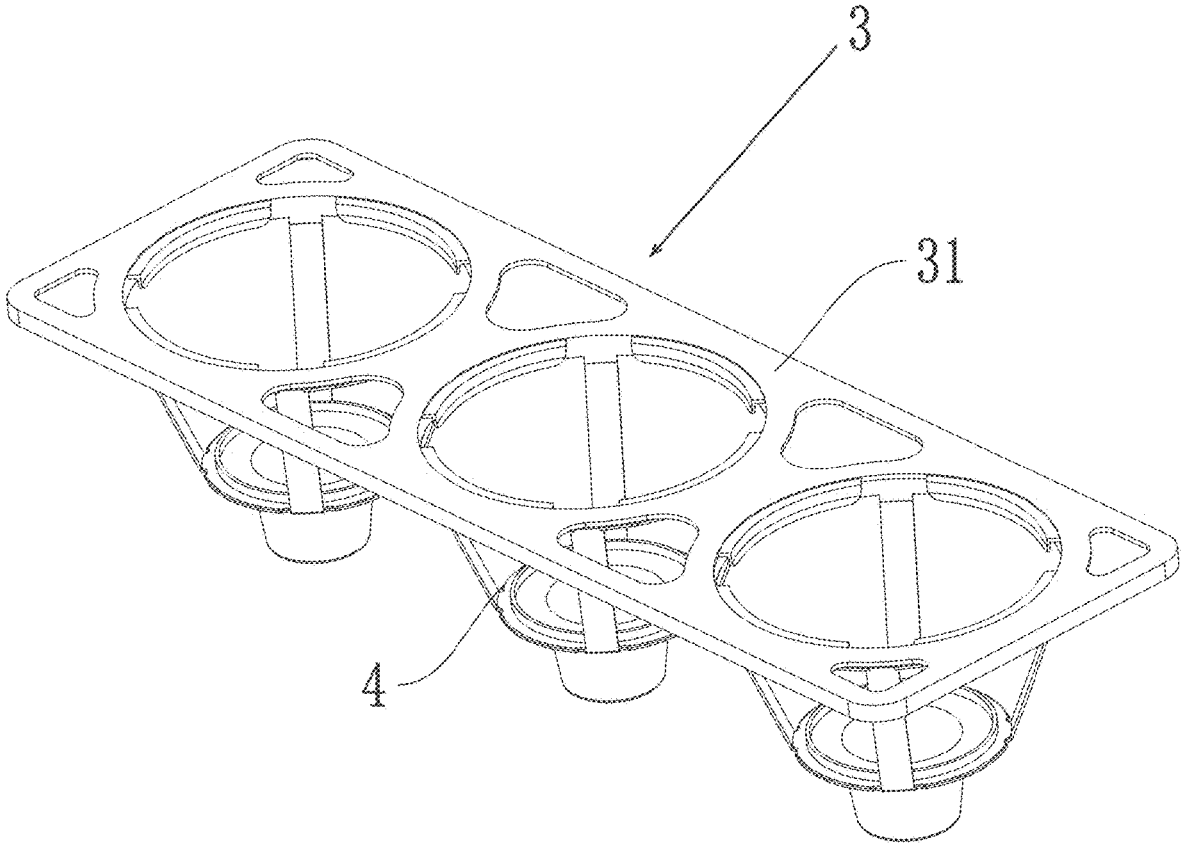
FIG. 57 is a view of a single-row structure of a spring module group housing inverted tapered springs in Embodiment 14 in the present disclosure.
Figure 58:
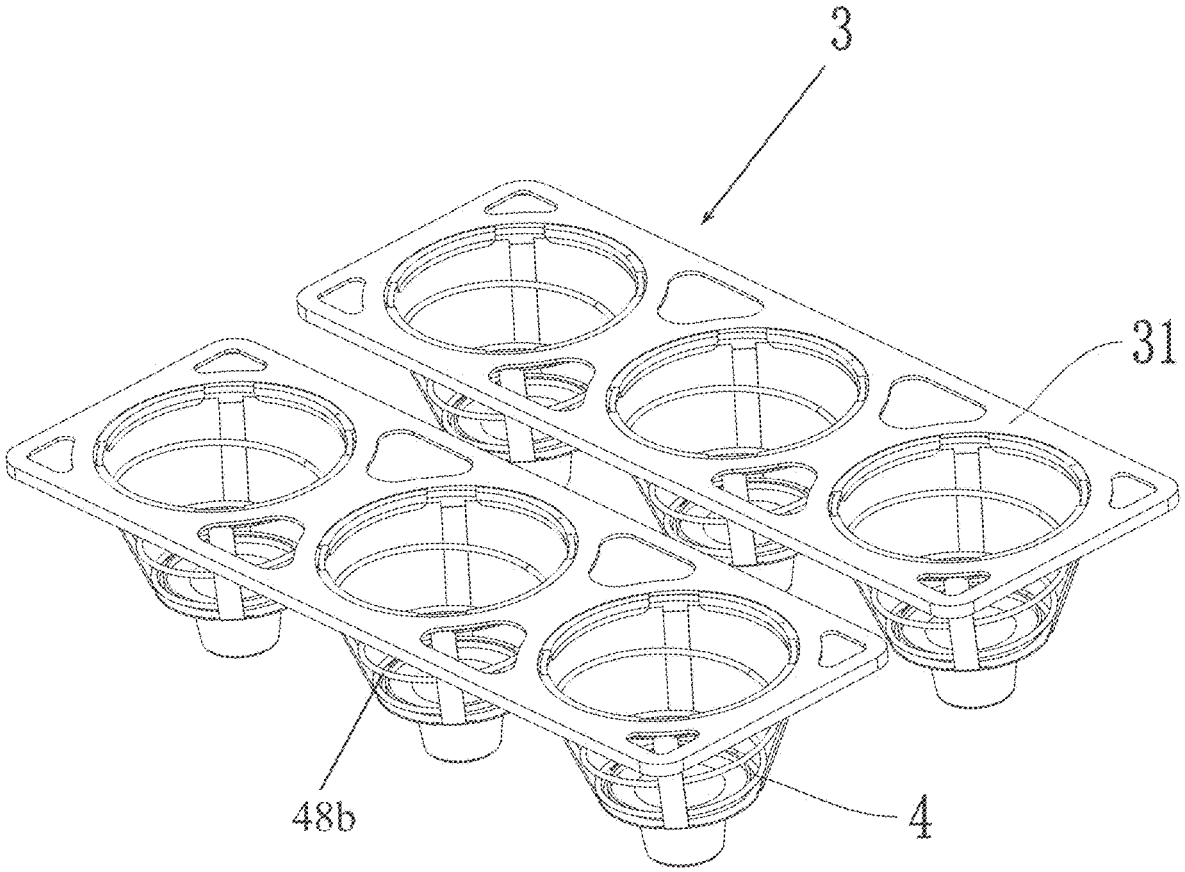
FIG. 58 is a view of a structure of multiple spring module groups housing the inverted tapered springs in Embodiment 14 in the present disclosure.
Figure 59:
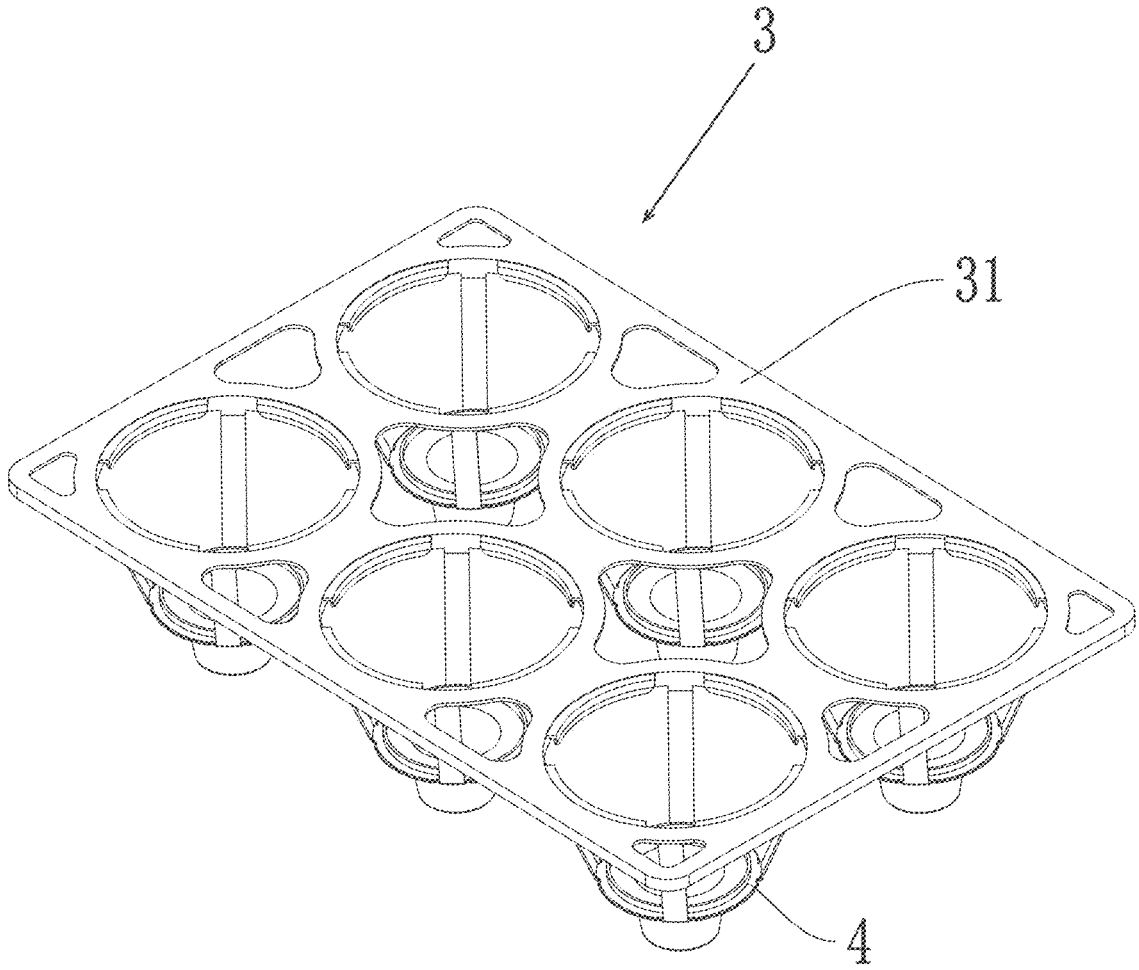
FIG. 59 is a view of a double-row structure of the spring module group housing the inverted tapered springs in Embodiment 14 in the present disclosure.

Referring to FIGS. 57-59, different from Embodiment 10, when the plurality of pre-compressed springs 4 housing inverted tapered springs 48*b* form the spring module 1, the spring module 1 is formed using the plurality of pre-compressed springs 4 by splicing in pairs or connecting by one or more third connecting members 6 in this embodiment. In a spring module group 3, the plurality of pre-compressed springs 4 define staggered or array arrangements.

The spring module group 3 comprises spring bases 31 for assembling the plurality of pre-compressed springs 4, and the plurality of pre-compressed springs 4 are fixedly buckled to the spring bases 31 using the spring fixing seats 47 of the plurality of pre-compressed springs 4. The spring fixing seats 47 comprise tapered accommodating cavities that cooperate with the spring bases 31 to secure the inverted tapered springs 48*b*.

In the spring module group 3, every three of the plurality of pre-compressed springs 4 can be arranged into a single row to form a group, and rows form a connection by a buckled connection between the spring bases 31. Alternatively, in the spring module group 3, every 6 of the plurality of pre-compressed springs 4 can be symmetrically arranged into double rows to form a group, and the rows form the connection by the buckled connection between the spring bases 31.

Embodiment 15

Figure 60:
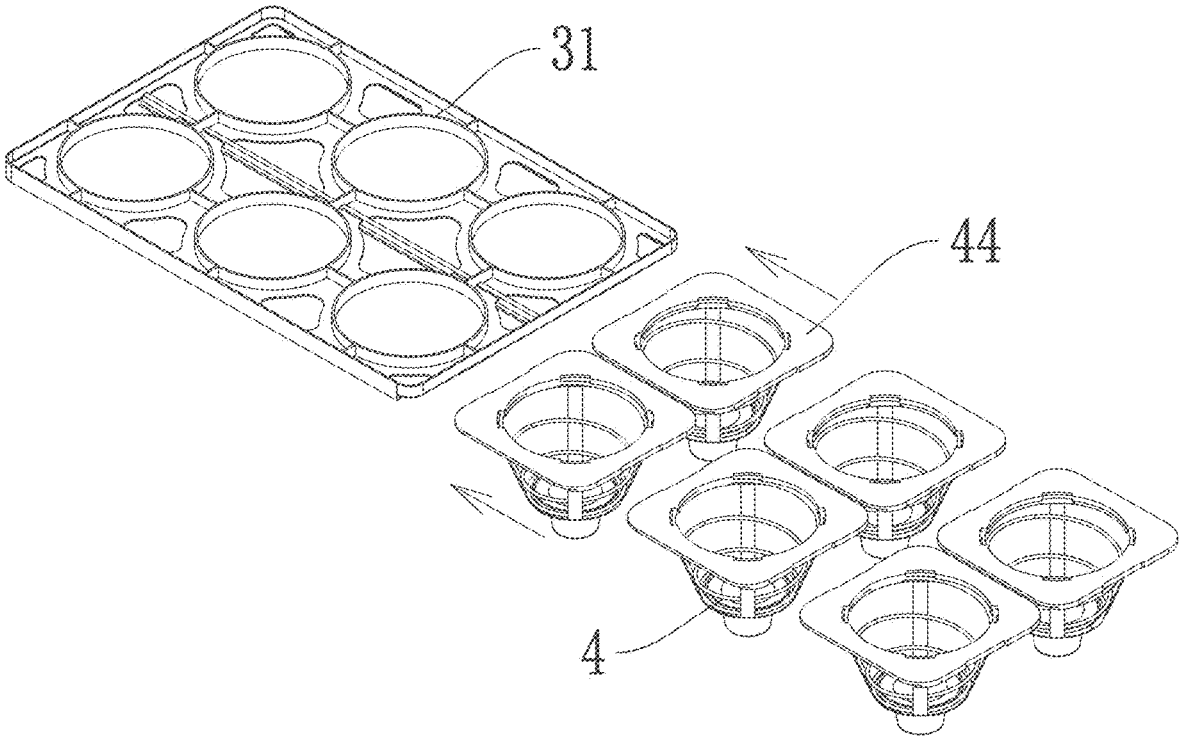
FIG. 60 is an exploded view of a structure of a spring module group housing inverted tapered springs in Embodiment 15 in the present disclosure.
Figure 61:
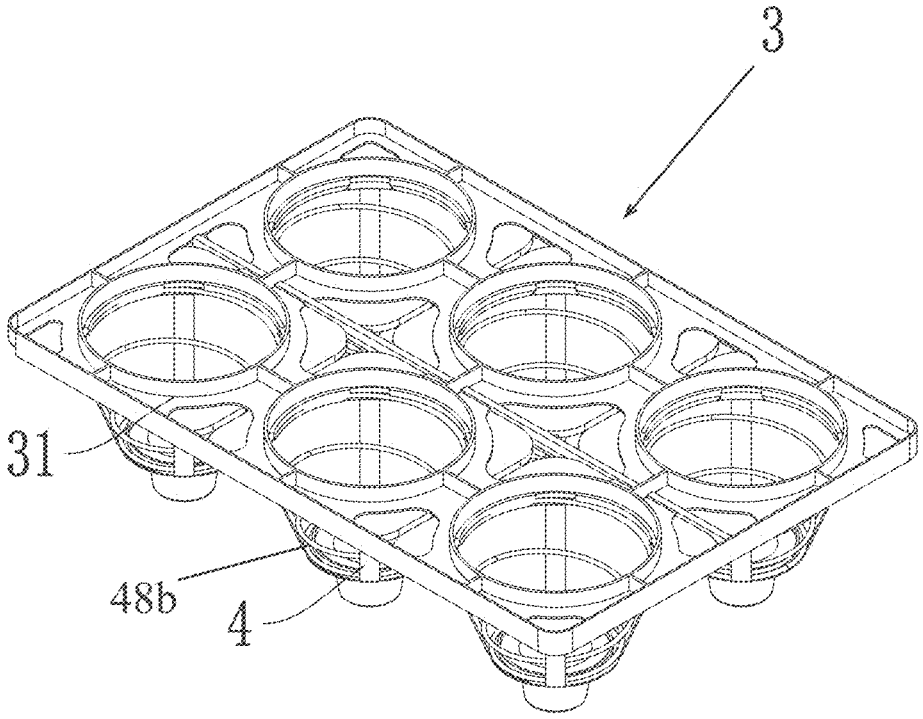
FIG. 61 is a view of the structure of the spring module group housing the inverted tapered spring in Embodiment 15 in the present disclosure.
Figure 62:
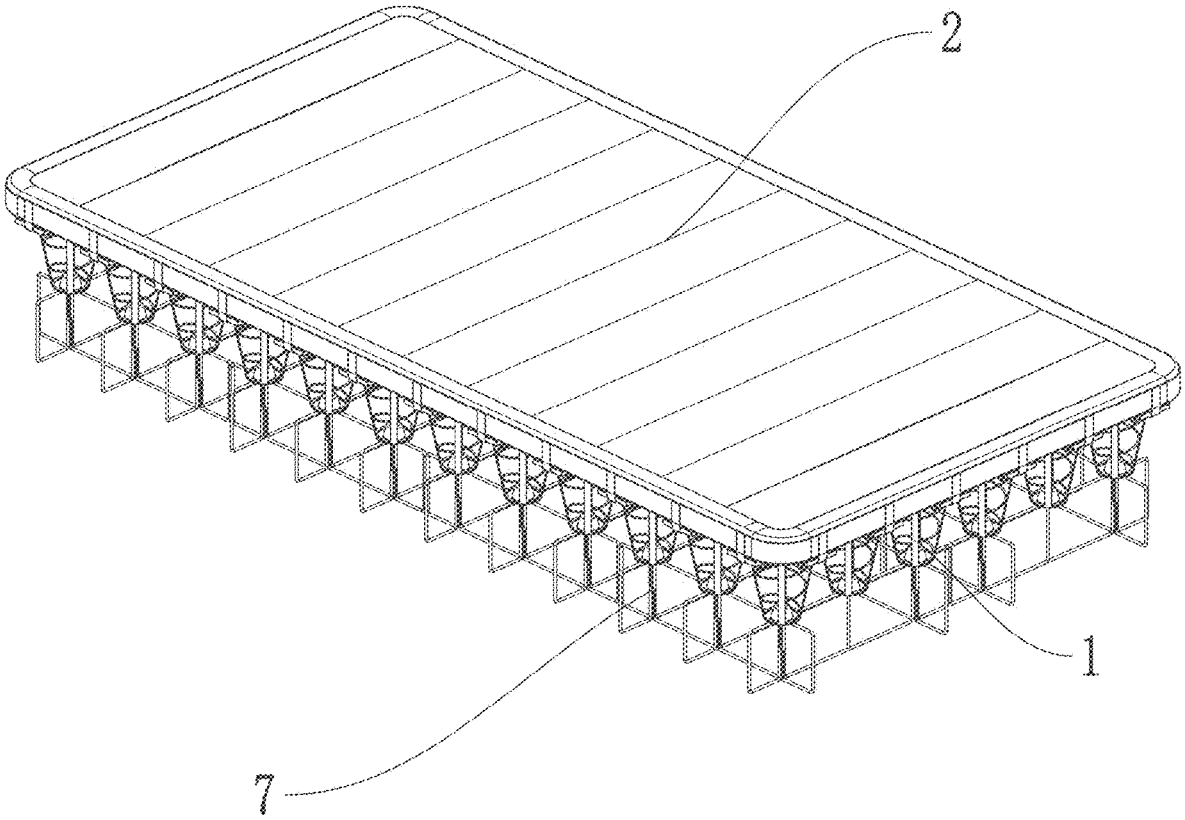
FIG. 62 is a view of a usage state of an elastic mattress in use in Embodiment 16 in the present disclosure.
Figure 63:
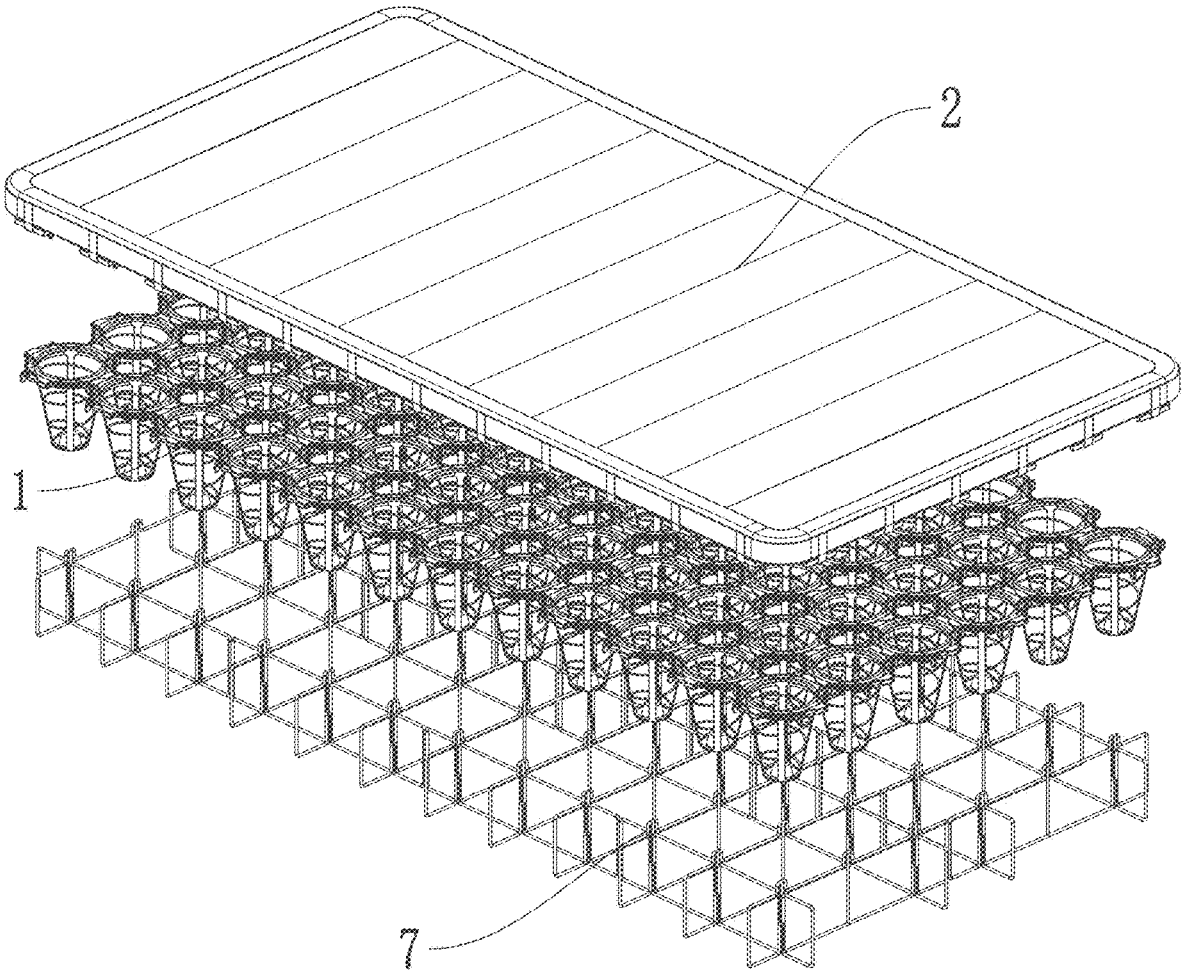
FIG. 63 is an exploded view of the elastic mattress in Embodiment 16 in the present disclosure.
Figure 64:
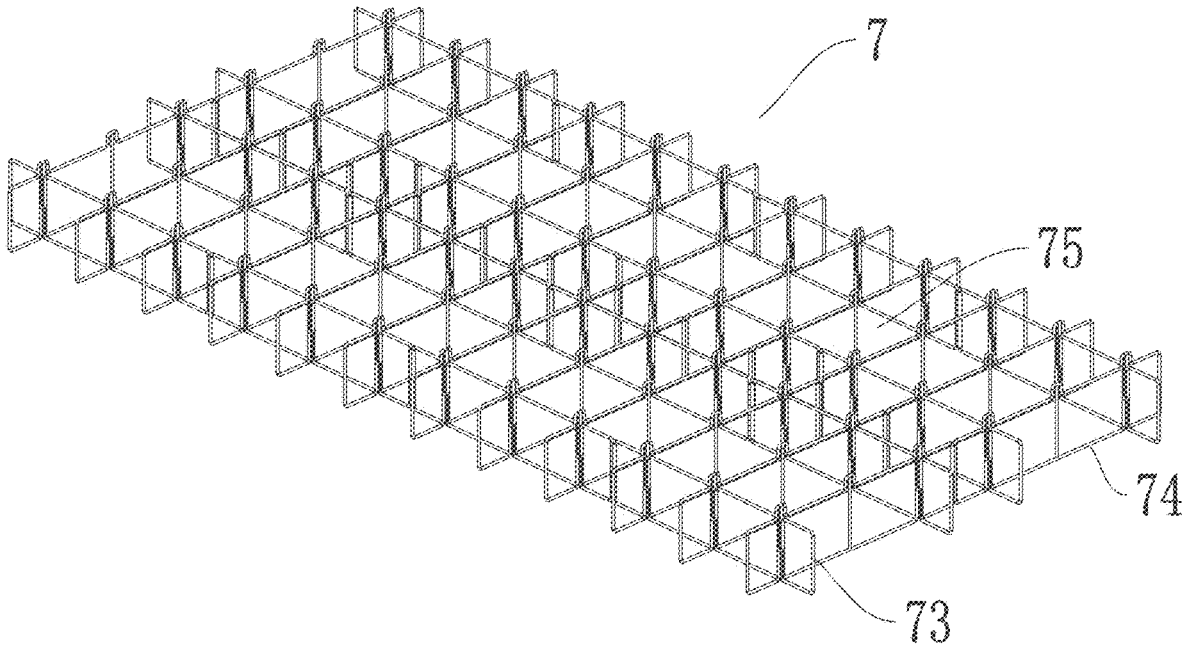
FIG. 64 is a diagrammatic view of a structure of a connecting base in Embodiment 16 in the present disclosure.
Figure 65:
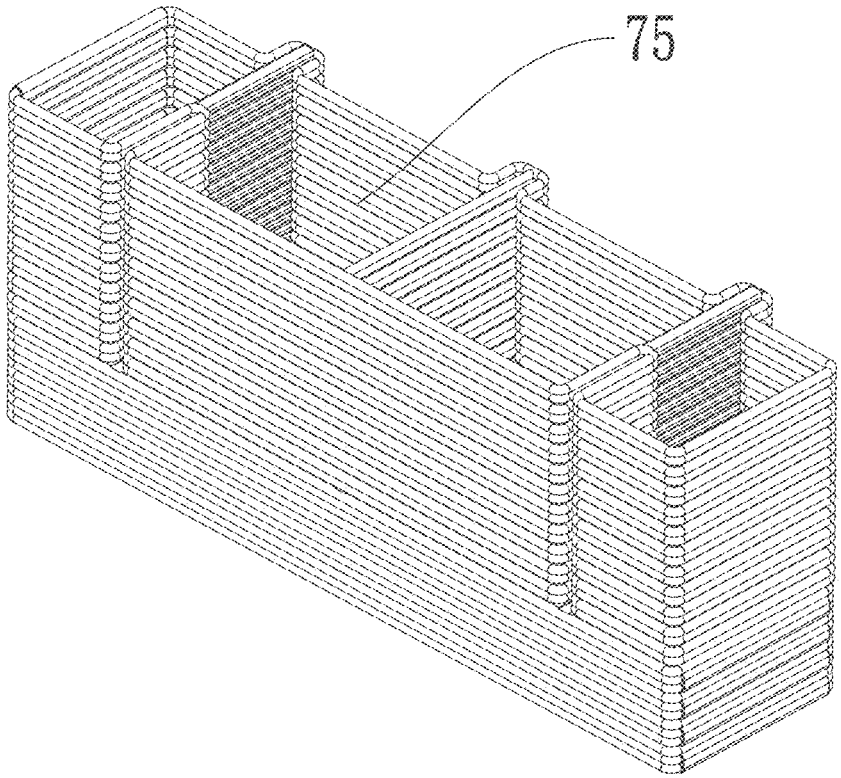
FIG. 65 is a diagrammatic view of the connecting base being folded for storage in Embodiment 16 in the present disclosure.

Referring to FIGS. 60 and 61, different from Embodiment 10, when the plurality of pre-compressed springs 4 housing inverted tapered springs 48*b* form the spring module 1, the spring module 1 is formed using the plurality of pre-compressed springs 4 by splicing in pairs or connecting by one or more third connecting members 6 in this embodiment. In a spring module group 3, the plurality of pre-compressed springs 4 define in staggered or array arrangements.

The spring module group 3 comprises spring bases 31 for assembling the plurality of pre-compressed springs 4, and the plurality of pre-compressed springs 4 are releasably buckled to the spring bases 31 using the spring fixing seats 47 of the plurality of pre-compressed springs 4. Releasable connection structures 5 of the spring bases 31 use structures identical with the releasable connection structures 5 of the spring connecting seats 72 in Embodiment 4.

Specifically, the spring bases 31 comprise comprises sliding rails 721 configured to be slidably connected to the spring fixing seats 47, and the sliding rails 721 inhibit the spring fixing seats 47 from being separated from the spring bases 31 in a vertical direction. One end of each of the spring bases 31 has a sliding-in opening 722 for the spring fixing seats 47. A positioning structure 723 is disposed adjacent to the sliding-in opening 722 and corresponding to a position of a first one of the spring fixing seats 47, and the positioning structure 723 is used to prevent the spring fixing seats 47 from sliding out of the sliding-in opening 722.

Embodiment 16

Referring to FIGS. 62-65, different from Embodiment 10, a focus of this embodiment is on the connecting base 7, and the connecting base 7 having a structure different from Embodiment 10 is provided. The connecting base 7 of this embodiment is formed by a plug-in connection of pairs of frames in multiple groups, and the frames are configured to be released from the plug-in connection.

In this embodiment, the frames are configured as structures that are folded at least once along a length direction of the frames. The frames can be folded for storage, and the folded structures can be folded according to a number of the plurality of pre-compressed springs 4, so that the frames that have been folded for storage can be exactly sleeved on the plurality of pre-compressed springs 4 that are stacked for storage. Specifically, the frames comprise at least one grid layer 75. The at least one grid layer 75 is configured to be sleeved on at least one of the plurality of pre-compressed springs 4 by individual grids. The folded structures in the frames are configured such that a number of the grids of the folded structures is matched with a module number of corresponding ones of the plurality of pre-compressed springs 4 in a spring module group 3 after being folded, and the number of the grids are matched with a module number of the plurality of pre-compressed springs 4 after the plurality of pre-compressed springs 4 are stacked together.

The folded structures can be used for storage to further reduce a storage space of the frames. In this embodiment, in order to be suitable for camping and easy to carry, the elastic mattress further comprises a storage box. The storage box comprises a box body and a box cover configured to be open or close relative to each other, and the box body is configured for storing the connecting base 7 and the plurality of pre-compressed spring 4 after being disassembled.

In this embodiment, the frames in the multiple groups are divided into two groups of the frames having different lengths. The two groups comprise long frames 73 and short frames 74. The long frames 73 are arranged in a longitudinal direction, the short frames 74 are arranged in a lateral direction. The long frames 73 and the short frames 74 are plugged into each other. Insertion structures are insertion grooves on the long frames 73 and the short frames 74, and the insertion grooves are disposed at intervals of a single grid or two and more grids on the frames. Depths of the insertion grooves are equal to at least ⅓ of heights of the grids of the frames. The long frames 73 and the short frames 74 are plugged into each other through the insertion grooves to form the connecting base 7, and a sum of the depths of the insertion grooves corresponding to the long frames 73 and the short frames 74 after insertion is equal to the heights of the grids, so that the connecting base 7 can form a stable connection structure when being assembled by a plug-in connection to ensure a stability of the connecting base 7 in use.

Embodiment 17

Figure 66:
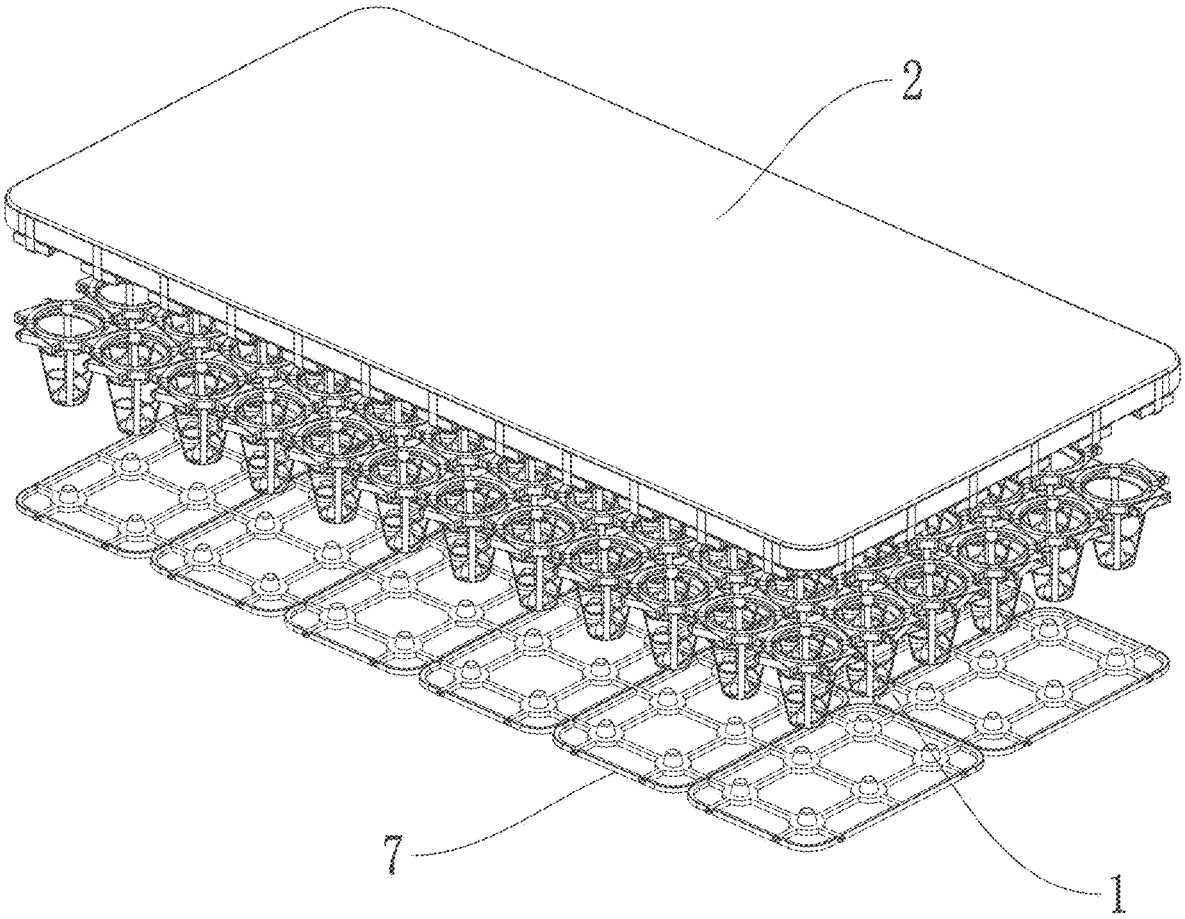
FIG. 66 is an exploded view of an elastic mattress in Embodiment 17 in the present disclosure.
Figure 67:
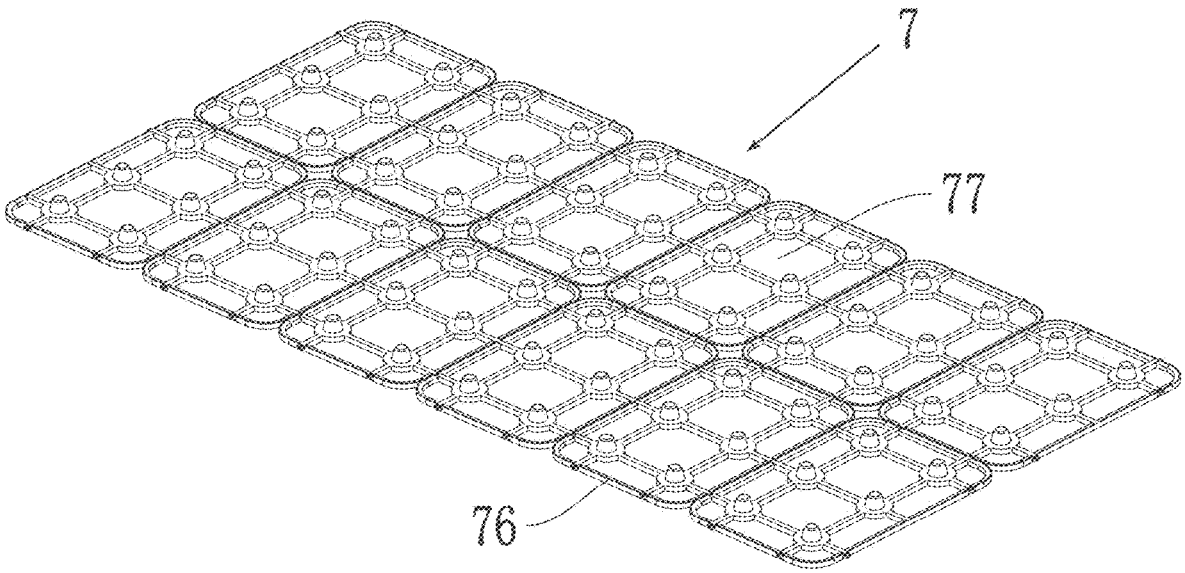
FIG. 67 is a diagrammatic view of a structure of connecting base in Embodiment 17 in the present disclosure.

Referring to FIGS. 66-68, different from Embodiment 10, a focus of this embodiment is on the connecting base 7, and the connecting base 7 having a structure different from Embodiment 10 is provided. A plurality of bottom plates 76 detachably spliced together are provided to define the connecting base 7. The plurality of bottom plates 76 comprise grid structures 77, and a single grid of the grid structures 77 is configured to be sleeved on a single one of the plurality of pre-compressed springs 4.

The plurality of bottom plates 76 comprise splicing structures 760, and the plurality of bottom plates 76 are spliced in pairs using the splicing structures 760 or are spliced using the splicing structures 760 by one or more third connecting members 6. The plurality of bottom plates 76 have a detachable function to be stacked in pairs and be folded for storage, which further reduces a storage space of the plurality of bottom plates 76. In this embodiment, in order to be suitable for camping and easy to carry, the elastic mattress further comprises a storage box. The storage box comprises a box body and a box cover configured to be open or close relative to each other, and the box body is configured for storing the connecting base 7 and the plurality of pre-compressed spring 4 after being disassembled.

The aforementioned description is merely preferred embodiments of the present disclosure, and the design and the concept of the disclosure is not limited thereto. Thus, it is intended that the protective scope of the present disclosure cover non-substantive modifications of the present disclosure provided they are made based on the concepts within the technical scope disclosed in the present disclosure by any technical person familiar with skill in the art.

What is claimed is:

1. An elastic mattress, comprising:

a spring module, and a cushion layer laid on an upper layer of the spring module, wherein:

the spring module is a plurality of pre-compressed springs defining staggered or array arrangements, the plurality of pre-compressed springs are inverted tapered springs, the plurality of pre-compressed springs form large end surfaces and small end surfaces, the small end surfaces are downwardly disposed to form a bottom surface, the large end surfaces are upwardly disposed to form a lying supporting surface, upper sections of the plurality of pre-compressed springs are disposed with connection structures, adjacent pre-compressed springs of the plurality of pre-compressed springs are interconnected by the connection structures or interconnected by the connection structures and one or more third connecting members, a plurality of straps with buckles are disposed on side edges around the cushion layer, and the plurality of straps with buckles form a detachable connection with the connection structures on one or more of the plurality of pre-compressed springs that are disposed on an outer periphery of the spring module or one or more of the one or more third connecting members configured be connected to the one or more of the plurality of pre-compressed springs.

2. The elastic mattress according to claim 1, wherein:

the plurality of pre-compressed springs comprise tapered spring sleeves and connecting seats extending from tapered end surfaces of the tapered spring sleeves, the tapered spring sleeves are configured to accommodate the inverted tapered springs thereinto to form pre-compressed forces applied to the inverted tapered springs, and the connecting seats are disposed at any position within upper sections as ⅓ of the tapered spring sleeves and are configured for installing the connection structures.

3. The elastic mattress according to claim 2, wherein:

a plurality of connection structures of the connection structures are disposed on peripheries of the connecting seats, the plurality of connection structures comprise snapping positions and buckling positions, and one of the snapping positions on one of the plurality of pre-compressed springs forms a buckled connection with one of the buckling positions of another one of the plurality of pre-compressed springs.

4. The elastic mattress according to claim 3, wherein:

the snapping positions are configured to squeeze the buckling positions to contract inward to release the buckled connection when being buckled in the buckling positions.

5. The elastic mattress according to claim 3, wherein:

the snapping positions are configured such that parts of the snapping positions pass through the buckling positions to enable the parts passing through the buckling positions to rotate to form the buckled connection or released from the buckled connection when being disposed in the buckling positions.

6. The elastic mattress according to claim 2, wherein:

a plurality of connection structures of the connection structures are disposed on peripheries of the connecting seats, the plurality of connection structures comprise insertion holes and snapping slots in communication with the insertion holes, widths of the snapping slots are smaller than diameters of the insertion holes, the one or more third connecting members comprise one or more rotating parts and one or more protrusions disposed on one or more end surfaces of the one or more rotating parts, the one or more protrusions are matched with the insertion holes, four of the plurality of pre-compressed springs as a group are buckled together through one of the one or more third connecting members, and when the one or more protrusions are disposed in one or more of the insertion holes, the one or more rotating parts rotate to enable the one or more protrusions to be disposed in one or more of the snapping slots to form a buckled connection or disposed in the one or more of the insertion holes to release the buckled connection.

7. The elastic mattress according to claim 2, wherein:

a plurality of connection structures of the connection structures are disposed on upper ends of peripheries of the connecting seats, the plurality of connection structures are snapping points, a plurality of buckling rings are fixedly connected together to form the one or more third connecting members, each of the plurality of buckling rings of the one or more third connecting members comprises an annular groove and an avoidance opening, the avoidance opening is configured such that a corresponding one of the snapping points is plugged in, and the corresponding one of the snapping points slides in the annular groove to be misaligned with the avoidance opening to enable the annular groove to be buckled to the corresponding one of the snapping points to prevent the corresponding one of the snapping points from being upwardly pulled out.

8. The elastic mattress according to claim 1, wherein:

the one or more third connecting members are made of elastic materials or flexible materials.

9. The elastic mattress according to claim 1, wherein:

the spring module comprises one or more spring bases for assembling the plurality of pre-compressed springs, and spring fixing seats are fixedly connected to the one or more spring bases, or the one or more spring bases are configured to be releasably buckled to the spring fixing seats.

10. The elastic mattress according to claim 1, wherein:

the connection structures are disposed at any position within sections of ½ or ⅓ of heights of the plurality of pre-compressed springs along the large end surfaces, or the connection structures are buckled to the one or more third connecting members.

11. The elastic mattress according to claim 10, wherein:
the connection structures and the one or more third connecting members are made of elastic materials or flexible materials.

12. The elastic mattress according to claim 1, wherein:
the elastic mattress further comprises a connecting base disposed on a lower layer of the spring module,
one of the connecting base or the small end surfaces of the plurality of pre-compressed springs comprises tapered protrusions,
the other one of the connecting base or the small end surfaces of the plurality of pre-compressed springs comprises tapered concave cavities, and
the tapered protrusions and the tapered concave cavities are plugged with each other.

13. The elastic mattress according to claim 12, wherein:
the connecting base is formed by splicing a plurality of second pre-compressed springs housing forward tapered springs on a spring connecting seat,
the plurality of second pre-compressed springs housing the forward tapered springs comprise spring fixing seats configured such that the forward tapered springs are pre-compressed, and
the spring fixing seats are fixedly connected to the spring connecting seat, or the spring connecting seat is configured to be releasably buckled to the spring fixing seats.

14. The elastic mattress according to claim 12, wherein:
the connecting base is formed by a plug-in connection of multiple groups of frames in pairs,
the frames are configured such that the plug-in connection is configured to be released,
the multiple groups of the frames are divided into two groups of the frames having different lengths,
each of the frames comprises at least one grid layer, and
the at least one grid layer is configured to be sleeved on at least one of the plurality of pre-compressed springs by individual grids.

15. The elastic mattress according to claim 14, wherein:
the frames are configured to comprise structures configured to be folded at least once along a length direction of the frames.

16. The elastic mattress according to claim 12, wherein:
the connecting base is formed by detachably splicing a plurality of bottom plates,
the plurality of bottom plates comprise grid structures,
individual grids of the grid structures are configured to be sleeved on individual ones of the plurality of pre-compressed springs,
the plurality of bottom plates comprise splicing structures, and
the plurality of bottom plates are spliced using the splicing structures in pairs or spliced using the splicing structures and the one or more third connecting members.

17. An elastic mattress, comprising:
a spring module, and
a cushion layer laid on an upper layer of the spring module, wherein:
the spring module is spliced by a plurality of pre-compressed springs,
the spring module is the plurality of pre-compressed springs defining staggered or array arrangements,
the plurality of pre-compressed springs are inverted tapered springs,
the plurality of pre-compressed springs form large end surfaces and small end surfaces,
the small end surfaces are downwardly disposed to form a bottom surface,
the large end surfaces are upwardly disposed to form a lying supporting surface,
a plurality of snapping slots are disposed on any position within upper sections as ⅓ of the plurality of pre-compressed springs,
adjacent pre-compressed springs of the plurality of pre-compressed springs form a buckled connection through one or more third connecting members and the plurality of snapping slots,
each of the one or more third connecting members comprises two elastic snapping ends and a connecting part connected to the two elastic snapping ends,
the connecting part has an elastic deformation amount configured to enable the two elastic snapping ends to move away from each other,
the two elastic snapping ends are configured to squeeze the two elastic snapping ends to contract inward to release the buckled connection when being buckled in the plurality of snapping slots,
a plurality of straps with buckles are disposed on side edges around the cushion layer, and
the plurality of straps with buckles form a detachable connection with connection structures on one or more of the plurality of pre-compressed springs that are disposed on an outer periphery of the spring module or the one or more third connecting members configured be connected to the one or more of the plurality of pre-compressed springs.

* * * * *